US008756946B2

(12) United States Patent
Li

(10) Patent No.: US 8,756,946 B2
(45) Date of Patent: Jun. 24, 2014

(54) METHOD TO IMPROVE HEATING TEMPERATURE OF HEAT PUMP AND SECOND-TYPE HIGH TEMPERATURE ABSORPTION HEAT PUMP

(76) Inventor: Huayu Li, Qingdao (CN)

( * ) Notice: Subject to any disclaimer, the term of this patent is extended or adjusted under 35 U.S.C. 154(b) by 103 days.

(21) Appl. No.: 13/263,743

(22) PCT Filed: Apr. 14, 2010

(86) PCT No.: PCT/CN2010/000491

§ 371 (c)(1),
(2), (4) Date: Oct. 9, 2011

(87) PCT Pub. No.: WO2010/118636

PCT Pub. Date: Oct. 21, 2010

(65) Prior Publication Data

US 2012/0031122 A1 Feb. 9, 2012

(30) Foreign Application Priority Data

Apr. 14, 2009 (CN) ..... 2009 1 0020152

(51) Int. Cl.
*F25D 15/00* (2006.01)

(52) U.S. Cl.
USPC ..... 62/119; 62/476

(58) Field of Classification Search
CPC ..... F25B 23/006; F25B 15/006; F25B 17/04; F25B 17/083; F25B 17/08; F25B 25/02; F25B 17/00
USPC ..... 62/119, 324.1, DIG. 2, 160, 238.7, 476, 62/478, 481, 483
See application file for complete search history.

(56) References Cited

U.S. PATENT DOCUMENTS

| | | | | | |
|---|---|---|---|---|---|
| 2,437,577 | A | * | 3/1948 | Williams | 62/141 |
| 2,494,972 | A | * | 1/1950 | Thomas et al. | 62/195 |
| 2,550,429 | A | * | 4/1951 | Reid, Jr. | 62/148 |
| 3,593,540 | A | * | 7/1971 | Hopkins | 62/476 |
| 3,831,397 | A | * | 8/1974 | Mamiya | 62/476 |
| 4,100,755 | A | * | 7/1978 | Leonard | 62/104 |
| 4,209,364 | A | * | 6/1980 | Rothschild | 203/11 |
| 4,290,273 | A | * | 9/1981 | Meckler | 62/148 |
| 4,311,024 | A | * | 1/1982 | Itoh et al. | 62/474 |
| 4,348,868 | A | * | 9/1982 | Foster et al. | 62/101 |
| 4,439,999 | A | * | 4/1984 | Mori et al. | 62/238.3 |
| 4,471,630 | A | * | 9/1984 | Sugimoto et al. | 62/175 |
| 4,509,336 | A | * | 4/1985 | Ouchi et al. | 62/112 |
| 4,593,531 | A | * | 6/1986 | Fujimoto | 62/101 |
| 4,672,821 | A | * | 6/1987 | Furutera et al. | 62/324.2 |
| 5,653,116 | A | * | 8/1997 | Erickson et al. | 62/101 |
| 5,673,569 | A | * | 10/1997 | Inoue | 62/324.2 |

(Continued)

*Primary Examiner* — Mohammad M Ali

(57) ABSTRACT

The method to improve the heating temperature of heat pump and the second-type high temperature absorption heat pump both belong to the field of heat pump technology. We can get the corresponding second-type high temperature absorption heat pump based on the second-type low temperature absorption heat pump as following ways. In the second-type low temperature absorption heat pump, we add the new added steam bleeding chamber, the new added absorber, then new added throttle or the new added liquid refrigerant pump, the new added solution pump and the new added solution heat exchanger. And some pipes are connected in a reasonable way. Or we adjust the connection of some pipes too. Then we can achieve correspondingly the three-stage high temperature second-type absorption heat pump or the high temperature second-type absorption heat pump with multi-terminal heating or the recuperative high temperature second-type absorption heat pump by combining some other components.

33 Claims, 26 Drawing Sheets

(56) References Cited

U.S. PATENT DOCUMENTS 6,038,882 A * 3/2000 Kuroda et al. ..... 62/476
6,357,254 B1 * 3/2002 Xia ..... 62/476
6,536,229 B1 * 3/2003 Takabatake et al. ..... 62/476
6,550,272 B2 * 4/2003 Nakajima et al. ..... 62/476

* cited by examiner

METHOD TO IMPROVE HEATING TEMPERATURE OF HEAT PUMP AND SECOND-TYPE HIGH TEMPERATURE ABSORPTION HEAT PUMP

BACKGROUND OF THE PRESENT INVENTION

1. Field of Invention

This invention belongs to the area of low-temperature residual heat utilization using the heat pump technology.

2. Description of Related Arts

Under the premise that heat pump can promote the residual heat temperature to the needed level of user, it is an effective way to develop residual heat by adopting heat pump technology which can bring a better energy conservation, environmental protection and economic interest. In the place of rich waste heat resources, the heating temperature of the second-type low temperature absorption heat pump can't meet the needs of customers if the residual heat temperature is relatively low or the hot demand temperature of users is relatively high. Now, we need adopt the second-type high temperature absorption heat pump which can achieve a higher temperature.

The driving force of the second-type absorption heat pump is the temperature difference between waste heat resources and environment. The temperature difference is relatively small. So in the second-type absorption heat pump, it is the first principle to get the second-type high temperature absorption heat pump with reasonable process and simple structure. Too much heat transfer links may not only lead to that the structure and process of heat pump unit is complex, but also have a great impact on the enhancement effect of residual heat temperature in heat pump units. So reducing the heat transfer links in the improving process of the residual heat temperature not only is beneficial to a further promoting of the residual heat temperature, but also is good for a further simplify of heat pump structure.

On the premise of greatly enhancing of waste heat temperature, simplify the structure and reducing heat transfer links, the invention comes up with a method to improve the heating temperature of the second-type absorption heat pump. Based on the existing heat pump units, the heating temperature of which is relatively low, we can get a series of second-type high temperature absorption heat pump by using this method.

SUMMARY OF THE PRESENT INVENTION

The main purpose of the invention is to provide a method which can improve the heating temperature of heat pump at first. Then, we use the method on the existing second-type absorption heat pump which only has a relatively low heating temperature. In this way, we can gain the corresponding second-type high temperature absorption heat pump. The specific contents of invention are as follows.

1. The method to improve the heating temperature of heat pump is that we add some components such as the new added steam bleeding chamber, the new added absorber, the new added throttle or the new added liquid refrigerant pump, the new added solution pump and the new added solution heat exchanger on the second-type low temperature absorption heat pump. We adopt the solution tandem cycle as following. We change that generator or the steam bleeding chamber has the concentrated solution pipe which passes through solution pump, solution heat exchanger and absorber to that generator or the steam bleeding chamber has the concentrated solution pipe which passes through solution pump, solution heat exchanger, absorber and the new added steam bleeding chamber. The new added steam bleeding chamber has the concentrated solution pipe which passes through the new added solution pump and the new added solution heat exchanger and then connects the new added absorber. The new added absorber has the dilute solution pipe which passes through the new added solution heat exchanger and then connects absorber. We change that absorber has the heated medium pipe connected external to that absorber has refrigerant vapor channel connected the new added absorber after that condenser or evaporator add the liquid refrigerant pipe which passes through the new added liquid refrigerant pump and then connects absorber. Or we change that absorber has the heated medium pipe connected external to that absorber has refrigerant vapor channel connected the new added absorber after that condenser has the liquid refrigerant pipe which passes through liquid refrigerant pump and then connects absorber. At the same time, we adjust that condenser has the liquid refrigerant pipe which passes through liquid refrigerant pump and then connects evaporator to that condenser has the liquid refrigerant pipe which passes through liquid refrigerant pump, the new added throttle and then connects evaporator.

The new added steam bleeding chamber has refrigerant vapor channel connected condenser. The new added absorber has the heated medium pipe connected external. The residual heat temperature is promoted for the first time in the second-type low temperature absorption heat pump and the heating load is formed in absorber. A part of the heating load heats up the solution which flows through absorber and then the solution enters the new added steam bleeding chamber releasing refrigerant vapor which is provided to condenser. At the same time, the concentrated solution is provided to the new added absorber. The other part of the heating load heats up the liquid refrigerant which flows through absorber and releases the high temperature refrigerant vapor which is provided to the new added absorber. The concentrated solution which enters the new added absorber absorbs the refrigerant vapor came from absorber and provides high temperature heating load to the heated medium. Consequently, we achieve the second stage improving of residual heat temperature.

2. The method to improve the heating temperature of heat pump is that we add some components such as the new added steam bleeding chamber, the new added absorber, the new added throttle or the new added liquid refrigerant pump, the new added solution pump and the new added solution heat exchanger on the second-type low temperature absorption heat pump. We adopt the solution independent cycle as following. The new added steam bleeding chamber has the concentrated solution pipe which passes through the new added solution pump and the new added solution heat exchanger and then connects the new added absorber. The new added absorber has the dilute solution pipe which passes through the new added solution heat exchanger, absorber and then connects the new added steam bleeding chamber. We change that absorber has the heated medium pipe connected external to that absorber has refrigerant vapor channel connected the new added absorber after that condenser or evaporator add the liquid refrigerant pipe which passes through the new added liquid refrigerant pump and then connects absorber. Or we change that absorber has the heated medium pipe connected external to that absorber has refrigerant vapor channel connected the new added absorber after that condenser has the liquid refrigerant pipe which passes through liquid refrigerant pump and then connects absorber. At the same time, we adjust that condenser has the liquid refrigerant pipe which passes through liquid refrigerant pump and then connects evaporator to that condenser has the liquid refrigerant pipe which passes through liquid refrigerant pump, the new added throttle and then connects evaporator.

The new added steam bleeding chamber has refrigerant vapor channel connected condenser. The new added absorber has the heated medium pipe connected external. The residual heat temperature is promoted for the first time in the second-type low temperature absorption heat pump and the heating load is formed in absorber. A part of the heating load heats up the solution which flows through absorber and then the solution enters the new added steam bleeding chamber releasing refrigerant vapor. At the same time, the concentrated solution is provided to the new added absorber. The other part of the heating load heats up the liquid refrigerant which flows through absorber and releases the high temperature refrigerant vapor which is provided to the new added absorber. The concentrated solution which enters the new added absorber absorbs the refrigerant vapor came from absorber and provides high temperature heating load to the heated medium. Consequently, we achieve the second stage improving of residual heat temperature.

3. The second-type high temperature absorption heat pump, based on the method expounded in item 1, is formed by adding the new added steam bleeding chamber, the new added absorber, the new added liquid refrigerant pump or the new added throttle, the new added solution pump and the new added solution heat exchanger on the single stage second-type absorption heat pump which comprises generator, condenser, evaporator, absorber, solution pump, liquid refrigerant pump and solution heat exchanger. In the single stage second-type absorption heat pump, generator has the concentrated solution pipe which passes through solution pump, solution heat exchanger and then connects absorber. Absorber has the dilute solution pipe which passes through solution heat exchanger and then connects generator. Generator has refrigerant vapor pipe connected condenser. Condenser has the liquid refrigerant pipe which passes through liquid refrigerant pump and then connects evaporator. Evaporator has the refrigerant vapor channel connected absorber. Generator and evaporator have the residual heat pipe connected external. Condenser has the liquid refrigerant channel connected absorber. Generator and evaporator have the residual heat medium pipe connected external. Condenser has the cooling medium pipe connected external. Absorber has the heated medium pipe connected external.

We adopt the solution tandem cycle as following. We change that generator has the concentrated solution pipe which passes through solution pump, solution heat exchanger and then connects absorber to that generator has the concentrated solution pipe which passes through solution pump, solution heat exchanger, absorber and then connects the new added steam bleeding chamber. The new added steam bleeding chamber has the concentrated solution pipe which passes through the new added solution pump and the new added solution heat exchanger and then connects the new added absorber. The new added absorber has the dilute solution pipe which passes through the new added solution heat exchanger and then connects absorber.

We change that absorber has the heated medium pipe connected external to that absorber has refrigerant vapor channel connected the new added absorber after that condenser or evaporator add the liquid refrigerant pipe which passes through the new added liquid refrigerant pump and then connects absorber. Or we change that absorber has the heated medium pipe connected external to that absorber has refrigerant vapor channel connected the new added absorber after that condenser has the liquid refrigerant pipe which passes through liquid refrigerant pump and then connects absorber. At the same time, we adjust that condenser has the liquid refrigerant pipe which passes through liquid refrigerant pump and then connects evaporator to that condenser has the liquid refrigerant pipe which passes through liquid refrigerant pump, the new added throttle and then connects evaporator.

The new added steam bleeding chamber has refrigerant vapor channel connected condenser. The new added absorber has the heated medium pipe connected external. The single stage second-type absorption heat pump completes the first stage improving of residual heat temperature. Absorber heats up the liquid refrigerant which flows through it. And the liquid refrigerant becomes refrigerant vapor provided to the new added absorber. Absorber heats up the solution which flows through it too. After that part of the solution is vaporization, it enters the new added steam bleeding chamber. The refrigerant vapor produced by the new added steam bleeding chamber enters condenser. At the same time, the concentrated solution enters the new added absorber, absorbs the refrigerant vapor came from absorber and provides the high temperature heating load to the heated medium. Consequently, we achieve the two-stage high temperature second-type absorption heat pump based on the single stage second-type absorption heat pump.

4. The second-type high temperature absorption heat pump, based on the method expounded in item 2, is formed by adding the new added steam bleeding chamber, the new added absorber, the new added liquid refrigerant pump or the new added throttle, the new added solution pump and the new added solution heat exchanger on the single stage second-type absorption heat pump which comprises generator, condenser, evaporator, absorber, solution pump, liquid refrigerant pump and solution heat exchanger. In the single stage second-type absorption heat pump, generator has the concentrated solution pipe which passes through solution pump, solution heat exchanger and then connects absorber. Absorber has the dilute solution pipe which passes through solution heat exchanger and then connects generator. Generator has refrigerant vapor pipe connected condenser. Condenser has the liquid refrigerant pipe which passes through liquid refrigerant pump and then connects evaporator. Evaporator has the refrigerant vapor channel connected absorber. Generator and evaporator have the residual heat pipe connected external. Condenser has the liquid refrigerant channel connected absorber. Generator and evaporator have the residual heat medium pipe connected external. Condenser has the cooling medium pipe connected external. Absorber has the heated medium pipe connected external.

We adopt the solution independent cycle as following. The new added steam bleeding chamber has the concentrated solution pipe which passes through the new added solution pump and the new added solution heat exchanger and then connects the new added absorber. The new added absorber has the dilute solution pipe which passes through the new added solution heat exchanger, absorber and then connects the new added steam bleeding chamber.

We change that absorber has the heated medium pipe connected external to that absorber has refrigerant vapor channel connected the new added absorber after that condenser or evaporator add the liquid refrigerant pipe which passes through the new added liquid refrigerant pump and then connects absorber. Or we change that absorber has the heated medium pipe connected external to that absorber has refrigerant vapor channel connected the new added absorber after that condenser has the liquid refrigerant pipe which passes through liquid refrigerant pump and then connects absorber. At the same time, we adjust that condenser has the liquid refrigerant pipe which passes through liquid refrigerant pump and then connects evaporator to that condenser has the liquid refrigerant pipe which passes through liquid refrigerant pump, the new added throttle and then connects evaporator.

The new added steam bleeding chamber has refrigerant vapor channel connected condenser. The new added absorber has the heated medium pipe connected external. The single stage second-type absorption heat pump completes the first stage improving of residual heat temperature. Absorber heats up the liquid refrigerant which flows through it. And the liquid refrigerant becomes refrigerant vapor provided to the new added absorber. Absorber heats up the solution which flows through it too. After that part of the solution is vaporization, it enters the new added steam bleeding chamber. The refrigerant vapor produced by the new added steam bleeding chamber enters condenser. At the same time, the concentrated solution enters the new added absorber, absorbs the refrigerant vapor came from absorber and provides the high temperature heating load to the heated medium. Consequently, we achieve the two-stage high temperature second-type absorption heat pump based on the single stage second-type absorption heat pump.

5. The second-type high temperature absorption heat pump, based on the method expounded in item 1, is formed by adding the new added steam bleeding chamber, the new added absorber, the new added liquid refrigerant pump or the new added throttle, the new added solution pump and the new added solution heat exchanger on the recuperative single stage second-type absorption heat pump which comprises generator, condenser, evaporator, the first absorber, the first solution pump, liquid refrigerant pump, the second absorber, the steam bleeding chamber, the second solution pump or/and the third solution pump, the first solution heat exchanger and the second solution heat exchanger.

In the recuperative single stage second-type absorption heat pump, generator has the concentrated solution pipe which passes through the first solution pump, the second solution heat exchanger (L1), the second absorber and then connects the steam bleeding chamber (I1). The steam bleeding chamber (I1) has the concentrated solution pipe which passes through the second solution pump (J1), the first solution heat exchanger and then connects the first absorber. The first absorber has the dilute solution pipe which passes through the first solution heat exchanger or/and the third solution heat exchanger (K1) and then connects the second absorber. The second absorber has the dilute solution pipe which passes through the second solution heat exchanger (L1) and then connects generator. Generator and the steam bleeding chamber (I1) have refrigerant vapor pipe connected condenser. Condenser has the liquid refrigerant pipe which passes through liquid refrigerant pump and then connects evaporator. Evaporator has refrigerant vapor channel which separately connects the first absorber and the second absorber. Generator and evaporator have the residual heat medium pipe connected external. Condenser has the cooling medium pipe connected external. The first absorber has the heated medium pipe connected external.

We adopt the solution tandem cycle as following. We change that the steam bleeding chamber (I1) has the concentrated solution pipe which passes through the second solution pump (J1), the first solution heat exchanger and then connects the first absorber to that the steam bleeding chamber (I1) has the concentrated solution pipe which passes through the second solution pump (J1), the first solution heat exchanger, the first absorber and then connects the new added steam bleeding chamber. The new added steam bleeding chamber has the concentrated solution pipe which passes through the new added solution pump and the new added solution heat exchanger and then connects the new added absorber. The new added absorber has the dilute solution pipe which passes through the new added solution heat exchanger and then connects absorber.

We change that the first absorber has the heated medium pipe connected external to that the first absorber has refrigerant vapor channel connected the new added absorber after that condenser or evaporator add the liquid refrigerant pipe which passes through the new added liquid refrigerant pump and then connects absorber. Or we change that the first absorber has the heated medium pipe connected external to that the first absorber has refrigerant vapor channel connected the new added absorber after that condenser has the liquid refrigerant pipe which passes through liquid refrigerant pump and then connects the first absorber. At the same time, we adjust that condenser has the liquid refrigerant pipe which passes through liquid refrigerant pump and then connects evaporator to that condenser has the liquid refrigerant pipe which passes through liquid refrigerant pump, the new added throttle and then connects evaporator.

The new added steam bleeding chamber has refrigerant vapor channel connected condenser. The new added absorber has the heated medium pipe connected external. The recuperative single stage second-type absorption heat pump completes the first stage improving of residual heat temperature. The first absorber heats up the liquid refrigerant which flows through it. And the liquid refrigerant becomes refrigerant vapor provided to the new added absorber. The first absorber heats up the solution which flows through it too. After that part of the solution is vaporization, it enters the new added steam bleeding chamber. The refrigerant vapor produced by the new added steam bleeding chamber enters condenser. At the same time, the concentrated solution enters the new added absorber, absorbs the refrigerant vapor came from the first absorber and provides the high temperature heating load to the heated medium. Consequently, we achieve the two-stage high temperature second-type absorption heat pump based on the recuperative single stage second-type absorption heat pump.

6. The second-type high temperature absorption heat pump, based on the method expounded in item 1, is formed by adding the new added steam bleeding chamber, the new added absorber, the new added liquid refrigerant pump or the new added throttle, the new added solution pump and the new added solution heat exchanger on the recuperative single stage second-type absorption heat pump which comprises generator, condenser, the first evaporator, the second evaporator, the first absorber, the first solution pump, liquid refrigerant pump, the second absorber, the steam bleeding chamber, the second solution pump, throttle, the first solution heat exchanger and the second solution heat exchanger.

In the recuperative single stage second-type absorption heat pump, generator has the concentrated solution pipe which passes through the first solution pump, the second solution heat exchanger, the second absorber and then connects the steam bleeding chamber. The steam bleeding chamber has the concentrated solution pipe which passes through the second solution pump, the first solution heat exchanger and then connects the first absorber. The first absorber has the dilute solution pipe which passes through the first solution heat exchanger and then connects the second absorber. The second absorber has the dilute solution pipe which passes through the second solution heat exchanger and then connects generator. Generator and the steam bleeding chamber have refrigerant vapor pipe connected condenser. Condenser has the liquid refrigerant pipe which passes through liquid refrigerant pump and then connects the first evaporator. The first evaporator has liquid refrigerant pipe which passes through throttle and then connects the second evaporator. The first evaporator has refrigerant vapor channel connected the first absorber. The second evaporator has refrigerant vapor channel connected the second absorber. Generator, the first evaporator and the second evaporator have the residual heat medium pipe connected external. Condenser has the cooling medium pipe connected external. The first absorber has the heated medium pipe connected external.

We adopt the solution tandem cycle as following. We change that the steam bleeding chamber has the concentrated solution pipe which passes through the second solution pump, the first solution heat exchanger and then connects the first absorber to that the steam bleeding chamber has the concentrated solution pipe which passes through the second solution pump, the first solution heat exchanger, the first absorber and then connects the new added steam bleeding chamber. The new added steam bleeding chamber has the concentrated solution pipe which passes through the new added solution pump and the new added solution heat exchanger and then connects the new added absorber. The new added absorber has the dilute solution pipe which passes through the new added solution heat exchanger and then connects absorber.

We change that the first absorber has the heated medium pipe connected external to that the first absorber has refrigerant vapor channel connected the new added absorber after that condenser or the first evaporator add the liquid refrigerant pipe which passes through the new added liquid refrigerant pump and then connects absorber. Or we change that the first absorber has the heated medium pipe connected external to that the first absorber has refrigerant vapor channel connected the new added absorber after that condenser has the liquid refrigerant pipe which passes through liquid refrigerant pump and then connects the first absorber. At the same time, we adjust that condenser has the liquid refrigerant pipe which passes through liquid refrigerant pump and then connects the first evaporator to that condenser has the liquid refrigerant pipe which passes through liquid refrigerant pump, the new added throttle and then connects the first evaporator.

The new added steam bleeding chamber has refrigerant vapor channel connected condenser. The new added absorber has the heated medium pipe connected external. The recuperative single stage second-type absorption heat pump completes the first stage improving of residual heat temperature. The first absorber heats up the liquid refrigerant which flows through it. And the liquid refrigerant becomes refrigerant vapor provided to the new added absorber. The first absorber heats up the solution which flows through it too. After that part of the solution is vaporization, it enters the new added steam bleeding chamber. The refrigerant vapor produced by the new added steam bleeding chamber enters condenser. At the same time, the concentrated solution enters the new added absorber, absorbs the refrigerant vapor came from the first absorber and provides the high temperature heating load to the heated medium. Consequently, we achieve the two-stage high temperature second-type absorption heat pump based on the recuperative single stage second-type absorption heat pump.

7. The second-type high temperature absorption heat pump, based on the method expounded in item 2, is formed by adding the new added steam bleeding chamber, the new added absorber, the new added liquid refrigerant pump or the new added throttle, the new added solution pump and the new added solution heat exchanger on the recuperative single stage second-type absorption heat pump which comprises generator, condenser, evaporator, the first absorber, the first solution pump, liquid refrigerant pump, the second absorber, the steam bleeding chamber, the second solution pump, the first solution heat exchanger and the second solution heat exchanger.

In the recuperative single stage second-type absorption heat pump, generator has the concentrated solution pipe which passes through the first solution pump, the second solution heat exchanger and then connects the second absorber. The steam bleeding chamber has the concentrated solution pipe which passes through the second solution pump, the first solution heat exchanger and then connects the first absorber. The first absorber has the dilute solution pipe which passes through the first solution heat exchanger, the second absorber and then connects the steam bleeding chamber. Generator and the steam bleeding chamber have refrigerant vapor pipe connected condenser. Condenser has the liquid refrigerant pipe which passes through liquid refrigerant pump and then connects evaporator. Evaporator has refrigerant vapor channel which separately connects the first absorber and the second absorber. Generator and evaporator have the residual heat medium pipe connected external. Condenser has the cooling medium pipe connected external. The first absorber has the heated medium pipe connected external.

We adopt the solution independent cycle as following. The new added steam bleeding chamber has the concentrated solution pipe which passes through the new added solution pump and the new added solution heat exchanger and then connects the new added absorber. The new added absorber has the dilute solution pipe which passes through the new added solution heat exchanger, absorber and then connects the new added steam bleeding chamber.

We change that the first absorber has the heated medium pipe connected external to that the first absorber has refrigerant vapor channel connected the new added absorber after that condenser or evaporator add the liquid refrigerant pipe which passes through the new added liquid refrigerant pump and then connects absorber. Or we change that the first absorber has the heated medium pipe connected external to that the first absorber has refrigerant vapor channel connected the new added absorber after that condenser has the liquid refrigerant pipe which passes through liquid refrigerant pump and then connects the first absorber. At the same time, we adjust that condenser has the liquid refrigerant pipe which passes through liquid refrigerant pump and then connects evaporator to that condenser has the liquid refrigerant pipe which passes through liquid refrigerant pump, the new added throttle and then connects evaporator.

The new added steam bleeding chamber has refrigerant vapor channel connected condenser. The new added absorber has the heated medium pipe connected external. The recuperative single stage second-type absorption heat pump completes the first stage improving of residual heat temperature. The first absorber heats up the liquid refrigerant which flows through it. And the liquid refrigerant becomes refrigerant vapor provided to the new added absorber. The first absorber heats up the solution which flows through it too. After that part of the solution is vaporization, it enters the new added steam bleeding chamber. The refrigerant vapor produced by the new added steam bleeding chamber enters condenser. At the same time, the concentrated solution enters the new added absorber, absorbs the refrigerant vapor came from the first absorber and provides the high temperature heating load to the heated medium. Consequently, we achieve the two-stage high temperature second-type absorption heat pump based on the recuperative single stage second-type absorption heat pump.

8. The second-type high temperature absorption heat pump, based on the method expounded in item 2, is formed by adding the new added steam bleeding chamber, the new added absorber, the new added liquid refrigerant pump or the new added throttle, the new added solution pump and the new added solution heat exchanger on the recuperative single stage second-type absorption heat pump which comprises generator, condenser, the first evaporator, the second evaporator, the first absorber, the first solution pump, liquid refrigerant pump, the second absorber, the steam bleeding chamber, the second solution pump, throttle, the first solution heat exchanger and the second solution heat exchanger.

In the recuperative single stage second-type absorption heat pump, generator has the concentrated solution pipe which passes through the first solution pump, the second solution heat exchanger and then connects the second absorber. The second absorber has the dilute solution pipe which passes through the second solution heat exchanger and then connects generator. The steam bleeding chamber has the concentrated solution pipe which passes through the second solution pump, the first solution heat exchanger and then connects the first absorber. The first absorber has the dilute solution pipe which passes through the first solution heat exchanger, the second absorber and then connects the steam bleeding chamber. Generator and the steam bleeding chamber have refrigerant vapor pipe connected condenser. Condenser has the liquid refrigerant pipe which passes through liquid refrigerant pump and then connects the first evaporator. The first evaporator has liquid refrigerant pipe which passes through throttle and then connects the second evaporator. The first evaporator has refrigerant vapor channel connected the first absorber. The second evaporator has refrigerant vapor channel connected the second absorber. Generator, the first evaporator and the second evaporator have the residual heat medium pipe connected external. Condenser has the cooling medium pipe connected external. The first absorber has the heated medium pipe connected external.

We adopt the solution independent cycle as following. The new added steam bleeding chamber has the concentrated solution pipe which passes through the new added solution pump and the new added solution heat exchanger and then connects the new added absorber. The new added absorber has the dilute solution pipe which passes through the new added solution heat exchanger, absorber and then connects the new added steam bleeding chamber.

We change that the first absorber has the heated medium pipe connected external to that the first absorber has refrigerant vapor channel connected the new added absorber after that condenser or the first evaporator add the liquid refrigerant pipe which passes through the new added liquid refrigerant pump and then connects absorber. Or we change that the first absorber has the heated medium pipe connected external to that the first absorber has refrigerant vapor channel connected the new added absorber after that condenser has the liquid refrigerant pipe which passes through liquid refrigerant pump and then connects the first absorber. At the same time, we adjust that condenser has the liquid refrigerant pipe which passes through liquid refrigerant pump and then connects the first evaporator to that condenser has the liquid refrigerant pipe which passes through liquid refrigerant pump, the new added throttle and then connects the first evaporator.

The new added steam bleeding chamber has refrigerant vapor channel connected condenser. The new added absorber has the heated medium pipe connected external. The recuperative single stage second-type absorption heat pump completes the first stage improving of residual heat temperature. The first absorber heats up the liquid refrigerant which flows through it. And the liquid refrigerant becomes refrigerant vapor provided to the new added absorber. The first absorber heats up the solution which flows through it too. After that part of the solution is vaporization, it enters the new added steam bleeding chamber. The refrigerant vapor produced by the new added steam bleeding chamber enters condenser. At the same time, the concentrated solution enters the new added absorber, absorbs the refrigerant vapor came from the first absorber and provides the high temperature heating load to the heated medium. Consequently, we achieve the two-stage high temperature second-type absorption heat pump based on the recuperative single stage second-type absorption heat pump.

9. The second-type high temperature absorption heat pump, based on any of the second-type high temperature absorption heat pumps expounded in item 7-8, is formed in the following way. We adjust that the first absorber has the refrigerant vapor pipe connected the new added absorber after that the new added liquid refrigerant pump or liquid refrigerant pump has the liquid refrigerant pipe connected the second absorber to that the first absorber has the refrigerant vapor pipe connected the new added absorber after that the new added liquid refrigerant pump or liquid refrigerant pump has the liquid refrigerant pipe connected the second absorber.

The recuperative single stage second-type absorption heat pump completes the first stage improving of residual heat temperature. The second absorber heats up the liquid refrigerant which flows through it. And the liquid refrigerant becomes refrigerant vapor provided to the new added absorber. The first absorber heats up the solution which flows through it too. After that part of the solution is vaporization, it enters the new added steam bleeding chamber. The refrigerant vapor produced by the new added steam bleeding chamber enters condenser. At the same time, the concentrated solution enters the new added absorber, absorbs the refrigerant vapor came from the second absorber and provides the high temperature heating load to the heated medium. When the first absorber has the heated medium pipe connected external, the second absorber and the new added absorber separately provide heat to the heated medium. Consequently, we achieve the two-stage high temperature second-type absorption heat pump based on the recuperative single stage double-effect second-type absorption heat pump.

10. The second-type high temperature absorption heat pump, based on the method expounded in item 1, is formed by adding the new added steam bleeding chamber, the new added absorber, the new added liquid refrigerant pump or the new added throttle, the new added solution pump and the new added solution heat exchanger on the single stage tandem double-effect second-type absorption heat pump which comprises high pressure generator, low pressure generator, condenser, evaporator, absorber, the first solution pump, the second solution pump, liquid refrigerant pump, throttle, solution heat exchanger.

In the single stage tandem double-effect second-type absorption heat pump, high pressure generator has the concentrated solution pipe which passes through the second solution pump, solution heat exchanger and then connects absorber. Absorber has the dilute solution pipe which passes through solution heat exchanger and then connects low pressure generator. Low pressure generator has the concentrated solution pipe which passes through the first solution pump and then connects high pressure generator. After that high pressure generator refrigerant vapor channel connected low pressure generator, low pressure generator liquid refrigerant pipe which passes through throttle and then connects condenser. Low pressure generator has refrigerant vapor channel connected condenser. Generator has liquid refrigerant pipe which passes through liquid refrigerant pump and then connects evaporator. Evaporator has refrigerant vapor channel connected absorber. Generator and evaporator separately have the residual heat medium pipe connected external. Condenser has the cooling medium pipe connected external. Absorber has the heated medium pipe connected external.

We adopt the solution tandem cycle as following. We change that high pressure generator has the concentrated solution pipe which passes through the first solution pump, solution heat exchanger and then connects absorber to that high pressure generator has the concentrated solution pipe which passes through the first solution pump, solution heat exchanger, absorber and then connects the new added steam bleeding chamber. The new added steam bleeding chamber has the concentrated solution pipe which passes through the new added solution pump and the new added solution heat exchanger and then connects the new added absorber. The new added absorber has the dilute solution pipe which passes through the new added solution heat exchanger and then connects absorber.

We change that absorber has the heated medium pipe connected external to that absorber has refrigerant vapor channel connected the new added absorber after that condenser or evaporator add the liquid refrigerant pipe which passes through the new added liquid refrigerant pump and then connects absorber. Or we change that absorber has the heated medium pipe connected external to that absorber has refrigerant vapor channel connected the new added absorber after that condenser has the liquid refrigerant pipe which passes through liquid refrigerant pump and then connects absorber. At the same time, we adjust that condenser has the liquid refrigerant pipe which passes through liquid refrigerant pump and then connects evaporator to that condenser has the liquid refrigerant pipe which passes through liquid refrigerant pump, the new added throttle and then connects evaporator.

The new added steam bleeding chamber has refrigerant vapor channel connected condenser. The new added absorber has the heated medium pipe connected external. The single stage double-effect second-type absorption heat pump completes the first stage improving of residual heat temperature. Absorber heats up the liquid refrigerant which flows through it. And the liquid refrigerant becomes refrigerant vapor provided to the new added absorber. Absorber heats up the solution which flows through it too. After that part of the solution is vaporization, it enters the new added steam bleeding chamber. The refrigerant vapor produced by the new added steam bleeding chamber enters condenser. At the same time, the concentrated solution enters the new added absorber, absorbs the refrigerant vapor came from the first absorber and provides the high temperature heating load to the heated medium. Consequently, we achieve the two-stage high temperature second-type absorption heat pump based on the single stage double-effect second-type absorption heat pump.

11. The second-type high temperature absorption heat pump, based on the method expounded in item 1, is formed by adding the new added steam bleeding chamber, the new added absorber, the new added liquid refrigerant pump or the new added throttle, the new added solution pump and the new added solution heat exchanger on the single stage tandem double-effect second-type absorption heat pump which comprises high pressure generator, low pressure generator, condenser, evaporator, absorber, the first solution pump, the second solution pump, liquid refrigerant pump, throttle, solution heat exchanger.

In the single stage tandem double-effect second-type absorption heat pump, high pressure generator has the concentrated solution pipe which passes through the second solution pump, solution heat exchanger and then connects absorber. Absorber has the dilute solution pipe which passes through solution heat exchanger and then connects low pressure generator. Low pressure generator has the concentrated solution pipe which passes through the first solution pump and then connects high pressure generator. After that high pressure generator refrigerant vapor channel connected low pressure generator, low pressure generator liquid refrigerant pipe which passes through throttle and then connects condenser. Low pressure generator has refrigerant vapor channel connected condenser. Generator has liquid refrigerant pipe which passes through liquid refrigerant pump and then connects evaporator. Evaporator has refrigerant vapor channel connected absorber. Generator and evaporator separately have the residual heat medium pipe connected external. Condenser has the cooling medium pipe connected external. Absorber has the heated medium pipe connected external.

We adopt the solution independent cycle as following. The new added steam bleeding chamber has the concentrated solution pipe which passes through the new added solution pump and the new added solution heat exchanger and then connects the new added absorber. The new added absorber has the dilute solution pipe which passes through the new added solution heat exchanger, absorber and then connects the new added steam bleeding chamber.

We change that absorber has the heated medium pipe connected external to that absorber has refrigerant vapor channel connected the new added absorber after that condenser or evaporator add the liquid refrigerant pipe which passes through the new added liquid refrigerant pump and then connects absorber. Or we change that absorber has the heated medium pipe connected external to that absorber has refrigerant vapor channel connected the new added absorber after that condenser has the liquid refrigerant pipe which passes through liquid refrigerant pump and then connects absorber. At the same time, we adjust that condenser has the liquid refrigerant pipe which passes through liquid refrigerant pump and then connects evaporator to that condenser has the liquid refrigerant pipe which passes through liquid refrigerant pump, the new added throttle and then connects evaporator.

The new added steam bleeding chamber has refrigerant vapor channel connected condenser. The new added absorber has the heated medium pipe connected external. The single stage double-effect second-type absorption heat pump completes the first stage improving of residual heat temperature. Absorber heats up the liquid refrigerant which flows through it. And the liquid refrigerant becomes refrigerant vapor provided to the new added absorber. Absorber heats up the solution which flows through it too. After that part of the solution is vaporization, it enters the new added steam bleeding chamber. The refrigerant vapor produced by the new added steam bleeding chamber enters condenser. At the same time, the concentrated solution enters the new added absorber, absorbs the refrigerant vapor came from the first absorber and provides the high temperature heating load to the heated medium. Consequently, we achieve the two-stage high temperature second-type absorption heat pump based on the single stage double-effect second-type absorption heat pump.

12. The second-type high temperature absorption heat pump, based on the method expounded in item 1, is formed by adding the new added steam bleeding chamber, the new added absorber, the new added liquid refrigerant pump or the new added throttle, the new added solution pump and the new added solution heat exchanger on the single stage tandem double-effect second-type absorption heat pump which comprises high pressure generator, low pressure generator, condenser, evaporator, absorber, solution pump, liquid refrigerant pump, throttle, the first solution heat exchanger and the second solution heat exchanger.

In the single stage tandem double-effect second-type absorption heat pump, high pressure generator has the concentrated solution pipe which passes through the first solution heat exchanger and then connects low pressure generator. Low pressure generator has the concentrated solution pipe which passes through the first solution heat exchanger and the second solution heat exchanger and then connects absorber. Absorber has the dilute solution pipe which passes through the second solution heat exchanger and then connects high pressure generator. After that high pressure generator refrigerant vapor channel connected low pressure generator, low pressure generator liquid refrigerant pipe which passes through throttle and then connects condenser. Low pressure generator has refrigerant vapor channel connected condenser. High pressure generator has liquid refrigerant pipe which passes through liquid refrigerant pump and then connects evaporator. Evaporator has refrigerant vapor channel connected absorber. High pressure generator and evaporator separately have the residual heat medium pipe connected external. Condenser has the cooling medium pipe connected external. Absorber has the heated medium pipe connected external.

We adopt the solution tandem cycle as following. We change that low pressure generator has the concentrated solution pipe which passes through solution pump, the first solution heat exchanger, the second solution heat exchanger and then connects absorber to that high pressure generator has the concentrated solution pipe which passes through solution pump, the first solution heat exchanger, the second solution heat exchanger, absorber and then connects the new added steam bleeding chamber. The new added steam bleeding chamber has the concentrated solution pipe which passes through the new added solution pump and the new added solution heat exchanger and then connects the new added absorber. The new added absorber has the dilute solution pipe which passes through the new added solution heat exchanger and then connects absorber.

We change that absorber has the heated medium pipe connected external to that absorber has refrigerant vapor channel connected the new added absorber after that condenser or evaporator add the liquid refrigerant pipe which passes through the new added liquid refrigerant pump and then connects absorber. Or we change that absorber has the heated medium pipe connected external to that absorber has refrigerant vapor channel connected the new added absorber after that condenser has the liquid refrigerant pipe which passes through liquid refrigerant pump and then connects absorber. At the same time, we adjust that condenser has the liquid refrigerant pipe which passes through liquid refrigerant pump and then connects evaporator to that condenser has the liquid refrigerant pipe which passes through liquid refrigerant pump, the new added throttle and then connects evaporator.

The new added steam bleeding chamber has refrigerant vapor channel connected condenser. The new added absorber has the heated medium pipe connected external. The single stage double-effect second-type absorption heat pump completes the first stage improving of residual heat temperature. Absorber heats up the liquid refrigerant which flows through it. And the liquid refrigerant becomes refrigerant vapor provided to the new added absorber. Absorber heats up the solution which flows through it too. After that part of the solution is vaporization, it enters the new added steam bleeding chamber. The refrigerant vapor produced by the new added steam bleeding chamber enters condenser. At the same time, the concentrated solution enters the new added absorber, absorbs the refrigerant vapor came from the first absorber and provides the high temperature heating load to the heated medium. Consequently, we achieve the two-stage high temperature second-type absorption heat pump based on the single stage double-effect second-type absorption heat pump.

13. The second-type high temperature absorption heat pump, based on the method expounded in item 2, is formed by adding the new added steam bleeding chamber, the new added absorber, the new added liquid refrigerant pump or the new added throttle, the new added solution pump and the new added solution heat exchanger on the single stage tandem double-effect second-type absorption heat pump which comprises high pressure generator, low pressure generator, condenser, evaporator, absorber, solution pump, liquid refrigerant pump, throttle, the first solution heat exchanger and the second solution heat exchanger.

In the single stage tandem double-effect second-type absorption heat pump, high pressure generator has the concentrated solution pipe which passes through the first solution heat exchanger and then connects low pressure generator. Low pressure generator has the concentrated solution pipe which passes through the first solution heat exchanger and the second solution heat exchanger and then connects absorber. Absorber has the dilute solution pipe which passes through the second solution heat exchanger and then connects high pressure generator. After that high pressure generator refrigerant vapor channel connected low pressure generator, low pressure generator liquid refrigerant pipe which passes through throttle and then connects condenser. Low pressure generator has refrigerant vapor channel connected condenser. Condenser has liquid refrigerant pipe which passes through liquid refrigerant pump and then connects evaporator. Evaporator has refrigerant vapor channel connected absorber. High pressure generator and evaporator separately have the residual heat medium pipe connected external. Condenser has the cooling medium pipe connected external. Absorber has the heated medium pipe connected external.

We adopt the solution independent cycle as following. The new added steam bleeding chamber has the concentrated solution pipe which passes through the new added solution pump and the new added solution heat exchanger and then connects the new added absorber. The new added absorber has the dilute solution pipe which passes through the new added solution heat exchanger, absorber and then connects the new added steam bleeding chamber.

We change that absorber has the heated medium pipe connected external to that absorber has refrigerant vapor channel connected the new added absorber after that condenser or evaporator add the liquid refrigerant pipe which passes through the new added liquid refrigerant pump and then connects absorber. Or we change that absorber has the heated medium pipe connected external to that absorber has refrigerant vapor channel connected the new added absorber after that condenser has the liquid refrigerant pipe which passes through liquid refrigerant pump and then connects absorber. At the same time, we adjust that condenser has the liquid refrigerant pipe which passes through liquid refrigerant pump and then connects evaporator to that condenser has the liquid refrigerant pipe which passes through liquid refrigerant pump, the new added throttle and then connects evaporator.

The new added steam bleeding chamber has refrigerant vapor channel connected condenser. The new added absorber has the heated medium pipe connected external. The single stage double-effect second-type absorption heat pump completes the first stage improving of residual heat temperature. Absorber heats up the liquid refrigerant which flows through it. And the liquid refrigerant becomes refrigerant vapor provided to the new added absorber. Absorber heats up the solution which flows through it too. After that part of the solution is vaporization, it enters the new added steam bleeding chamber. The refrigerant vapor produced by the new added steam bleeding chamber enters condenser. At the same time, the concentrated solution enters the new added absorber, absorbs the refrigerant vapor came from the first absorber and provides the high temperature heating load to the heated medium. Consequently, we achieve the two-stage high temperature second-type absorption heat pump based on the single stage double-effect second-type absorption heat pump.

14. The second-type high temperature absorption heat pump, based on the method expounded in item 1, is formed by adding the new added steam bleeding chamber, the new added absorber, the new added liquid refrigerant pump or the new added throttle, the new added solution pump and the new added solution heat exchanger on the single stage parallel double-effect second-type absorption heat pump which comprises high pressure generator, low pressure generator, condenser, evaporator, absorber, the first solution pump, the second solution pump, liquid refrigerant pump, throttle, the first solution heat exchanger and the second solution heat exchanger.

In the single stage tandem double-effect second-type absorption heat pump, high pressure generator has the concentrated solution pipe which passes through the first solution pump, the first solution heat exchanger and then connects absorber. Absorber has the dilute solution pipe which passes through the first solution heat exchanger and then connects high pressure generator. Low pressure generator has the concentrated solution pipe which passes through the second solution pump, the second solution heat exchanger and then connects absorber. Absorber has the dilute solution pipe which passes through the second solution heat exchanger and then connects low pressure generator. After that high pressure generator refrigerant vapor channel connected low pressure generator, low pressure generator has liquid refrigerant pipe which passes through throttle and then connects condenser. Low pressure generator has refrigerant vapor channel connected condenser. High pressure generator has liquid refrigerant pipe which passes through liquid refrigerant pump and then connects evaporator. Evaporator has refrigerant vapor channel connected absorber. High pressure generator and evaporator separately have the residual heat medium pipe connected external. Condenser has the cooling medium pipe connected external. Absorber has the heated medium pipe connected external.

We adopt the solution tandem cycle as following. We change that high pressure generator has the concentrated solution pipe which passes through solution pump, the first solution heat exchanger and then connects absorber and that low pressure generator has the concentrated solution pipe which passes through the second solution pump, the second solution heat exchanger and then connects absorber to that absorber connects the new added steam bleeding chamber after that the two roads of concentrated solution converges. One road is that the pipe from high pressure generator passes through solution pump, the first solution heat exchanger. The other road is that the pipe from low pressure generator passes through the second solution pump, the second solution heat exchanger. The new added steam bleeding chamber has the concentrated solution pipe which passes through the new added solution pump and the new added solution heat exchanger and then connects the new added absorber. The new added absorber has the dilute solution pipe which passes through the new added solution heat exchanger and then connects absorber.

We change that absorber has the heated medium pipe connected external to that absorber has refrigerant vapor channel connected the new added absorber after that condenser or evaporator add the liquid refrigerant pipe which passes through the new added liquid refrigerant pump and then connects absorber. Or we change that absorber has the heated medium pipe connected external to that absorber has refrigerant vapor channel connected the new added absorber after that condenser has the liquid refrigerant pipe which passes through liquid refrigerant pump and then connects absorber. At the same time, we adjust that condenser has the liquid refrigerant pipe which passes through liquid refrigerant pump and then connects evaporator to that condenser has the liquid refrigerant pipe which passes through liquid refrigerant pump, the new added throttle and then connects evaporator.

The new added steam bleeding chamber has refrigerant vapor channel connected condenser. The new added absorber has the heated medium pipe connected external. The single stage double-effect second-type absorption heat pump completes the first stage improving of residual heat temperature. Absorber heats up the liquid refrigerant which flows through it. And the liquid refrigerant becomes refrigerant vapor provided to the new added absorber. Absorber heats up the solution which flows through it too. After that part of the solution is vaporization, it enters the new added steam bleeding chamber. The refrigerant vapor produced by the new added steam bleeding chamber enters condenser. At the same time, the concentrated solution enters the new added absorber, absorbs the refrigerant vapor came from the first absorber and provides the high temperature heating load to the heated medium. Consequently, we achieve the two-stage high temperature second-type absorption heat pump based on the single stage double-effect second-type absorption heat pump.

15. The second-type high temperature absorption heat pump, based on the method expounded in item 1, is formed by adding the new added steam bleeding chamber, the new added absorber, the new added liquid refrigerant pump or the new added throttle, the new added solution pump and the new added solution heat exchanger on the single stage parallel double-effect second-type absorption heat pump which comprises high pressure generator, low pressure generator, condenser, evaporator, absorber, the first solution pump, the second solution pump, liquid refrigerant pump, throttle, the first solution heat exchanger and the second solution heat exchanger.

In the single stage tandem double-effect second-type absorption heat pump, high pressure generator has the concentrated solution pipe which passes through the first solution pump, the first solution heat exchanger and then connects absorber. Absorber has the dilute solution pipe which passes through the first solution heat exchanger and then connects high pressure generator. Low pressure generator has the concentrated solution pipe which passes through the second solution pump, the second solution heat exchanger and then connects absorber. Absorber has the dilute solution pipe which passes through the second solution heat exchanger and then connects low pressure generator. After that high pressure generator refrigerant vapor channel connected low pressure generator, low pressure generator has liquid refrigerant pipe which passes through throttle and then connects condenser. Low pressure generator has refrigerant vapor channel connected condenser. High pressure generator has liquid refrigerant pipe which passes through liquid refrigerant pump and then connects evaporator. Evaporator has refrigerant vapor channel connected absorber. High pressure generator and evaporator separately have the residual heat medium pipe connected external. Condenser has the cooling medium pipe connected external. Absorber has the heated medium pipe connected external.

We adopt the solution tandem cycle as following. We change that high pressure generator has the concentrated solution pipe which passes through solution pump, the first solution heat exchanger and then connects absorber to that high pressure generator has the concentrated solution pipe which passes through solution pump, the first solution heat exchanger, absorber and then connects the new added steam bleeding chamber. Or we change that low pressure generator has the concentrated solution pipe which passes through the second solution pump, the second solution heat exchanger and then connects absorber to that low pressure generator has the concentrated solution pipe which passes through the second solution pump, the second solution heat exchanger, absorber and then connects the new added steam bleeding chamber. The new added steam bleeding chamber has the concentrated solution pipe which passes through the new added solution pump and the new added solution heat exchanger and then connects the new added absorber. The new added absorber has the dilute solution pipe which passes through the new added solution heat exchanger and then connects absorber.

We change that absorber has the heated medium pipe connected external to that absorber has refrigerant vapor channel connected the new added absorber after that condenser or evaporator add the liquid refrigerant pipe which passes through the new added liquid refrigerant pump and then connects absorber. Or we change that absorber has the heated medium pipe connected external to that absorber has refrigerant vapor channel connected the new added absorber after that condenser has the liquid refrigerant pipe which passes through liquid refrigerant pump and then connects absorber. At the same time, we adjust that condenser has the liquid refrigerant pipe which passes through liquid refrigerant pump and then connects evaporator to that condenser has the liquid refrigerant pipe which passes through liquid refrigerant pump, the new added throttle and then connects evaporator.

The new added steam bleeding chamber has refrigerant vapor channel connected condenser. The new added absorber has the heated medium pipe connected external. The single stage double-effect second-type absorption heat pump completes the first stage improving of residual heat temperature. Absorber heats up the liquid refrigerant which flows through it. And the liquid refrigerant becomes refrigerant vapor provided to the new added absorber. Absorber heats up the solution which flows through it too. After that part of the solution is vaporization, it enters the new added steam bleeding chamber. The refrigerant vapor produced by the new added steam bleeding chamber enters condenser. At the same time, the concentrated solution enters the new added absorber, absorbs the refrigerant vapor came from the first absorber and provides the high temperature heating load to the heated medium. Consequently, we achieve the two-stage high temperature second-type absorption heat pump based on the single stage double-effect second-type absorption heat pump.

16. The second-type high temperature absorption heat pump, based on the method expounded in item 2, is formed by adding the new added steam bleeding chamber, the new added absorber, the new added liquid refrigerant pump or the new added throttle, the new added solution pump and the new added solution heat exchanger on the single stage parallel double-effect second-type absorption heat pump which comprises high pressure generator, low pressure generator, condenser, evaporator, absorber, the first solution pump, the second solution pump, liquid refrigerant pump, throttle, the first solution heat exchanger and the second solution heat exchanger.

In the single stage tandem double-effect second-type absorption heat pump, high pressure generator has the concentrated solution pipe which passes through the first solution pump, the first solution heat exchanger and then connects absorber. Absorber has the dilute solution pipe which passes through the first solution heat exchanger and then connects high pressure generator. Low pressure generator has the concentrated solution pipe which passes through the second solution pump, the second solution heat exchanger and then connects absorber. Absorber has the dilute solution pipe which passes through the second solution heat exchanger and then connects low pressure generator. After that high pressure generator refrigerant vapor channel connected low pressure generator, low pressure generator has liquid refrigerant pipe which passes through throttle and then connects condenser. Low pressure generator has refrigerant vapor channel connected condenser. High pressure generator has liquid refrigerant pipe which passes through liquid refrigerant pump and then connects evaporator. Evaporator has refrigerant vapor channel connected absorber. High pressure generator and evaporator separately have the residual heat medium pipe connected external. Condenser has the cooling medium pipe connected external. Absorber has the heated medium pipe connected external.

We adopt the solution independent cycle as following. The new added steam bleeding chamber has the concentrated solution pipe which passes through the new added solution pump and the new added solution heat exchanger and then connects the new added absorber. The new added absorber has the dilute solution pipe which passes through the new added solution heat exchanger, absorber and then connects the new added steam bleeding chamber.

We change that absorber has the heated medium pipe connected external to that absorber has refrigerant vapor channel connected the new added absorber after that condenser or evaporator add the liquid refrigerant pipe which passes through the new added liquid refrigerant pump and then connects absorber. Or we change that absorber has the heated medium pipe connected external to that absorber has refrigerant vapor channel connected the new added absorber after that condenser has the liquid refrigerant pipe which passes through liquid refrigerant pump and then connects absorber. At the same time, we adjust that condenser has the liquid refrigerant pipe which passes through liquid refrigerant pump and then connects evaporator to that condenser has the liquid refrigerant pipe which passes through liquid refrigerant pump, the new added throttle and then connects evaporator.

The new added steam bleeding chamber has refrigerant vapor channel connected condenser. The new added absorber has the heated medium pipe connected external. The single stage double-effect second-type absorption heat pump completes the first stage improving of residual heat temperature. Absorber heats up the liquid refrigerant which flows through it. And the liquid refrigerant becomes refrigerant vapor provided to the new added absorber. Absorber heats up the solution which flows through it too. After that part of the solution is vaporization, it enters the new added steam bleeding chamber. The refrigerant vapor produced by the new added steam bleeding chamber enters condenser. At the same time, the concentrated solution enters the new added absorber, absorbs the refrigerant vapor came from the first absorber and provides the high temperature heating load to the heated medium. Consequently, we achieve the two-stage high temperature second-type absorption heat pump based on the single stage double-effect second-type absorption heat pump.

17. The second-type high temperature absorption heat pump, based on the method expounded in item 2, is formed by adding the new added steam bleeding chamber, the new added absorber, the new added liquid refrigerant pump or the new added throttle, the new added solution pump and the new added solution heat exchanger on the recuperative single stage tandem double-effect second-type absorption heat pump. The recuperative single stage tandem double-effect second-type absorption heat pump is mentioned in item 10 and is formed by adding the second solution heat exchanger, the second absorber, the steam bleeding chamber, the third solution pump or adding the fourth solution pump too on the single stage tandem double-effect second-type absorption heat pump which comprises high pressure generator, low pressure generator, condenser, evaporator, the first absorber, the first solution pump, the second solution pump, liquid refrigerant pump, throttle, solution heat exchanger.

In the recuperative single stage tandem double-effect second-type absorption heat pump, we cancel the second solution pump. We adjust that high pressure generator has the concentrated solution pipe which passes through the second solution pump, the first solution heat exchanger and then connects absorber to that high pressure generator has the concentrated solution pipe which passes through the second solution pump, the first solution heat exchanger, absorber and then connects the steam bleeding chamber. The steam bleeding chamber has the concentrated solution pipe which passes through the third solution pump, the second solution heat exchanger and then connects the second absorber. The second absorber has the dilute solution pipe which passes through the second solution heat exchanger or the fourth solution pump and then connects absorber. The steam bleeding chamber has refrigerant vapor channel connected condenser. Evaporator has refrigerant vapor channel connected the second absorber. The second absorber has the heated medium pipe connected external. We cancel that absorber has the heated medium pipe connected external.

We adopt the solution tandem cycle as following. We change that the steam bleeding chamber has the concentrated solution pipe which passes through the third solution pump, the second solution heat exchanger and then connects the second absorber to that the steam bleeding chamber has the concentrated solution pipe which passes through the third solution pump, the second solution heat exchanger, the second absorber and then connects the new added steam bleeding chamber. The new added steam bleeding chamber has the concentrated solution pipe which passes through the new added solution pump and the new added solution heat exchanger and then connects the new added absorber. The new added absorber has the dilute solution pipe which passes through the new added solution heat exchanger and then connects the second absorber.

We change that the second absorber has the heated medium pipe connected external to that the second absorber has refrigerant vapor channel connected the new added absorber after that condenser or evaporator add the liquid refrigerant pipe which passes through the new added liquid refrigerant pump and then connects the second absorber. Or we change that the second absorber has the heated medium pipe connected external to that the second absorber has refrigerant vapor channel connected the new added absorber after that condenser has the liquid refrigerant pipe which passes through liquid refrigerant pump and then connects the second absorber. At the same time, we adjust that condenser has the liquid refrigerant pipe which passes through liquid refrigerant pump and then connects evaporator to that condenser has the liquid refrigerant pipe which passes through liquid refrigerant pump, the new added throttle and then connects evaporator.

The new added steam bleeding chamber has refrigerant vapor channel connected condenser. The new added absorber has the heated medium pipe connected external. The recuperative single stage double-effect second-type absorption heat pump completes the first stage improving of residual heat temperature. The second absorber heats up the liquid refrigerant which flows through it. And the liquid refrigerant becomes refrigerant vapor provided to the new added absorber. The second absorber heats up the solution which flows through it too. After that part of the solution is vaporization, it enters the new added steam bleeding chamber. The refrigerant vapor produced by the new added steam bleeding chamber enters condenser. At the same time, the concentrated solution enters the new added absorber, absorbs the refrigerant vapor came from the second absorber and provides the high temperature heating load to the heated medium. Consequently, we achieve the two-stage high temperature second-type absorption heat pump based on the recuperative single stage double-effect second-type absorption heat pump.

18. The second-type high temperature absorption heat pump, based on the method expounded in item 2, is formed by adding the new added steam bleeding chamber, the new added absorber, the new added liquid refrigerant pump or the new added throttle, the new added solution pump and the new added solution heat exchanger on the recuperative single stage tandem double-effect second-type absorption heat pump. The recuperative single stage tandem double-effect second-type absorption heat pump is mentioned in item 10 and is formed by adding the second solution heat exchanger, the second absorber, the steam bleeding chamber, the third solution pump, the second evaporator and the second throttle on the single stage tandem double-effect second-type absorption heat pump which comprises high pressure generator, low pressure generator, condenser, evaporator, the first absorber, the first solution pump, the second solution pump, liquid refrigerant pump, throttle, solution heat exchanger.

In the recuperative single stage tandem double-effect second-type absorption heat pump, the steam bleeding chamber has the concentrated solution pipe which passes through the third solution pump, the second solution heat exchanger and then connects the second absorber. The second absorber has the dilute solution pipe which passes through the second solution heat exchanger, the first absorber and then connects the steam bleeding chamber. The steam bleeding chamber has refrigerant vapor channel connected condenser. Evaporator has refrigerant vapor channel which passes through the second throttle and then connects the second evaporator. The second evaporator has refrigerant vapor channel connected the second absorber. The second absorber has the heated medium pipe connected external. We cancel that absorber has the heated medium pipe connected external.

We adopt the solution independent cycle as following. We change that the steam bleeding chamber has the concentrated solution pipe which passes through the third solution pump, the second solution heat exchanger and then connects the second absorber to that the steam bleeding chamber has the concentrated solution pipe which passes through the third solution pump, the second solution heat exchanger, the second absorber and then connects the new added steam bleeding chamber. The new added steam bleeding chamber has the concentrated solution pipe which passes through the new added solution pump and the new added solution heat exchanger and then connects the new added absorber. The new added absorber has the dilute solution pipe which passes through the new added solution heat exchanger, the second absorber and then connects the new added steam bleeding chamber.

We change that the second absorber has the heated medium pipe connected external to that the second absorber has refrigerant vapor channel connected the new added absorber after that condenser or evaporator add the liquid refrigerant pipe which passes through the new added liquid refrigerant pump and then connects the second absorber. Or we change that the second absorber has the heated medium pipe connected external to that the second absorber has refrigerant vapor channel connected the new added absorber after that condenser has the liquid refrigerant pipe which passes through liquid refrigerant pump and then connects the second absorber. At the same time, we adjust that condenser has the liquid refrigerant pipe which passes through liquid refrigerant pump and then connects evaporator to that condenser has the liquid refrigerant pipe which passes through liquid refrigerant pump, the new added throttle and then connects evaporator.

The new added steam bleeding chamber has refrigerant vapor channel connected condenser. The new added absorber has the heated medium pipe connected external. The recuperative single stage double-effect second-type absorption heat pump completes the first stage improving of residual heat temperature. The second absorber heats up the liquid refrigerant which flows through it. And the liquid refrigerant becomes refrigerant vapor provided to the new added absorber. The second absorber heats up the solution which flows through it too. After that part of the solution is vaporization, it enters the new added steam bleeding chamber. The refrigerant vapor produced by the new added steam bleeding chamber enters condenser. At the same time, the concentrated solution enters the new added absorber, absorbs the refrigerant vapor came from the second absorber and provides the high temperature heating load to the heated medium. Consequently, we achieve the two-stage high temperature second-type absorption heat pump based on the recuperative single stage double-effect second-type absorption heat pump.

19. The second-type high temperature absorption heat pump, based on the method expounded in item 1, is formed by adding the new added steam bleeding chamber, the new added absorber, the new added liquid refrigerant pump or the new added throttle, the new added solution pump and the new added solution heat exchanger on the recuperative single stage tandem double-effect second-type absorption heat pump. The recuperative single stage tandem double-effect second-type absorption heat pump is mentioned in item 12 and is formed by adding the third solution heat exchanger, the second absorber, the steam bleeding chamber, the third solution pump, the second evaporator and the second throttle on the single stage tandem double-effect second-type absorption heat pump which comprises high pressure generator, low pressure generator, condenser, evaporator, the first absorber, solution pump, liquid refrigerant pump, throttle, the first solution heat exchanger and the second solution heat exchanger.

In the recuperative single stage tandem double-effect second-type absorption heat pump, we adjust that low pressure generator has the concentrated solution pipe which passes through solution pump, the first solution heat exchanger and the second solution heat exchanger and then connects the first absorber to that low pressure generator has the concentrated solution pipe which passes through solution pump, the first solution heat exchanger, the second solution heat exchanger, the first absorber and then connects the steam bleeding chamber. The steam bleeding chamber has the concentrated solution pipe which passes through the third solution pump, the third solution heat exchanger and then connects the second absorber. The second absorber has the dilute solution pipe which passes through the third solution heat exchanger and then connects the first absorber. The steam bleeding chamber has refrigerant vapor channel connected condenser. The first evaporator has refrigerant vapor channel which passes through the second throttle and then connects the second evaporator. The second evaporator has refrigerant vapor channel connected the second absorber. The second absorber has the heated medium pipe connected external. We cancel that absorber has the heated medium pipe connected external We adopt the solution tandem cycle as following. We change that the steam bleeding chamber has the concentrated solution pipe which passes through the third solution pump, the third solution heat exchanger and then connects the second absorber to that the steam bleeding chamber has the concentrated solution pipe which passes through the third solution pump, the third solution heat exchanger, the second absorber and then connects the new added steam bleeding chamber. The new added steam bleeding chamber has the concentrated solution pipe which passes through the new added solution pump and the new added solution heat exchanger and then connects the new added absorber. The new added absorber has the dilute solution pipe which passes through the new added solution heat exchanger and then connects the second absorber.

We change that the second absorber has the heated medium pipe connected external to that the second absorber has refrigerant vapor channel connected the new added absorber after that condenser or evaporator add the liquid refrigerant pipe which passes through the new added liquid refrigerant pump and then connects the second absorber. Or we change that the second absorber has the heated medium pipe connected external to that the second absorber has refrigerant vapor channel connected the new added absorber after that condenser has the liquid refrigerant pipe which passes through liquid refrigerant pump and then connects the second absorber. At the same time, we adjust that condenser has the liquid refrigerant pipe which passes through liquid refrigerant pump and then connects evaporator to that condenser has the liquid refrigerant pipe which passes through liquid refrigerant pump, the new added throttle and then connects evaporator.

The new added steam bleeding chamber has refrigerant vapor channel connected condenser. The new added absorber has the heated medium pipe connected external. The recuperative single stage double-effect second-type absorption heat pump completes the first stage improving of residual heat temperature. The second absorber heats up the liquid refrigerant which flows through it. And the liquid refrigerant becomes refrigerant vapor provided to the new added absorber. The second absorber heats up the solution which flows through it too. After that part of the solution is vaporization, it enters the new added steam bleeding chamber. The refrigerant vapor produced by the new added steam bleeding chamber enters condenser. At the same time, the concentrated solution enters the new added absorber, absorbs the refrigerant vapor came from the second absorber and provides the high temperature heating load to the heated medium. Consequently, we achieve the two-stage high temperature second-type absorption heat pump based on the recuperative single stage double-effect second-type absorption heat pump.

20. The second-type high temperature absorption heat pump, based on the method expounded in item 2, is formed by adding the new added steam bleeding chamber, the new added absorber, the new added liquid refrigerant pump or the new added throttle, the new added solution pump and the new added solution heat exchanger on the recuperative single stage tandem double-effect second-type absorption heat pump. The recuperative single stage tandem double-effect second-type absorption heat pump is mentioned in item 12 and is formed by adding the third solution heat exchanger, the second absorber, the steam bleeding chamber, the third solution pump on the single stage tandem double-effect second-type absorption heat pump which comprises high pressure generator, low pressure generator, condenser, evaporator, the first absorber, solution pump, liquid refrigerant pump, throttle, the first solution heat exchanger and the second solution heat exchanger.

In the recuperative single stage tandem double-effect second-type absorption heat pump, the steam bleeding chamber has the concentrated solution pipe which passes through the third solution pump, the third solution heat exchanger and then connects the second absorber. The second absorber has the dilute solution pipe which passes through the third solution heat exchanger, the first absorber and then connects the steam bleeding chamber. The steam bleeding chamber has refrigerant vapor channel connected condenser. Evaporator has refrigerant vapor channel connected the second absorber. The second absorber has the heated medium pipe connected external. We cancel that absorber has the heated medium pipe connected external.

We adopt the solution independent cycle as following. The new added steam bleeding chamber has the concentrated solution pipe which passes through the new added solution pump and the new added solution heat exchanger and then connects the new added absorber. The new added absorber has the dilute solution pipe which passes through the new added solution heat exchanger, the second absorber and then connects the new added steam bleeding chamber.

We change that the second absorber has the heated medium pipe connected external to that the second absorber has refrigerant vapor channel connected the new added absorber after that condenser or evaporator add the liquid refrigerant pipe which passes through the new added liquid refrigerant pump and then connects the second absorber. Or we change that the second absorber has the heated medium pipe connected external to that the second absorber has refrigerant vapor channel connected the new added absorber after that condenser has the liquid refrigerant pipe which passes through liquid refrigerant pump and then connects the second absorber. At the same time, we adjust that condenser has the liquid refrigerant pipe which passes through liquid refrigerant pump and then connects evaporator to that condenser has the liquid refrigerant pipe which passes through liquid refrigerant pump, the new added throttle and then connects evaporator.

The new added steam bleeding chamber has refrigerant vapor channel connected condenser. The new added absorber has the heated medium pipe connected external. The recuperative single stage double-effect second-type absorption heat pump completes the first stage improving of residual heat temperature. The second absorber heats up the liquid refrigerant which flows through it. And the liquid refrigerant becomes refrigerant vapor provided to the new added absorber. The second absorber heats up the solution which flows through it too. After that part of the solution is vaporization, it enters the new added steam bleeding chamber. The refrigerant vapor produced by the new added steam bleeding chamber enters condenser. At the same time, the concentrated solution enters the new added absorber, absorbs the refrigerant vapor came from the second absorber and provides the high temperature heating load to the heated medium. Consequently, we achieve the two-stage high temperature second-type absorption heat pump based on the recuperative single stage double-effect second-type absorption heat pump.

21. The second-type high temperature absorption heat pump, based on the method expounded in item 1, is formed by adding the new added steam bleeding chamber, the new added absorber, the new added liquid refrigerant pump or the new added throttle, the new added solution pump and the new added solution heat exchanger on the recuperative single stage tandem double-effect second-type absorption heat pump. The recuperative single stage tandem double-effect second-type absorption heat pump is mentioned in item 14 and is formed by adding the third solution heat exchanger, the second absorber, the steam bleeding chamber, the third solution pump, the second evaporator and the second throttle on the single stage parallel double-effect second-type absorption heat pump which comprises high pressure generator, low pressure generator, condenser, evaporator, the first absorber, the first solution pump, the second solution pump, liquid refrigerant pump, throttle, the first solution heat exchanger and the second solution heat exchanger.

In the recuperative single stage tandem double-effect second-type absorption heat pump, high pressure generator has the concentrated solution pipe which passes through solution pump, the first solution heat exchanger and then connects the first absorber to that high pressure generator has the concentrated solution pipe which passes through solution pump, the first solution heat exchanger the first absorber and then connects the steam bleeding chamber. We adjust that low pressure generator has the concentrated solution pipe which passes the second solution pump, the second solution heat exchanger and then connects the first absorber to that the concentrated solution pipe which passes through solution pump, the first solution heat exchanger from high pressure generator joins with the other concentrated solution pipe which passes through the second solution pump, the second solution heat exchanger from low pressure generator.

The steam bleeding chamber has the concentrated solution pipe which passes through the third solution pump, the third solution heat exchanger and then connects the second absorber. The second absorber has the dilute solution pipe which passes through the third solution heat exchanger and then connects the first absorber. The steam bleeding chamber has refrigerant vapor channel connected condenser. The first evaporator has refrigerant vapor channel which passes through the second throttle and then connects the second evaporator. The second evaporator has refrigerant vapor channel connected the second absorber. The second absorber has the heated medium pipe connected external. We cancel that absorber has the heated medium pipe connected external We adopt the solution tandem cycle as following. We change that the steam bleeding chamber has the concentrated solution pipe which passes through the third solution pump, the third solution heat exchanger and then connects the second absorber to that the steam bleeding chamber has the concentrated solution pipe which passes through the third solution pump, the third solution heat exchanger, the second absorber and then connects the new added steam bleeding chamber. The new added steam bleeding chamber has the concentrated solution pipe which passes through the new added solution pump and the new added solution heat exchanger and then connects the new added absorber. The new added absorber has the dilute solution pipe which passes through the new added solution heat exchanger and then connects the second absorber.

We change that the second absorber has the heated medium pipe connected external to that the second absorber has refrigerant vapor channel connected the new added absorber after that condenser or evaporator add the liquid refrigerant pipe which passes through the new added liquid refrigerant pump and then connects the second absorber. Or we change that the second absorber has the heated medium pipe connected external to that the second absorber has refrigerant vapor channel connected the new added absorber after that condenser has the liquid refrigerant pipe which passes through liquid refrigerant pump and then connects the second absorber. At the same time, we adjust that condenser has the liquid refrigerant pipe which passes through liquid refrigerant pump and then connects evaporator to that condenser has the liquid refrigerant pipe which passes through liquid refrigerant pump, the new added throttle and then connects evaporator.

The new added steam bleeding chamber has refrigerant vapor channel connected condenser. The new added absorber has the heated medium pipe connected external. The recuperative single stage double-effect second-type absorption heat pump completes the first stage improving of residual heat temperature. The second absorber heats up the liquid refrigerant which flows through it. And the liquid refrigerant becomes refrigerant vapor provided to the new added absorber. The second absorber heats up the solution which flows through it too. After that part of the solution is vaporization, it enters the new added steam bleeding chamber. The refrigerant vapor produced by the new added steam bleeding chamber enters condenser. At the same time, the concentrated solution enters the new added absorber, absorbs the refrigerant vapor came from the second absorber and provides the high temperature heating load to the heated medium. Consequently, we achieve the two-stage high temperature second-type absorption heat pump based on the recuperative single stage double-effect second-type absorption heat pump.

22. The second-type high temperature absorption heat pump, based on the method expounded in item 2, is formed by adding the new added steam bleeding chamber, the new added absorber, the new added liquid refrigerant pump or the new added throttle, the new added solution pump and the new added solution heat exchanger on the recuperative single stage parallel double-effect second-type absorption heat pump. The recuperative single stage tandem double-effect second-type absorption heat pump is mentioned in item 14 and is formed by adding the third solution heat exchanger, the second absorber, the steam bleeding chamber, the third solution pump on the single stage parallel double-effect second-type absorption heat pump which comprises high pressure generator, low pressure generator, condenser, evaporator, the first absorber, the first solution pump, the second solution pump, liquid refrigerant pump, throttle, the first solution heat exchanger and the second solution heat exchanger.

In the recuperative single stage tandem double-effect second-type absorption heat pump, the steam bleeding chamber has the concentrated solution pipe which passes through the third solution pump, the third solution heat exchanger and then connects the second absorber. The second absorber has the dilute solution pipe which passes through the third solution heat exchanger, the first absorber and then connects the steam bleeding chamber. The steam bleeding chamber has refrigerant vapor channel connected condenser. Evaporator has refrigerant vapor channel connected the second absorber. The second absorber has the heated medium pipe connected external. We cancel that absorber has the heated medium pipe connected external.

We adopt the solution independent cycle as following. The new added steam bleeding chamber has the concentrated solution pipe which passes through the new added solution pump and the new added solution heat exchanger and then connects the new added absorber. The new added absorber has the dilute solution pipe which passes through the new added solution heat exchanger, the second absorber and then connects the new added steam bleeding chamber.

We change that the second absorber has the heated medium pipe connected external to that the second absorber has refrigerant vapor channel connected the new added absorber after that condenser or evaporator add the liquid refrigerant pipe which passes through the new added liquid refrigerant pump and then connects the second absorber. Or we change that the second absorber has the heated medium pipe connected external to that the second absorber has refrigerant vapor channel connected the new added absorber after that condenser has the liquid refrigerant pipe which passes through liquid refrigerant pump and then connects the second absorber. At the same time, we adjust that condenser has the liquid refrigerant pipe which passes through liquid refrigerant pump and then connects evaporator to that condenser has the liquid refrigerant pipe which passes through liquid refrigerant pump, the new added throttle and then connects evaporator.

The new added steam bleeding chamber has refrigerant vapor channel connected condenser. The new added absorber has the heated medium pipe connected external. The recuperative single stage double-effect second-type absorption heat pump completes the first stage improving of residual heat temperature. The second absorber heats up the liquid refrigerant which flows through it. And the liquid refrigerant becomes refrigerant vapor provided to the new added absorber. The second absorber heats up the solution which flows through it too. After that part of the solution is vaporization, it enters the new added steam bleeding chamber. The refrigerant vapor produced by the new added steam bleeding chamber enters condenser. At the same time, the concentrated solution enters the new added absorber, absorbs the refrigerant vapor came from the second absorber and provides the high temperature heating load to the heated medium. Consequently, we achieve the two-stage high temperature second-type absorption heat pump based on the recuperative single stage double-effect second-type absorption heat pump.

23. The second-type high temperature absorption heat pump, based on any of the second-type high temperature absorption heat pumps expounded in item 18-22, is formed in the following way. We adjust that the second absorber has the refrigerant vapor pipe connected the new added absorber after that the new added liquid refrigerant pump or liquid refrigerant pump has the liquid refrigerant pipe connected the second absorber to that the first absorber has the refrigerant vapor pipe connected the new added absorber after that the new added liquid refrigerant pump or liquid refrigerant pump has the liquid refrigerant pipe connected the second absorber.

The recuperative single stage second-type absorption heat pump completes the first stage improving of residual heat temperature. The first absorber heats up the liquid refrigerant which flows through it. And the liquid refrigerant becomes refrigerant vapor provided to the new added absorber. The second absorber heats up the solution which flows through it too. After that part of the solution is vaporization, it enters the new added steam bleeding chamber. The refrigerant vapor produced by the new added steam bleeding chamber enters condenser. At the same time, the concentrated solution enters the new added absorber, absorbs the refrigerant vapor came from the second absorber and provides the high temperature heating load to the heated medium. When the second absorber has the heated medium pipe connected external, the second absorber and the new added absorber separately provide heat to the heated medium. Consequently, we achieve the two-stage high temperature second-type absorption heat pump based on the recuperative single stage double-effect second-type absorption heat pump.

24. The second-type high temperature absorption heat pump, based on the method expounded in item 1, is formed by adding the new added steam bleeding chamber, the new added absorber, the new added liquid refrigerant pump or the new added throttle, the new added solution pump and the new added solution heat exchanger on the single generator two-stage second-type absorption heat pump which comprises generator, condenser, evaporator, absorption-evaporator, absorber, solution pump, the first liquid refrigerant pump, throttle or the second liquid refrigerant pump, the first solution heat exchanger, the second solution heat exchanger.

In the single generator two-stage second-type absorption heat pump, generator has the concentrated solution pipe which passes through solution pump, the first solution heat exchanger, the second solution heat exchanger and then connects the second absorber. The second absorber has the concentrated solution pipe which passes through the second solution heat exchanger and then connects absorption-evaporator. Absorption-evaporator has the dilute solution pipe which passes through the first solution heat exchanger and then connects generator. Generator has refrigerant vapor channel connected condenser. Generator has the liquid refrigerant pipe which passes through the first liquid refrigerant pump, throttle and then connect evaporator. After that, the pipe connects absorption-evaporator. And then, absorption-evaporator has refrigerant vapor channel connected the second absorber. Or after that condenser has the liquid refrigerant pipe connected evaporator and evaporator has the liquid refrigerant pipe which passes through the second liquid refrigerant pump and then connects absorption-evaporator, absorption-evaporator has refrigerant vapor channel connected the second absorber. Evaporator has refrigerant vapor channel connected absorption-evaporator. Generator and evaporator separately have the heated medium pipe connected external. Condenser has the cooling medium pipe connected external. Absorber has the heated medium pipe connected external.

We adopt the solution tandem cycle as following. We change that generator has the concentrated solution pipe which passes through solution pump, the first solution heat exchanger, the second solution heat exchanger and then connects the second absorber to that generator has the concentrated solution pipe which passes through solution pump, the first solution heat exchanger, the second solution heat exchanger, the second absorber and then connects the new added steam bleeding chamber. The new added steam bleeding chamber has the concentrated solution pipe which passes through the new added solution pump and the new added solution heat exchanger and then connects the new added absorber. The new added absorber has the dilute solution pipe which passes through the new added solution heat exchanger and then connects absorber.

We change that absorber has the heated medium pipe connected external to that absorber has refrigerant vapor channel connected the new added absorber after that condenser or evaporator add the liquid refrigerant pipe which passes through the new added liquid refrigerant pump and then connects absorber. Or we change that absorber has the heated medium pipe connected external to that absorber has refrigerant vapor channel connected the new added absorber after that evaporator has the liquid refrigerant pipe which passes through the second liquid refrigerant pump and then connects absorber. At the same time, we adjust that evaporator has the liquid refrigerant pipe which passes through the second liquid refrigerant pump, absorption-evaporator and then connects evaporator to that evaporator has the liquid refrigerant pipe which passes through the second liquid refrigerant pump, the new added throttle and then connects absorption-evaporator.

The new added steam bleeding chamber has refrigerant vapor channel connected condenser. The new added absorber has the heated medium pipe connected external. The single generator two-stage second-type absorption heat pump completes two stages improving of residual heat temperature. The second absorber heats up the liquid refrigerant which flows through it. And the liquid refrigerant becomes refrigerant vapor provided to the new added absorber. And absorber heats up the liquid refrigerant which flows through it. The liquid refrigerant becomes refrigerant vapor provided to the new added absorber. After that part of the solution is vaporization, it enters the new added steam bleeding chamber. The refrigerant vapor produced by the new added steam bleeding chamber enters condenser. At the same time, the concentrated solution enters the new added absorber, absorbs the refrigerant vapor came from absorber and provides the high temperature heating load to the heated medium. Consequently, we achieve the three-stage high temperature second-type absorption heat pump based on the single generator two-stage second-type absorption heat pump.

25. The second-type high temperature absorption heat pump, based on the method expounded in item 2, is formed by adding the new added steam bleeding chamber, the new added absorber, the new added liquid refrigerant pump or the new added throttle, the new added solution pump and the new added solution heat exchanger on the single generator two-stage second-type absorption heat pump which comprises generator, condenser, evaporator, absorption-evaporator, absorber, solution pump, the first liquid refrigerant pump, throttle or the second liquid refrigerant pump, the first solution heat exchanger, the second solution heat exchanger.

In the single generator two-stage second-type absorption heat pump, generator has the concentrated solution pipe which passes through solution pump, the first solution heat exchanger, the second solution heat exchanger and then connects the second absorber. The second absorber has the concentrated solution pipe which passes through the second solution heat exchanger and then connects absorption-evaporator. Absorption-evaporator has the dilute solution pipe which passes through the first solution heat exchanger and then connects generator. Generator has refrigerant vapor channel connected condenser. Generator has the liquid refrigerant pipe which passes through the first liquid refrigerant pump, throttle and then connect evaporator. After that, the pipe connects absorption-evaporator. And then, absorption-evaporator has refrigerant vapor channel connected the second absorber. Or after that condenser has the liquid refrigerant pipe connected evaporator and evaporator has the liquid refrigerant pipe which passes through the second liquid refrigerant pump and then connects absorption-evaporator, absorption-evaporator has refrigerant vapor channel connected the second absorber. Evaporator has refrigerant vapor channel connected absorption-evaporator. Generator and evaporator separately have the heated medium pipe connected external. Condenser has the cooling medium pipe connected external. Absorber has the heated medium pipe connected external.

We adopt the solution independent cycle as following. The new added steam bleeding chamber has the concentrated solution pipe which passes through the new added solution pump and the new added solution heat exchanger and then connects the new added absorber. The new added absorber has the dilute solution pipe which passes through the new added solution heat exchanger, absorber and then connects the new added steam bleeding chamber.

We change that absorber has the heated medium pipe connected external to that absorber has refrigerant vapor channel connected the new added absorber after that condenser or evaporator add the liquid refrigerant pipe which passes through the new added liquid refrigerant pump and then connects absorber. Or we change that absorber has the heated medium pipe connected external to that absorber has refrigerant vapor channel connected the new added absorber after that evaporator has the liquid refrigerant pipe which passes through the second liquid refrigerant pump and then connects absorber. At the same time, we adjust that evaporator has the liquid refrigerant pipe which passes through the second liquid refrigerant pump and then connects absorption-evaporator to that evaporator has the liquid refrigerant pipe which passes through the second liquid refrigerant pump, the new added throttle and then connects absorption-evaporator.

The new added steam bleeding chamber has refrigerant vapor channel connected condenser. The new added absorber has the heated medium pipe connected external. The single generator two-stage second-type absorption heat pump completes two stages improving of residual heat temperature. The second absorber heats up the liquid refrigerant which flows through it. And the liquid refrigerant becomes refrigerant vapor provided to the new added absorber. And absorber heats up the liquid refrigerant which flows through it. The liquid refrigerant becomes refrigerant vapor provided to the new added absorber. After that part of the solution is vaporization, it enters the new added steam bleeding chamber. The refrigerant vapor produced by the new added steam bleeding chamber enters condenser. At the same time, the concentrated solution enters the new added absorber, absorbs the refrigerant vapor came from absorber and provides the high temperature heating load to the heated medium. Consequently, we achieve the three-stage high temperature second-type absorption heat pump based on the single generator two-stage second-type absorption heat pump.

26. The second-type high temperature absorption heat pump, based on the method expounded in item 2, is formed by adding the new added second steam bleeding chamber, the new added second absorber, the new added second throttle or the new added second liquid refrigerant pump, the new added second solution pump and the new added second solution heat exchanger on any of the second-type high temperature absorption heat pumps expounded in item 3-25.

We adopt the solution tandem cycle as following. We change that the new added steam bleeding chamber has the concentrated solution pipe which passes through the new added solution pump and the new added solution heat exchanger and then connects the new added absorber to that the new added steam bleeding chamber has the concentrated solution pipe which passes through the new added solution pump and the new added solution heat exchanger, the new added absorber and then connects the new added second steam bleeding chamber. The new added second steam bleeding chamber has the concentrated solution pipe which passes through the new added second solution pump, the new added second solution heat exchanger and then connects the new added second absorber. The new added second absorber has the dilute solution pipe which passes through the new added second solution heat exchanger and then connects the new added absorber. We change that the new added absorber has the heated medium pipe connected external to that the new added absorption-evaporator has refrigerant vapor channel connected the new added second absorber after that condenser or evaporator adds the liquid refrigerant pipe which passes through the new added second liquid refrigerant pump and then connects the new added absorber. Or we change that the new added absorber has the heated medium pipe connected external to that the new added absorption-evaporator has refrigerant vapor channel connected the new added second absorber after that condenser has the liquid refrigerant pipe which passes through liquid refrigerant pump and then connects the new added absorber. At the same time, we adjust that condenser has liquid refrigerant pipe connected other components such as evaporator or absorber or absorption-evaporator to that condenser has the liquid refrigerant pipe which passes through liquid refrigerant pump, the new added second throttle and then connects other components such as evaporator or absorber or absorption-evaporator.

The new added second steam bleeding chamber has refrigerant vapor channel connected condenser. The new added second absorber the heated medium pipe connected external. The new added absorber heats up the liquid refrigerant. And it becomes refrigerant vapor provided to the new added second absorber. The new added absorber heats up the solution which flows through it.

After that part of the solution is vaporization, it enters the new added second steam bleeding chamber. The refrigerant vapor produced by the new added second steam bleeding chamber enters condenser. At the same time, the concentrated solution enters the new added second absorber, absorbs the refrigerant vapor came from the new added absorber and provides the high temperature heating load to the heated medium. Consequently, we achieve the corresponding three-stage or multistage high temperature second-type absorption heat pump.

27. The second-type high temperature absorption heat pump, based on the method expounded in item 2, is formed by adding the new added second steam bleeding chamber, the new added second absorber, the new added second throttle or the new added second liquid refrigerant pump, the new added second solution pump and the new added second solution heat exchanger on any of the second-type high temperature absorption heat pumps expounded in item 3-25.

We adopt the solution independent cycle as following. The new added second steam bleeding chamber has the concentrated solution pipe which passes through the new added second solution pump, the new added second solution heat exchanger and then connects the new added second absorber. The new added second absorber has the dilute solution pipe which passes through the new added second solution heat exchanger, the new added absorber and then connects the new added second steam bleeding chamber. We change that the new added absorber has the heated medium pipe connected external to that the new added absorption-evaporator has refrigerant vapor channel connected the new added second absorber after that condenser or evaporator adds the liquid refrigerant pipe which passes through the new added second liquid refrigerant pump and then connects the new added absorber. Or we change that the new added absorber has the heated medium pipe connected external to that the new added absorption-evaporator has refrigerant vapor channel connected the new added second absorber after that condenser has the liquid refrigerant pipe which passes through liquid refrigerant pump and then connects the new added absorber. At the same time, we adjust that condenser has liquid refrigerant pipe connected other components such as evaporator or absorber or absorption-evaporator to that condenser has the liquid refrigerant pipe which passes through liquid refrigerant pump, the new added second throttle and then connects other components such as evaporator or absorber or absorption-evaporator.

The new added second steam bleeding chamber has refrigerant vapor channel connected condenser. The new added second absorber the heated medium pipe connected external. The new added absorber heats up the liquid refrigerant. And it becomes refrigerant vapor provided to the new added second absorber. The new added absorber heats up the solution which flows through it.

After that part of the solution is vaporization, it enters the new added second steam bleeding chamber. The refrigerant vapor produced by the new added second steam bleeding chamber enters condenser. At the same time, the concentrated solution enters the new added second absorber, absorbs the refrigerant vapor came from the new added absorber and provides the high temperature heating load to the heated medium. Consequently, we achieve the corresponding three-stage or multistage high temperature second-type absorption heat pump.

28. The second-type high temperature absorption heat pump is formed by adding the re-added absorber, the re-added solution heat exchanger on any of the second-type high temperature absorption heat pumps expounded in item 3, 5, 10, 12, 14-15, 21. The new added steam bleeding chamber has the concentrated solution pipe which passes through the new added solution pump, the re-added solution heat exchanger and then connects the re-added absorber. The re-added absorber has the dilute solution pipe which passes through the re-added solution heat exchanger and then connects generator or low pressure generator. The first evaporator adds refrigerant vapor pipe connected the re-added absorber. The re-added absorber has the heated medium pipe connected external. Consequently, we get the second-type high temperature absorption heat pump with low-temperature heating-side.

29. The second-type high temperature absorption heat pump is formed by adding the re-added absorber, the re-added solution heat exchanger, the re-added solution regulator on any of the second-type high temperature absorption heat pumps expounded in item 3, 5, 10, 12, 14-15, 21. The new added steam bleeding chamber has the concentrated solution pipe which passes through the new added solution pump, the re-added solution regulator and then connects the re-added absorber. The re-added absorber has the dilute solution pipe which passes through the re-added solution heat exchanger and then connects generator or low pressure generator. We change that generator has concentrated solution which passes through solution pump and one or several solution heat exchanger and then connects absorber to that generator has concentrated solution which passes through solution pump, the re-added solution heat exchanger and one or several solution heat exchanger and then connects absorber. Evaporator adds refrigerant vapor pipe connected the re-added absorber. The re-added absorber has the heated medium pipe connected external. Consequently, we get the second-type high temperature absorption heat pump with low-temperature heating-side.

30. The second-type high temperature absorption heat pump is formed by adding the re-added absorber, the re-added solution heat exchanger, the re-added evaporator, the re-added throttle on any of the single evaporator second-type high temperature absorption heat pumps expounded in item 3, 5, 10, 12, 14-15, 21. Evaporator has liquid refrigerant pipe which passes through the re-added throttle and then connects the re-added evaporator. We adjust that evaporator has liquid refrigerant channel connected the first absorber or absorption-evaporator to that evaporator has refrigerant vapor channel connected the re-added absorber and the re-added evaporator has refrigerant vapor channel connected the first absorber or absorption-evaporator. The new added steam bleeding chamber has the concentrated solution pipe which passes through the new added solution pump, the re-added solution heat exchanger and then connects the re-added absorber. The re-added absorber has the dilute solution pipe which passes through the re-added solution heat exchanger and then connects generator or low pressure generator. The re-added absorber has the heated medium pipe connected external. Consequently, we get the second-type high temperature absorption heat pump with low-temperature heating-side.

31. The second-type high temperature absorption heat pump is formed by adding the re-added absorber, the re-added solution heat exchanger, the re-added solution regulator, the re-added evaporator, the re-added throttle on any of the single evaporator second-type high temperature absorption heat pumps expounded in item 3, 5, 10, 12, 14-15, 21. Evaporator has liquid refrigerant pipe which passes through the re-added throttle and then connects the re-added evaporator. We adjust that evaporator has refrigerant vapor channel connected the first absorber or absorption-evaporator to that evaporator has refrigerant vapor channel connected the re-added absorber and the re-added evaporator has refrigerant vapor channel connected the first absorber or absorption-evaporator. The new added steam bleeding chamber has the concentrated solution pipe which passes through the new added solution pump, the re-added solution heat exchanger and then connects the re-added absorber. The re-added absorber has the dilute solution pipe which passes through the re-added solution heat exchanger and then connects generator or low pressure generator. The re-added absorber has the heated medium pipe connected external. Consequently, we get the second-type high temperature absorption heat pump with low-temperature heating-side.

31. The second-type high temperature absorption heat pump is formed in the following way. Based on any of the single evaporator second-type high temperature absorption heat pumps expounded in item 3-25 which is formed by adding the new added steam bleeding chamber, the new added absorber, the new added liquid refrigerant pump or the new added throttle, the new added solution pump and the new added solution heat exchanger, we adds recuperative steam bleeding chamber, recuperative absorber, recuperative solution pump and recuperative solution heat exchanger.

Recuperative steam bleeding chamber has the concentrated solution pipe which passes through recuperative solution pump and recuperative solution heat exchanger and then connects recuperative absorber. Recuperative absorber has the dilute solution pipe which passes through recuperative solution heat exchanger, the new added absorber and then connects recuperative steam bleeding chamber. Absorber adds refrigerant vapor channel connected recuperative absorber. Recuperative steam bleeding chamber has refrigerant vapor channel connected condenser. Recuperative absorber has the heated medium pipe connected external. We can reserve and cancel that the new added absorber has the heated medium pipe connected external. Then we get the recuperative high temperature second-type absorption heat pump.

Aimed at the second-type high temperature absorption heat pump which is formed by adding the new added steam bleeding chamber, the new added absorber, the new added liquid refrigerant pump or the new added throttle, the new added solution pump and the new added solution heat exchanger, the new added second steam bleeding chamber, the new added second absorber, the new added throttle or the new added second liquid refrigerant pump, the new added second solution pump and the new added second solution heat exchanger, we add recuperative steam bleeding chamber, recuperative absorber, recuperative solution pump and recuperative solution heat exchanger.

Recuperative steam bleeding chamber has the concentrated solution pipe which passes through recuperative solution pump and recuperative solution heat exchanger and then connects recuperative absorber. Recuperative absorber has the dilute solution pipe which passes through recuperative solution heat exchanger, the new added second absorber and then connects recuperative steam bleeding chamber. Absorber which the new added absorber provides refrigerant vapor to connects recuperative absorber. Or the new added absorber connects recuperative absorber. Recuperative steam bleeding chamber has the refrigerant vapor channel connected condenser. Recuperative absorber has the heated medium pipe connected external. We can reserve and cancel that the new added second absorber has the heated medium pipe connected external. Then we get the recuperative high temperature second-type absorption heat pump.

32. The second-type high temperature absorption heat pump is formed in the following way. Based on any of the single evaporator second-type high temperature absorption heat pumps expounded in item 3-25 which is formed by adding the new added steam bleeding chamber, the new added absorber, the new added liquid refrigerant pump or the new added throttle, the new added solution pump and the new added solution heat exchanger, we adds recuperative steam bleeding chamber, recuperative absorber, recuperative first solution pump, recuperative solution heat exchanger or adds recuperative second solution pump too.

We change that the new added steam bleeding chamber has the concentrated solution pipe which passes through the new added solution pump and the new added solution heat exchanger and then connects the new added absorber to that the new added steam bleeding chamber has the concentrated solution pipe which passes through the new added solution pump and the new added solution heat exchanger, the new added absorber and then connects recuperative steam bleeding chamber. Recuperative steam bleeding chamber has the concentrated solution pipe which passes through recuperative first solution pump and recuperative solution heat exchanger and then connects recuperative absorber. Recuperative absorber has the dilute solution pipe which passes through recuperative solution heat exchanger or passes recuperative second solution pump too and then connects the new added absorber. Absorber adds refrigerant vapor channel connected recuperative absorber. Recuperative steam bleeding chamber has refrigerant vapor channel connected condenser. Recuperative absorber has the heated medium pipe connected external. We can reserve and cancel that the new added absorber has the heated medium pipe connected external. Then we get the recuperative high temperature second-type absorption heat pump.

Aimed at the second-type high temperature absorption heat pump which is formed by adding the new added steam bleeding chamber, the new added absorber, the new added liquid refrigerant pump or the new added throttle, the new added solution pump and the new added solution heat exchanger, the new added second steam bleeding chamber, the new added second absorber, the new added throttle or the new added second liquid refrigerant pump, the new added second solution pump and the new added second solution heat exchanger, we add recuperative steam bleeding chamber, recuperative absorber, recuperative first solution pump, recuperative solution heat exchanger or add recuperative second solution pump too.

We change that the pipe from the new added second steam bleeding chamber passes through the new added second solution pump and the new added second solution heat exchanger and then connects the new added second absorber to that the pipe from the new added second steam bleeding chamber passes through the new added second solution pump and the new added second solution heat exchanger, the new added second absorber and then connects recuperative steam bleeding chamber. Recuperative steam bleeding chamber has the concentrated solution pipe which passes through recuperative solution pump and recuperative solution heat exchanger and then connects recuperative absorber. Recuperative absorber has the dilute solution pipe which passes through recuperative solution heat exchanger or passes recuperative second solution pump too and then connects the new added second absorber. Absorber which the new added absorber provides refrigerant vapor to connects recuperative absorber. Or the new added absorber connects recuperative absorber. Recuperative steam bleeding chamber has the refrigerant vapor channel connected condenser. Recuperative absorber has the heated medium pipe connected external. We can reserve and cancel that the new added second absorber has the heated medium pipe connected external. Then we get the recuperative high temperature second-type absorption heat pump.

BRIEF DESCRIPTION OF THE DRAWINGS

According to the method provided by the invention.

According to the method provided by the invention.

The difference between FIG. 1 and FIG. 2 is as follows. Firstly, the solution cycle way is different. We use the solution tandem cycle in FIG. 1 while the solution independent cycle is adopted in FIG. 2. Secondly, in FIG. 1, the new added throttle is used and condenser has the pipe which passes through the liquid refrigerant pump and then connects absorber and the new added absorber in turn. What's more, the new added liquid refrigerant pump is used and evaporator has the pipe which passes through the liquid refrigerant pump and then connects absorber and the new added absorber in turn.

According to the method provided by the invention.

According to the method provided by the invention.

According to the method provided by the invention.

The difference between FIG. 5 and FIG. 3 is as follows. In FIG. 5, condenser B1 has the liquid refrigerant pipe which passes through liquid refrigerant pump F1 and then connects the second absorber H1. After that, the second absorber H1 has refrigerant vapor channel connected the new added absorber 2. In FIG. 3, condenser B1 has the liquid refrigerant pipe which passes through liquid refrigerant pump F1 and then connects the first absorber D1. After that, the first absorber D1 has refrigerant vapor channel connected the new added absorber 2. According to the method provided by the invention, FIG. 5 is the delegate of the two-stage high temperature second-type absorption heat pump which is based on the recuperative single stage second-type absorption heat pump.

According to the method provided by the invention.

According to the method provided by the invention.

The difference between FIG. 7 and FIG. 6 is as follows. Firstly, the solution cycle way is different. We use the solution independent cycle in FIG. 6 while the solution tandem cycle is adopted in FIG. 7. Secondly, in FIG. 6, the low pressure generator connects the high pressure generator through the second solution pump. In FIG. 7, the high pressure generator connects the low pressure generator through the second solution heat exchanger.

According to the method provided by the invention.

According to the method provided by the invention.

According to the method provided by the invention.

The difference between FIG. 10 and FIG. 8 is as follows. In FIG. 10, the high pressure generator A2 has the concentrated solution pipe which passes through the first solution pump F2, the first solution heat exchanger J2, absorber E2 and then connects the new added steam bleeding chamber 1. In FIG. 8, the concentrated solution pipe which passes through the first solution pump F2, the first solution heat exchanger J2 from the high pressure generator A2 converges with the pipe which passes through the second solution pump G2, the second solution heat exchanger K2 from the low pressure generator B2, and then the pipe passes through absorber E2 and connects the new added steam bleeding chamber 1.

According to the method provided by the invention.

According to the method provided by the invention.

According to the method provided by the invention.

According to the method provided by the invention.

According to the method provided by the invention.

The difference among FIG. 11 to FIG. 16 is as follows. They adopt different ways of solution cycle to promote the heating temperature of heat pump. What's more, the recuperative way they adopt is different too. Some back-heating way use the solution tandem cycle which some back-heating way use the solution independent cycle.

Figure 17:
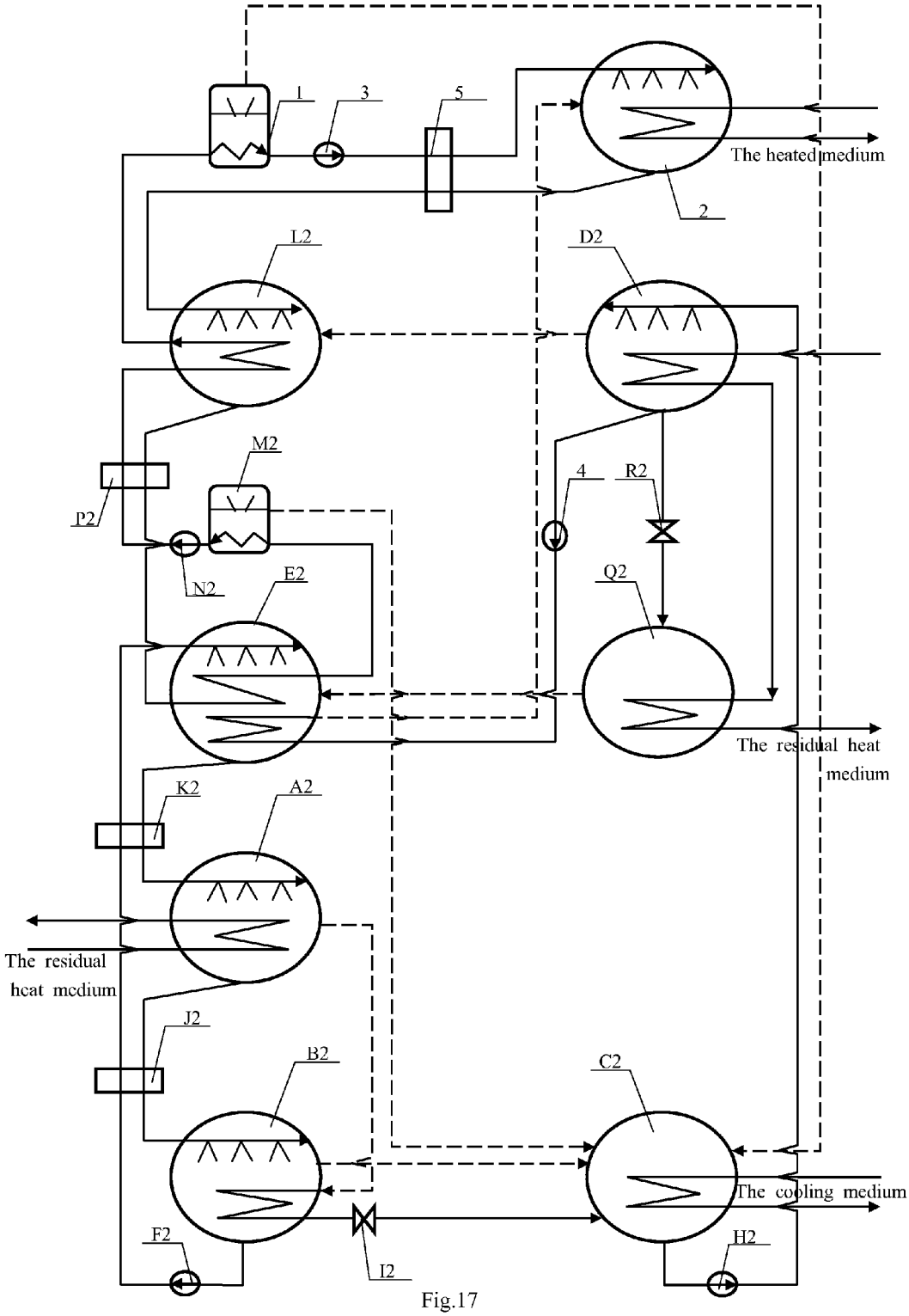

According to the method provided by the invention, FIG. 17 is the structure and flow diagram of the two-stage high temperature second-type absorption heat pump which adopts the solution tandem cycle and is based on the recuperative single stage tandem double-effect second-type absorption heat pump.

Figure 14:
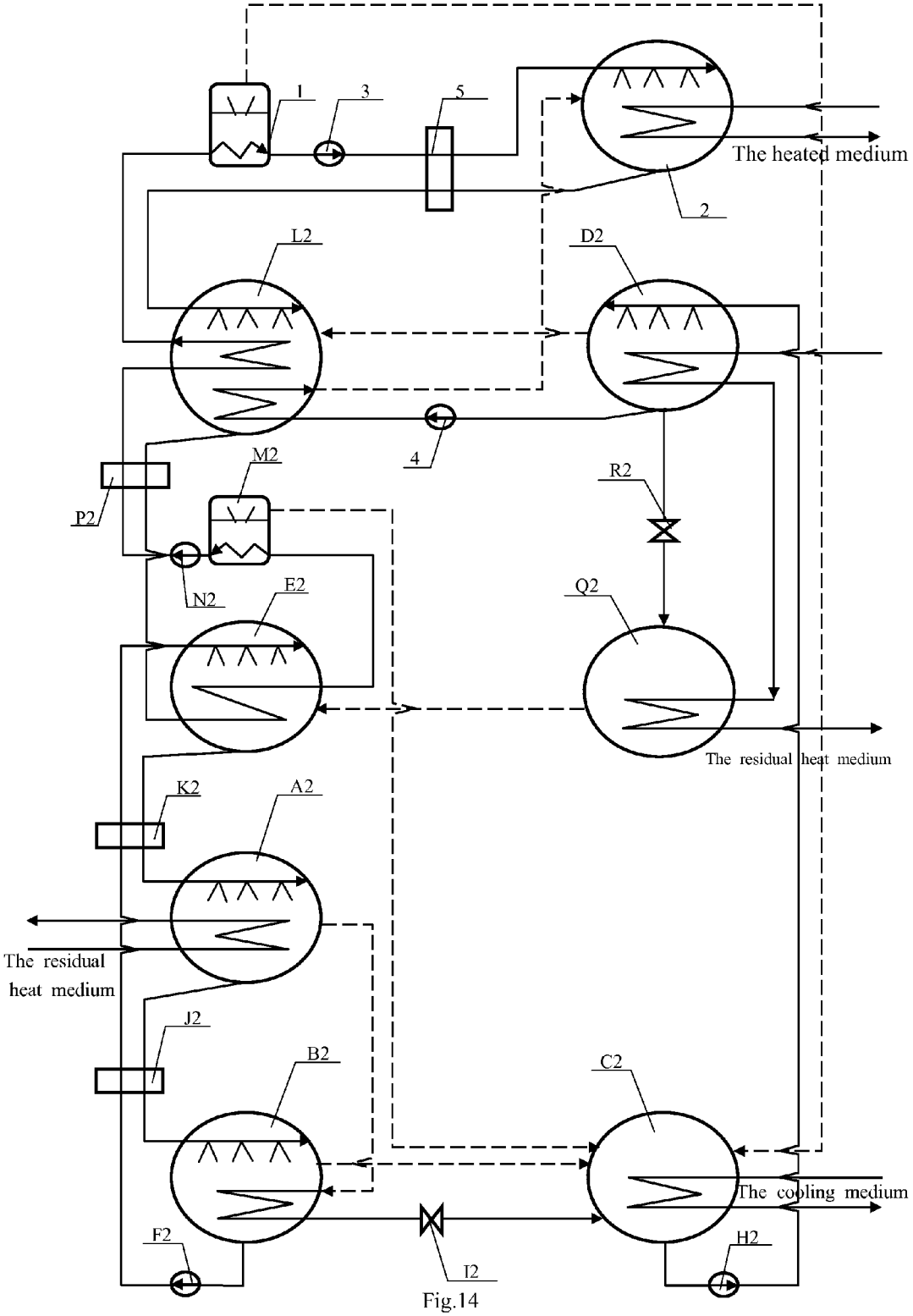
FIG. 14 is the structure and flow diagram of the two-stage high temperature second-type absorption heat pump which adopts the solution tandem cycle and is based on the recuperative single stage tandem double-effect second-type absorption heat pump.

The difference between FIG. 17 and FIG. 14 is as follows. Firstly, the new added absorber 2 has the heated medium pipe connected external in FIG. 17. Secondly, the first absorber E2 has the refrigerant vapor channel connected external after that the first evaporator D2 has the liquid refrigerant pipe which passes through the new added liquid refrigerant pump 4 and then connects the first absorber E2 in FIG. 17. Thirdly, the heating temperature shown in FIG. 17 is lower than the one shown in FIG. 14 but the performance index shown in FIG. 17 is relative higher than the one shown in FIG. 14. According to the method provided by the invention, FIG. 17 is the delegate of the two-stage high temperature second-type absorption heat pumps which are based on the recuperative single stage tandem double-effect second-type absorption heat pump.

Figure 18:
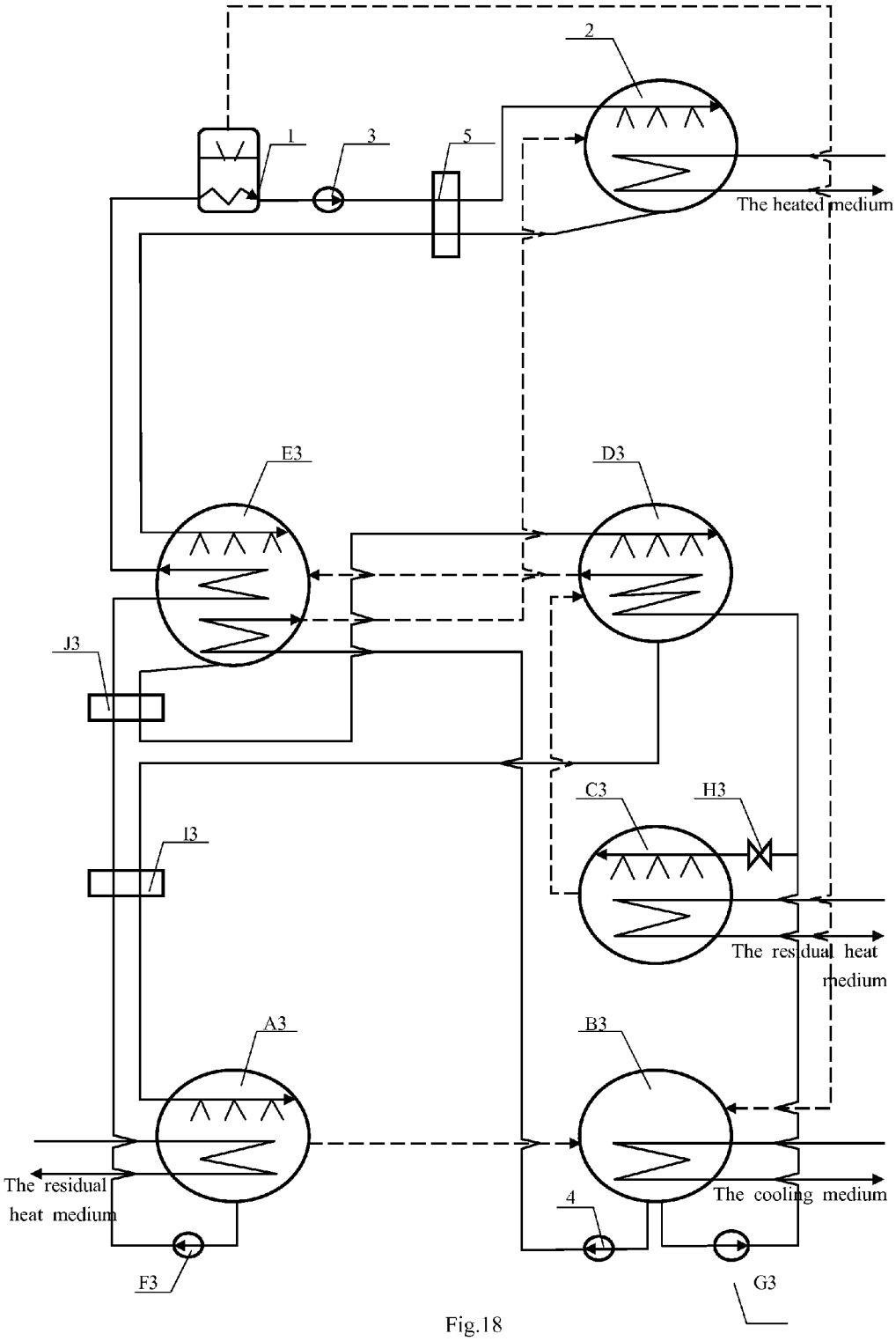

According to the method provided by the invention, FIG. 18 is the structure and flow diagram of the three-stage high temperature second-type absorption heat pump which adopts the solution tandem cycle and is based on the single generator two-stage second-type absorption heat pump.

Figure 19:
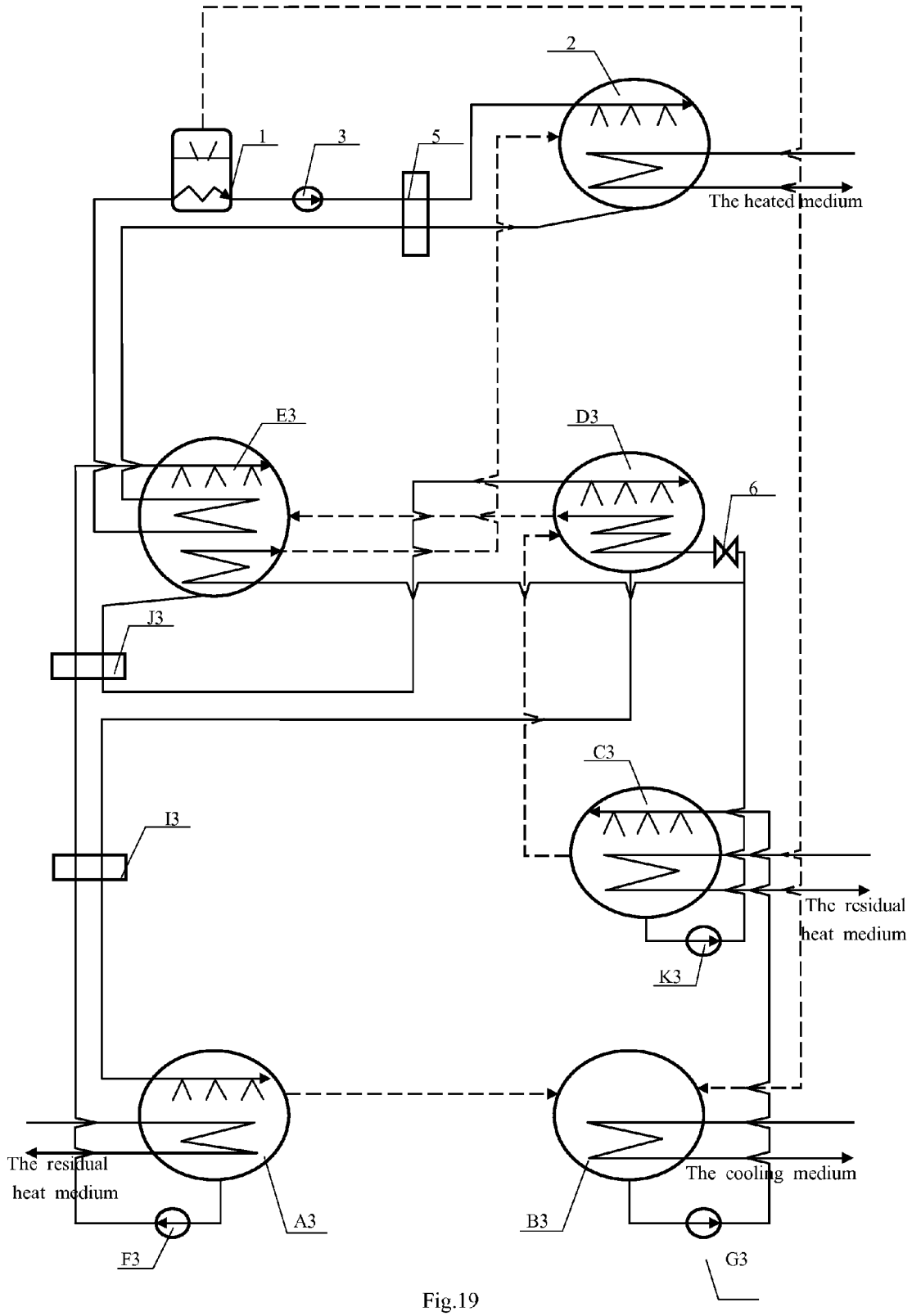

According to the method provided by the invention, FIG. 19 is the structure and flow diagram of the three-stage high temperature second-type absorption heat pump which adopts the solution independent cycle and is based on the single generator two-stage second-type absorption heat pump.

Figure 20:
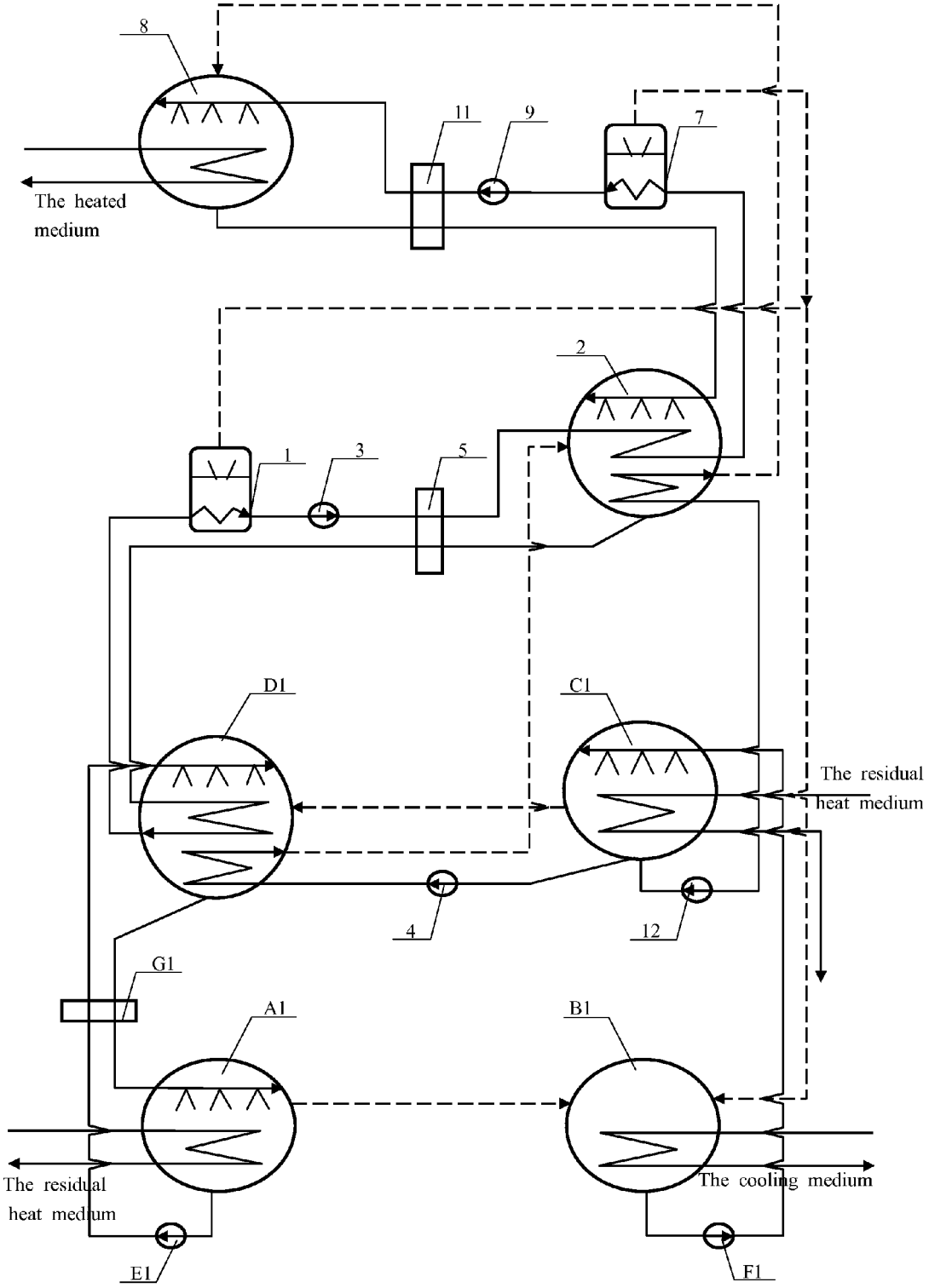

According to the method provided by the invention, FIG. 20 is the structure and flow diagram of the three-stage high temperature second-type absorption heat pump which adopts the solution tandem cycle and is based on the two-stage high temperature second-type absorption heat pump achieved by using the solution independent cycle.

Figure 21:
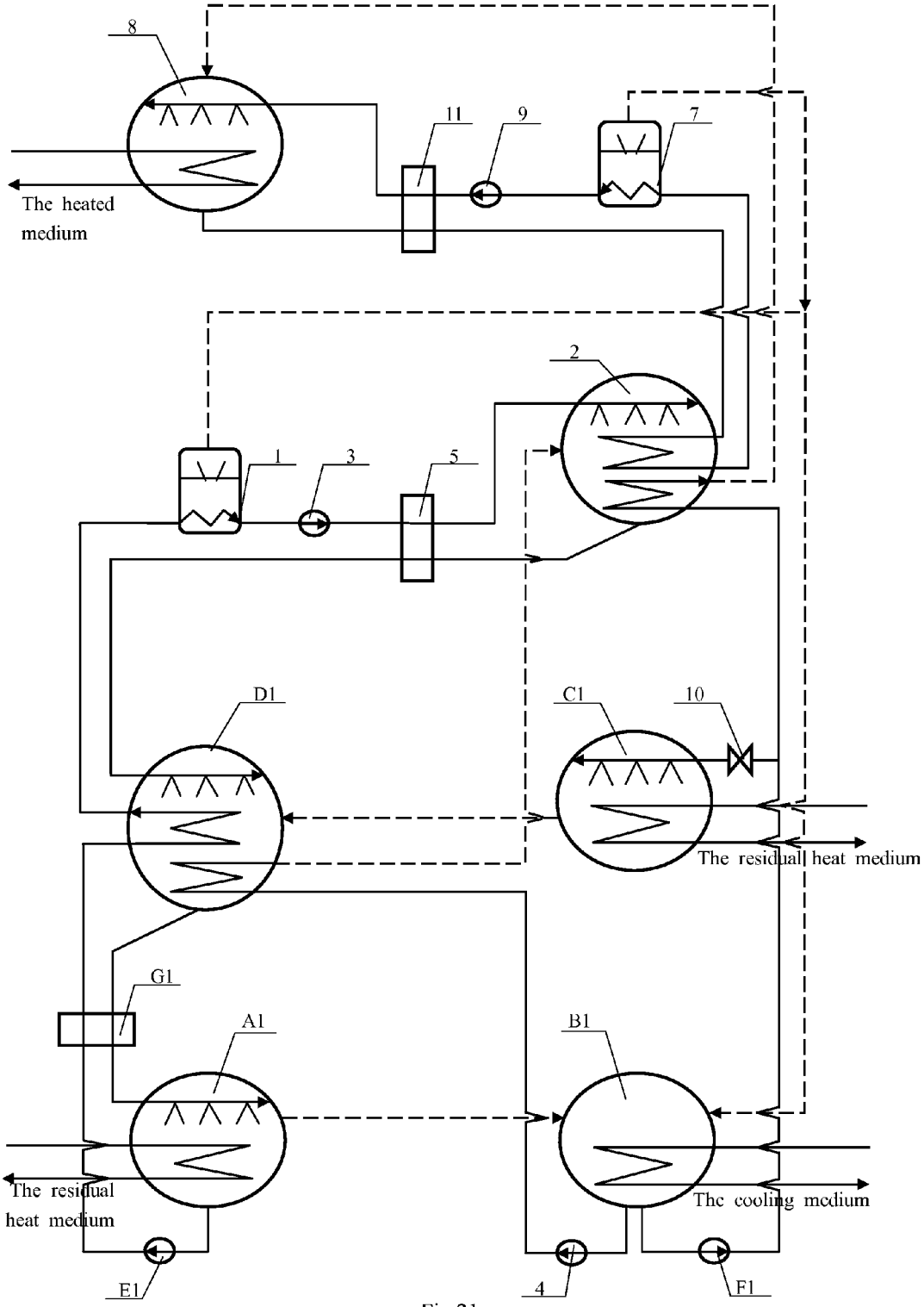

According to the method provided by the invention, FIG. 21 is the structure and flow diagram of the three-stage high temperature second-type absorption heat pump which adopts the solution independent cycle and is based on the two-stage high temperature second-type absorption heat pump achieved by using the solution tandem cycle.

According to the method provided by the invention, FIG. 20 and FIG. 21 are two delegates of the three-stage high temperature second-type absorption heat pump which is based on the two-stage high temperature second-type absorption heat pump.

Figure 22:
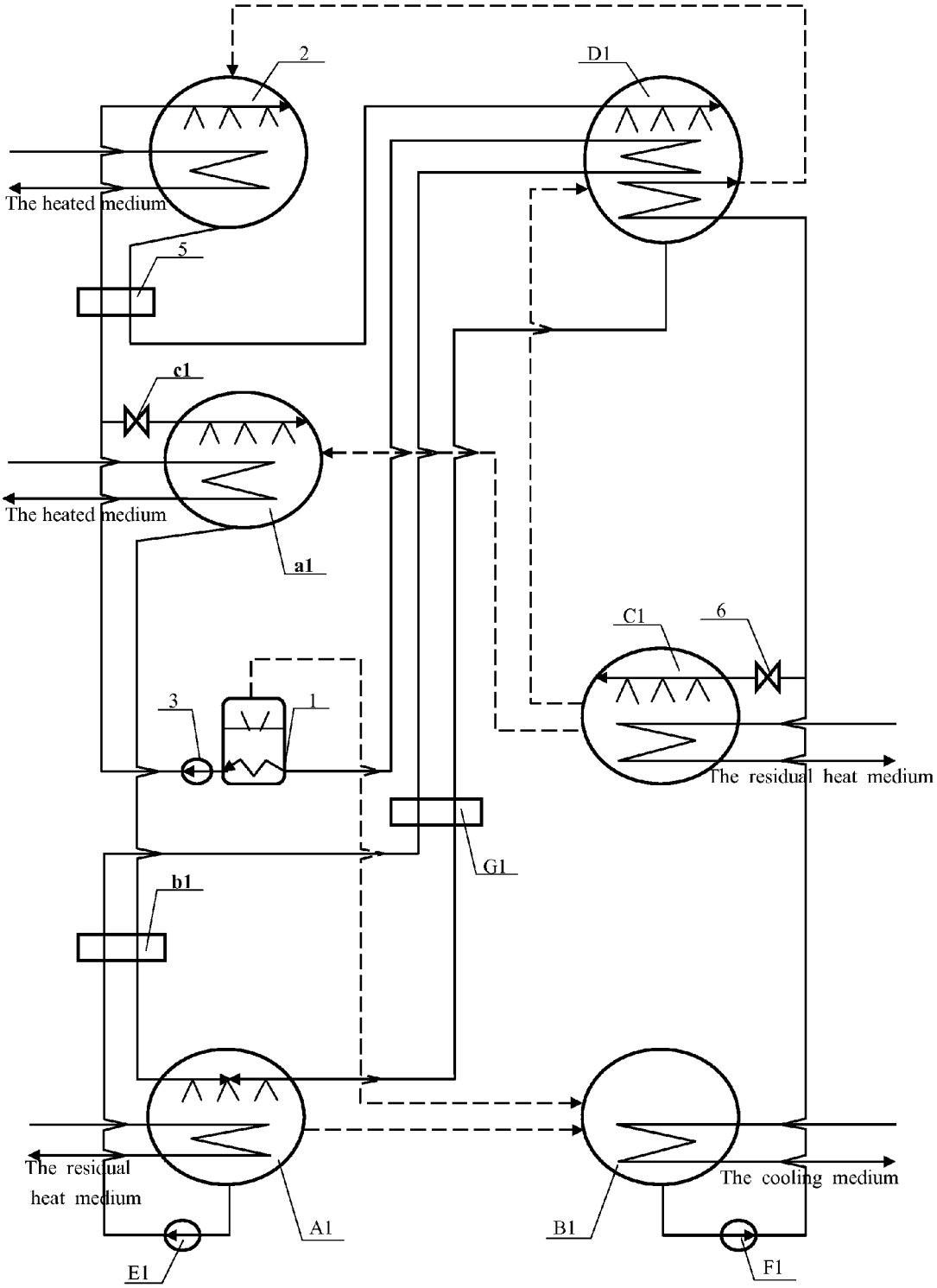

FIG. 22 is the structure and flow diagram of the two-stage high temperature second-type absorption heat pump with two-terminal heating which can be achieved by adding low temperature heating-side on the two-stage high temperature second-type absorption heat pump. The two-stage high temperature second-type absorption heat pump is based on the single stage second-type absorption heat pump.

Figure 23:
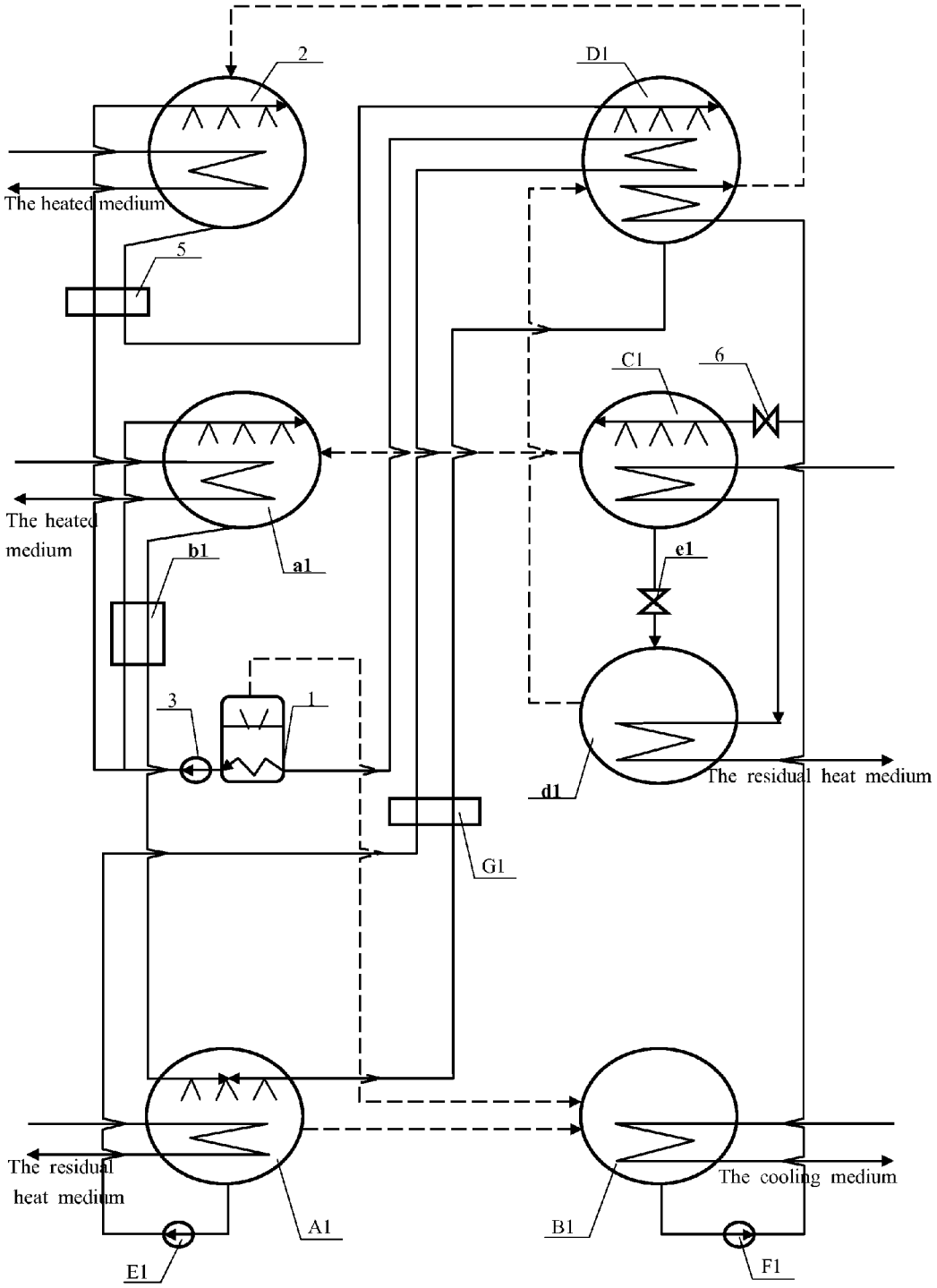

FIG. 23 also is the structure and flow diagram of the two-stage high temperature second-type absorption heat pump with two-terminal heating which can be achieved by adding low temperature heating-side on the two-stage high temperature second-type absorption heat pump. The two-stage high temperature second-type absorption heat pump is based on the single stage second-type absorption heat pump.

The difference between FIG. 23 and FIG. 22 is as follows. In FIG. 23, we add the re-added absorber, the re-added solution heat exchanger to form the low temperature heating-side. In FIG. 22, we add the re-added absorber, the re-added solution regulator, the re-added solution heat exchanger to form the low temperature heating-side.

Figure 24:
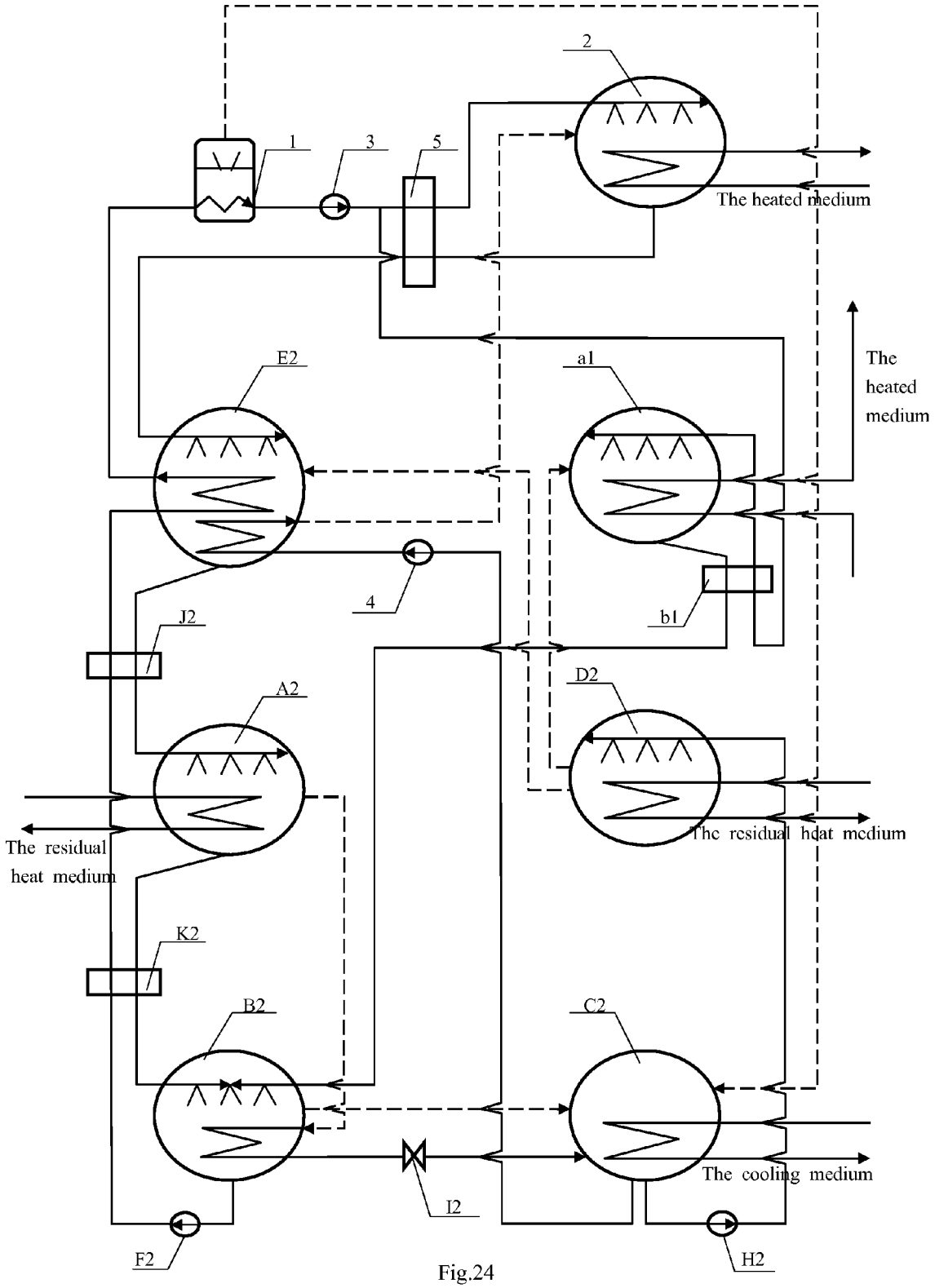

FIG. 22 to FIG. 24 is three delegates of adding the low temperature heating-side on the high temperature second-type absorption heat pumps.

Figure 25:
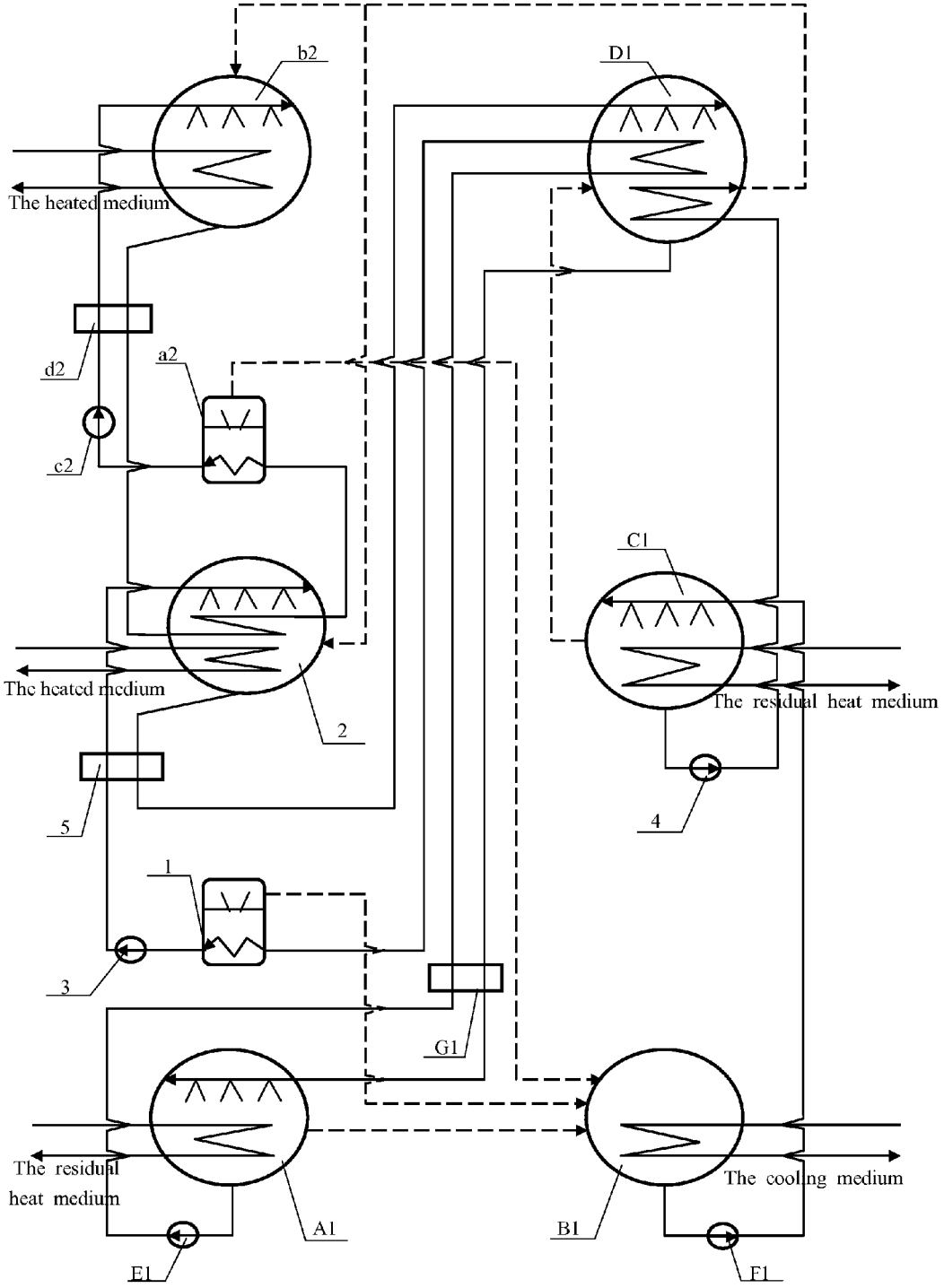

FIG. 25 is the structure and flow diagram of the recuperative two-stage high temperature second-type absorption heat pump with two-terminal heating which can be achieved by adding recuperative process on the two-stage high temperature second-type absorption heat pump. The two-stage high temperature second-type absorption heat pump is based on the single stage second-type absorption heat pump.

Figure 26:
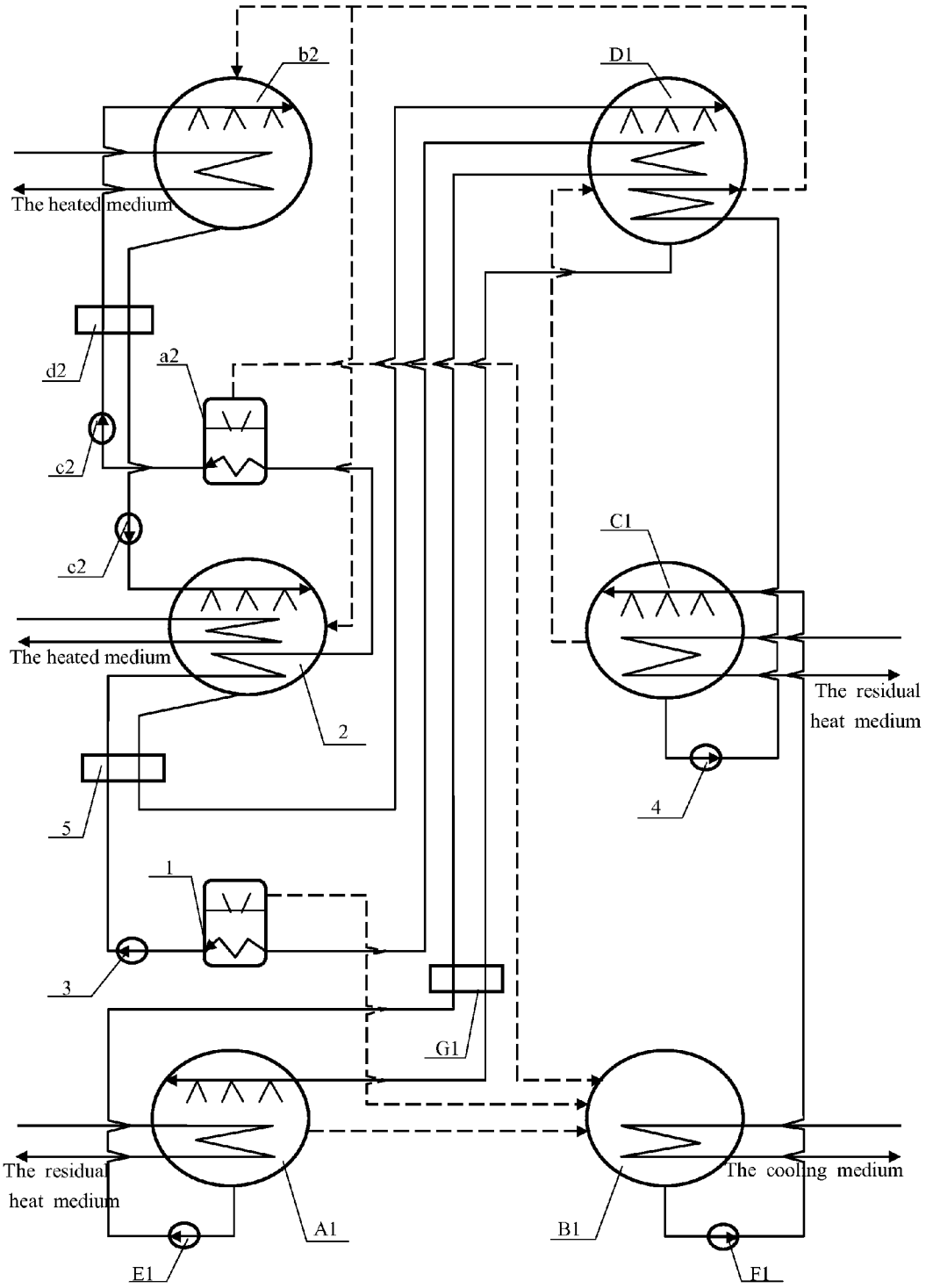

FIG. 26 also is the structure and flow diagram of the recuperative two-stage high temperature second-type absorption heat pump with two-terminal heating which can be achieved by adding recuperative process on the two-stage high temperature second-type absorption heat pump. The two-stage high temperature second-type absorption heat pump is based on the single stage second-type absorption heat pump.

FIG. 25 and FIG. 26 are two delegates of the recuperative high temperature second-type absorption heat pumps by adding recuperative process on the high temperature second-type absorption heat pump.

In the figure, 1—the new added steam bleeding chamber/the new added first steam bleeding chamber, 2—the new added absorber/the new added first absorber, 3—the new added solution pump/the new added first solution pump, 4—the new added liquid refrigerant pump/the new added first liquid refrigerant pump, 5—the new added solution heat exchanger/the new added first solution heat exchanger, 6—the new added throttle/the new added first throttle, 7—the new added second steam bleeding chamber, 8—the new added second absorber, 9—the new added second solution pump, 10—the new added second throttle, 11—the new added second solution heat exchanger, 12—the new added second liquid refrigerant pump, a1—the re-added absorber, b1—the re-added solution heat exchanger, c1—the re-added solution regulator, a2—the recuperative steam bleeding chamber, b2—the recuperative absorber, c2—the recuperative solution heat pump/the recuperative first solution heat pump, d2—the recuperative solution heat exchanger, e2—the recuperative second solution pump.

In the FIG. 1 to FIG. 4, FIG. 18 to FIG. 21, FIG. 24 to FIG. 25, A1—generator, B1—condenser, C1—evaporator/the first evaporator, D1—absorber/the first absorber, E1—solution pump/the first solution heat pump, F1—liquid refrigerant pump, G1—solution heat exchanger/the first solution heat exchanger, H1—the second absorber, I1—the steam bleeding chamber, J1—the second solution pump, K1—the third solution pump, L1—the second solution heat exchanger, M1—the second evaporator, N1—throttle.

In the FIG. 5 to FIG. 15, FIG. 22, A2—high pressure generator, B2—low pressure generator, C2—condenser, D2—evaporator/the first evaporator, E2—absorber/the first absorber, F2—solution pump/the first solution pump, G2—the second solution pump, H2—liquid refrigerant pump, I2—throttle/the first throttle, J2—solution heat exchanger/the first solution heat exchanger, K2—the second solution heat exchanger, L2—the second absorber, M2—the steam bleeding chamber, N2—the third solution pump, O2—the fourth solution pump, P2—the second solution heat exchanger, Q2—the second evaporator, R2—the second throttle.

Figure 16:
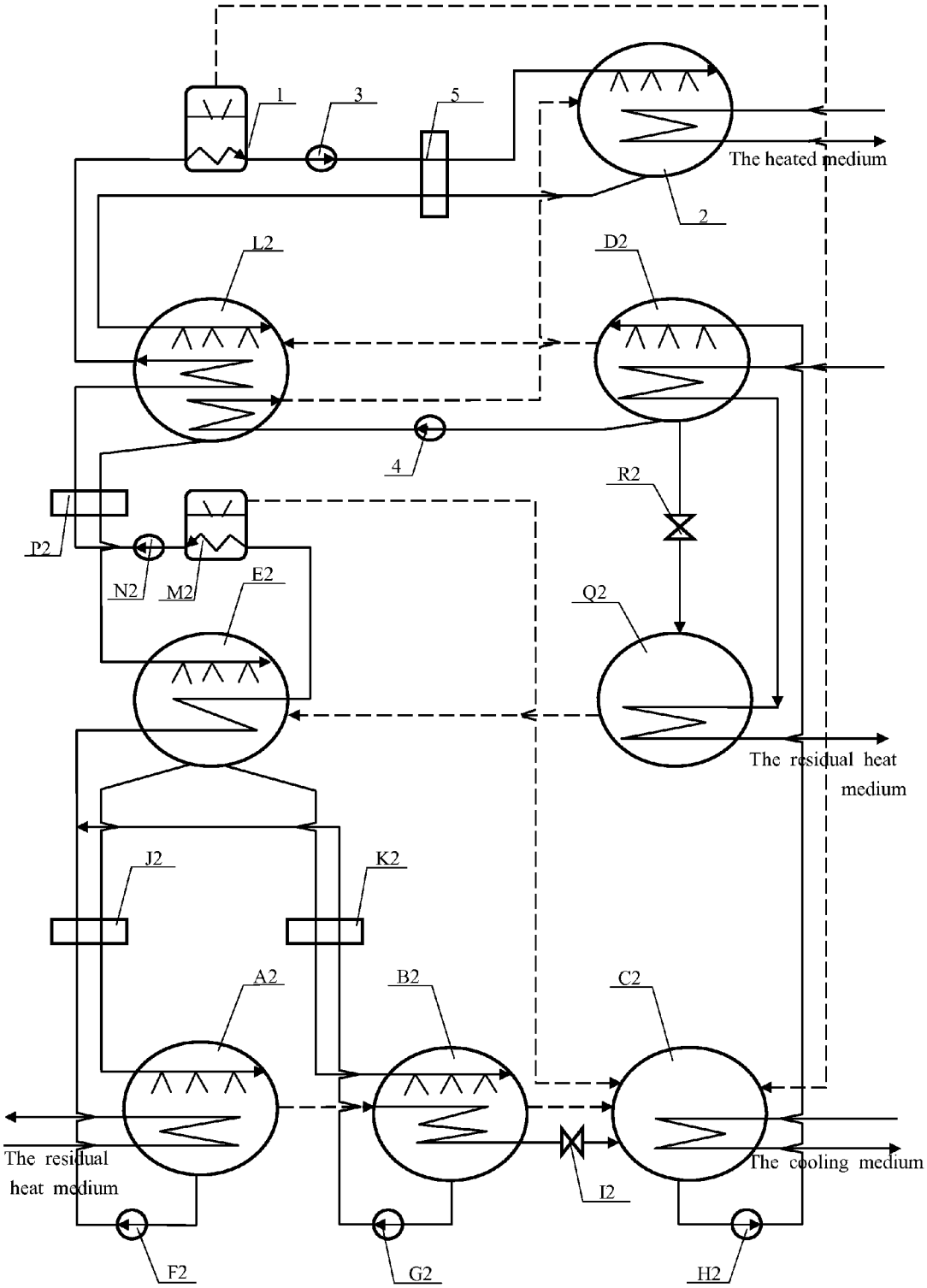
FIG. 16 is the structure and flow diagram of the two-stage high temperature second-type absorption heat pump which adopts the solution tandem cycle and is based on the recuperative single stage parallel double-effect second-type absorption heat pump.

In FIG. 16 to FIG. 17, FIG. 23, A3—generator, B3—condenser, C3—evaporator, D3—absorption-evaporator, E3—absorber, F3—solution pump, G3—liquid refrigerant pump/the first liquid refrigerant pump, H3—throttle, I3—solution heat exchanger, J3—the second solution heat exchanger, K3—the second liquid refrigerant pump.

Among them, absorber D1, E2, E3 is the absorber of the existing second-type low temperature absorption heat pump. After that we add the new added components to form the second-type high temperature absorption heat pump, D1, E2 and D3 not only are used to heat the solution but also heats up the liquid refrigerant which flows through them. And the liquid refrigerant becomes refrigerant vapor which is provided to the new added absorber. So absorber D1, E2 and E3 become absorption-evaporator. In order to reflect its original identity and role, they are still called absorber in the invention.

DETAILED DESCRIPTION OF THE PREFERRED EMBODIMENT

Now combining the appended drawings and examples, we described the invention in detail.

Figure 1:
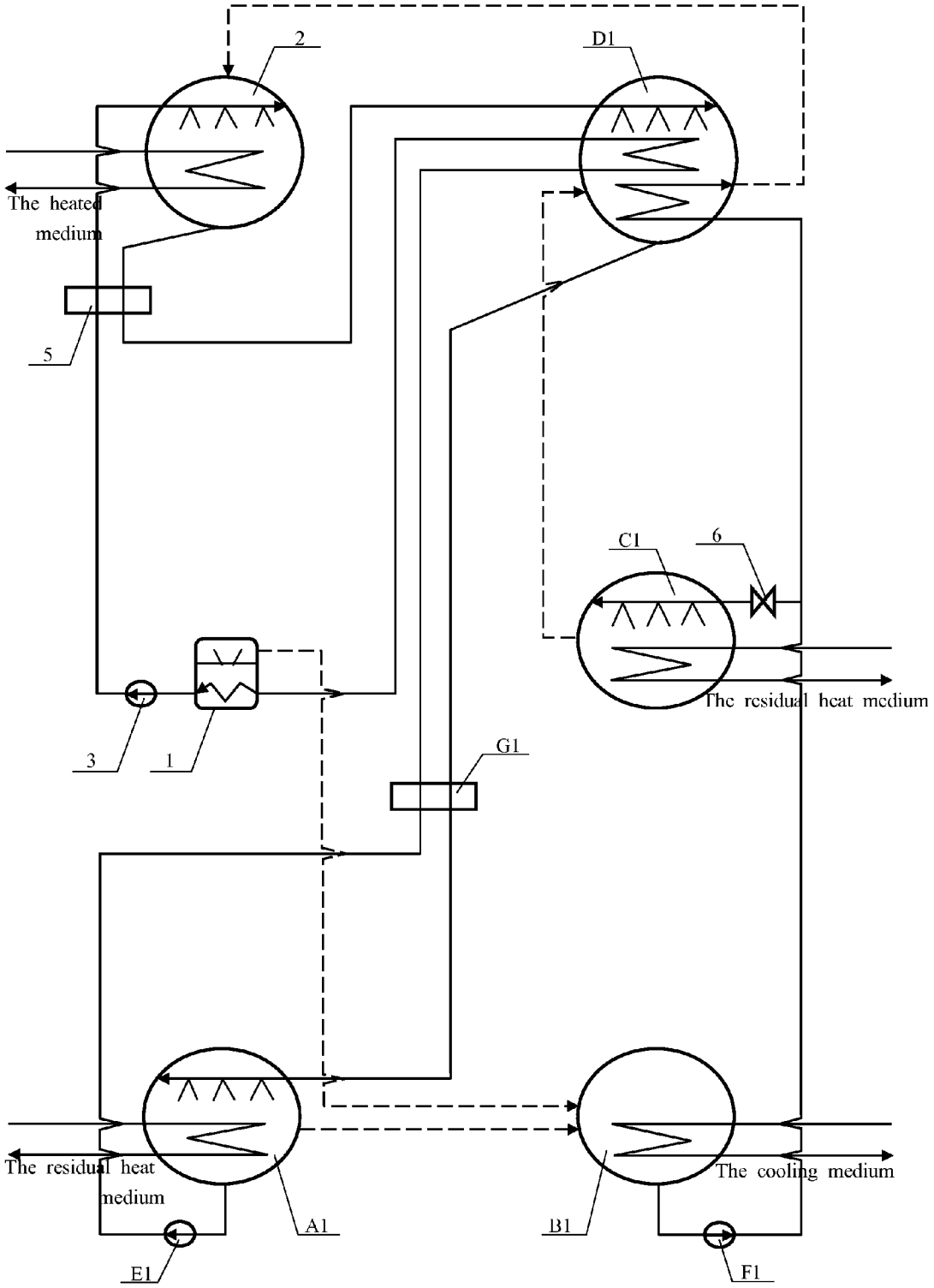
FIG. 1 is the structure and flow diagram of the two-stage high temperature second-type absorption heat pump which adopts the solution tandem cycle and is based on the single stage second-type absorption heat pump.

The two-stage high temperature second-type absorption heat pump shown in FIG. 1, based on the single stage second-type absorption heat pump, can be realized by the following way:

Firstly, structurally, we add the new added steam bleeding chamber 1, the new added absorber 2, the new added throttle 6, the new added solution pump 3, the new added solution heat exchanger 5 on the single stage second-type absorption heat pump which comprises generator, condenser, evaporator, absorber, solution pump, liquid refrigerant pump and solution heat exchanger. In the single stage second-type absorption heat pump, generator A1 has the concentrated solution pipe which passes through solution pump E1 and solution heat exchanger G1 and then connects absorber D1. Absorber D1 has the dilute solution pipe which passes through solution heat exchanger G1 and then connects generator A1. Generator A1 has the refrigerant vapor channel connected condenser B1. Condenser B1 has the liquid refrigerant pipe which passes through liquid refrigerant pump F1 and then connects evaporator C1. Evaporator C1 has the refrigerant vapor channel connected absorber D1. Generator A1 and evaporator C1 have the residual heat medium pipe connected external. Condenser B1 has the cooling medium pipe connected external. Absorber D1 has the heated medium pipe connected external.

We adopt the solution tandem cycle as follows. We change that generator A1 has the concentrated solution pipe which passes through solution pump E1 and solution heat exchanger G1 and then connects absorber D1 to that generator A1 has the concentrated solution pipe which passes through solution pump E1, solution heat exchanger G1, absorber D1 and then connects the new added steam bleeding chamber 1. The new added steam bleeding chamber 1 has the concentrated solution pipe that passes through the new added solution pump 3, the new added solution heat exchanger 5 and then connects the new added absorber 2. The new added absorber 2 has the dilute solution pipe which passes through the new added solution heat exchanger 5 and then connects absorber D1. We change that absorber D1 have the residual heat medium pipe connected external to that absorber D1 has the refrigerant vapor pipe connected the new added absorber 2 after that condenser B1 has the liquid refrigerant pipe which passes through liquid refrigerant pump F1 and then connects absorber D1. We change that condenser B1 has the liquid refrigerant pipe which passes through liquid refrigerant pump F1 and then connects evaporator C1 to that condenser B1 has the liquid refrigerant pipe which passes through liquid refrigerant pump F1, the new added throttle 6 and then connects evaporator C1. The new added steam bleeding chamber 1 has the refrigerant vapor channel connected condenser B1. The new added absorber 2 have the residual heat medium pipe connected external.

Secondly, on the process, absorber D1 has the dilute solution which passes through solution heat exchanger G1 and then enters generator A1. Then the solution is heated by the residual heat medium which flows through generator A1 and releases refrigerant vapor provided to condenser B1. Generator A1 has the concentrated solution which flows through solution pump E1, solution heat exchanger G1 and enters absorber D1 where it absorbs heat and part of it is vaporization. Then it enters the new added steam bleeding chamber 1. The new added steam bleeding chamber 1 releases refrigerant vapor which is provided to condenser B1 while the concentrated solution flows through the new added solution pump 3, the new added solution heat exchanger 5 and then connects the new added absorber 2. Then the concentrated solution absorbs the refrigerant vapor came from absorber D1 and the provided the high temperature heating load to the heated medium. The new added absorber 2 has the dilute solution which flows through the new added solution heat exchanger 5 and then enters absorber D1 where it absorbs the refrigerant vapor came from evaporator C1 and releases heat.

The refrigerant vapor, which enters condenser B1 from generator A1 and the new added steam bleeding chamber 1, releases heat to the cooling medium and becomes liquid refrigerant. The liquid refrigerant flows through liquid refrigerant pump F1 and then is divided into two parts. One part of the liquid refrigerant flows through the new added throttle 6 and then enters evaporator C1 where it absorbs residual heat and becomes refrigerant vapor provided to absorber D1. In absorber D1, the refrigerant vapor is absorbed by the solution and releases heat to the other road of solution and liquid refrigerant which flows through absorber D1. The other part flows through absorber D1 and absorbs heat becoming refrigerant vapor which is provided to the new added absorber 2. At first, the concentration of the solution which enters the new added absorber 2 is promoted by the generator A1 for the first time. And then, the solution concentration is improved by the absorber D1 and the new added steam bleeding chamber 1 for the second time. The refrigerant vapor which enters the new added absorber 2 is produced by the heating of absorber D1. The heating temperature of the new added absorber 2 is higher than the one of absorber D1. Consequently, we achieve the two stages improving of residual heat temperature. And we get the two-stage high temperature second-type absorption heat pump based on the single stage second-type absorption heat pump.

Figure 2:
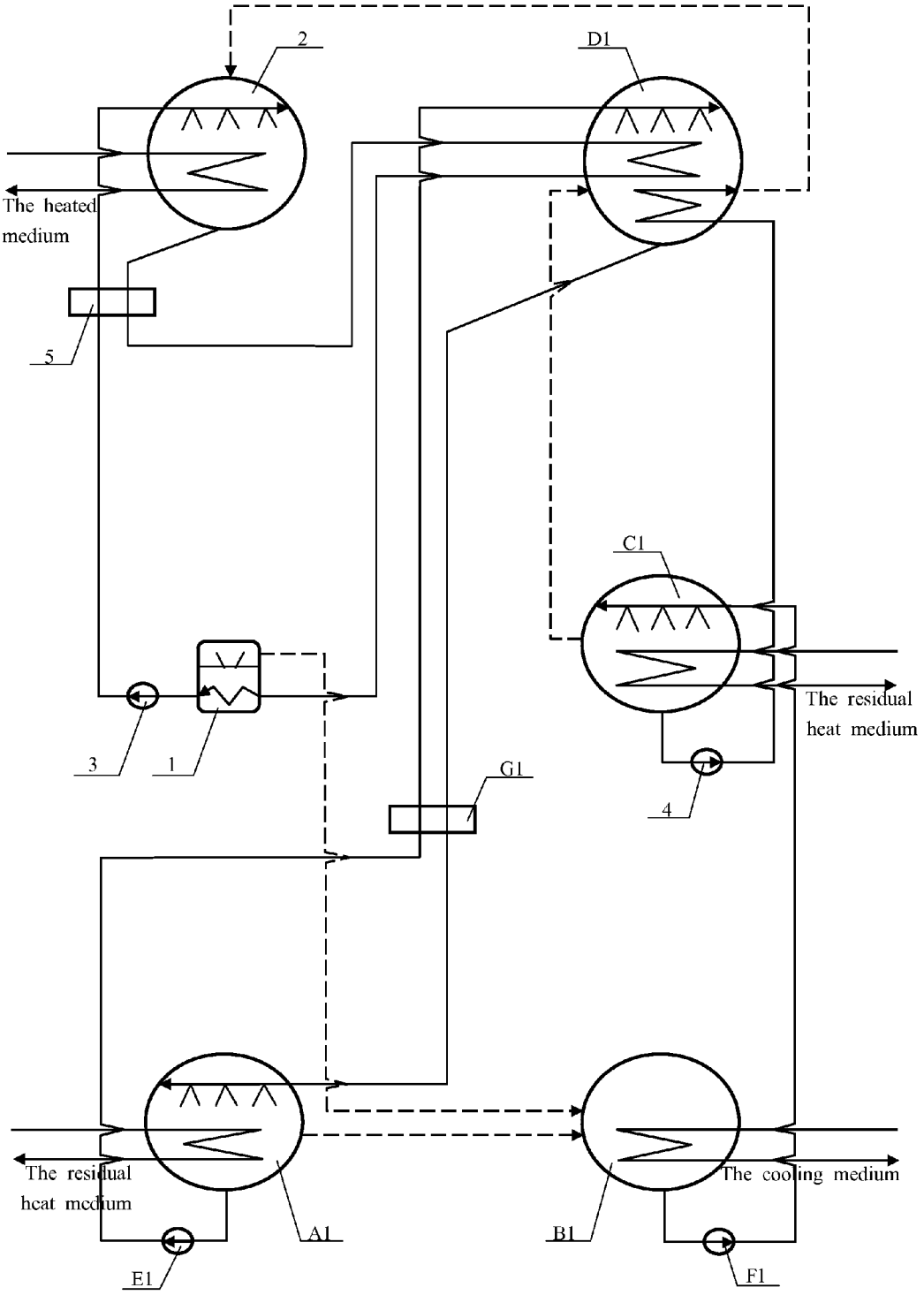
FIG. 2 is the structure and flow diagram of the two-stage high temperature second-type absorption heat pump which adopts the solution independent cycle and is based on the single stage second-type absorption heat pump.

The two-stage high temperature second-type absorption heat pump shown in FIG. 2, based on the single stage second-type absorption heat pump, can be realized by the following way:

Firstly, structurally, we add the new added steam bleeding chamber 1, the new added absorber 2, the new added liquid refrigerant pump 4, the new added solution pump 3, the new added solution heat exchanger 5 on the single stage second-type absorption heat pump which comprises generator, condenser, evaporator, absorber, solution pump, liquid refrigerant pump and solution heat exchanger. In the single stage second-type absorption heat pump, generator A1 has the concentrated solution pipe which passes through solution pump E1 and solution heat exchanger G1 and then connects absorber D1. Absorber D1 has the dilute solution pipe which passes through solution heat exchanger G1 and then connects generator A1. Generator A1 has the refrigerant vapor channel connected condenser B1. Condenser B1 has the liquid refrigerant pipe which passes through liquid refrigerant pump F1 and then connects evaporator C1. Evaporator C1 has the refrigerant vapor channel connected absorber D1. Generator A1 and evaporator C1 have the residual heat medium pipe connected external. Condenser B1 has the cooling medium pipe connected external. Absorber D1 has the heated medium pipe connected external.

We adopt the solution independent cycle as follows. The new added steam bleeding chamber 1 has the concentrated solution pipe that passes through the new added solution pump 3, the new added solution heat exchanger 5 and then connects the new added absorber 2. The new added absorber 2 has the dilute solution pipe which passes through the new added solution heat exchanger 5, absorber D1 and then connects the new added steam bleeding chamber 1. We change that absorber D1 have the residual heat medium pipe connected external to that absorber D1 has the refrigerant vapor pipe connected the new added absorber 2 after that evaporator C1 adds the liquid refrigerant pipe which passes through the new added liquid refrigerant pump 4 and then connects absorber D1. The new added steam bleeding chamber 1 has the refrigerant vapor channel connected condenser B1. The new added absorber 2 have the residual heat medium pipe connected external.

Secondly, on the process, the process to form the high temperature heating-side is as following. In the single second-type absorption heat pump which comprises generator, condenser, evaporator, absorber, liquid refrigerant pump and solution heat exchanger, the heating load is formed in absorber D1 and can be divided into two parts. One part of the heating load heats up the solution which flows through the new added solution heat exchanger 5, absorber D1 form the new added absorber 2. The solution is vaporization and then enters the new added steam bleeding chamber 1. The other part heats up the liquid refrigerant which flows through the new added liquid refrigerant pump 4, absorber D1 form evaporator C1. And the liquid refrigerant becomes refrigerant vapor provided to the new added absorber 2.

After that the vapor phase and liquid phase of the solution which enters the new added steam bleeding chamber 1 is separated, the refrigerant vapor enters condenser B1 while the concentrated solution flows through the new added solution pump 3, the new added solution heat exchanger 5 and then connects the new added absorber 2. Then the concentrated solution in absorber 2 absorbs the refrigerant vapor came from absorber D1 and provides the high temperature heating load to the heated medium. The refrigerant vapor, which enters condenser B1 from the new added steam bleeding chamber 1, releases heat to the cooling medium and becomes liquid refrigerant.

After that the liquid refrigerant flows through liquid refrigerant pump F1, the new added liquid refrigerant pump 4 and absorber D1 where it absorbs heat and becomes refrigerant vapor with high temperature entered the new added absorber 2. The solution concentration which enters the new added absorber 2 from the new added steam bleeding chamber 1 is higher than the one which enters absorber D1 from generator A1. The temperature of refrigerant vapor which enters the new added absorber 2 from absorber D1 is higher than the one which enters absorber D1 from evaporator C1. Consequently, the exothermic temperature of the new added absorber 2 is much higher than the one of absorber D1.

Figure 3:
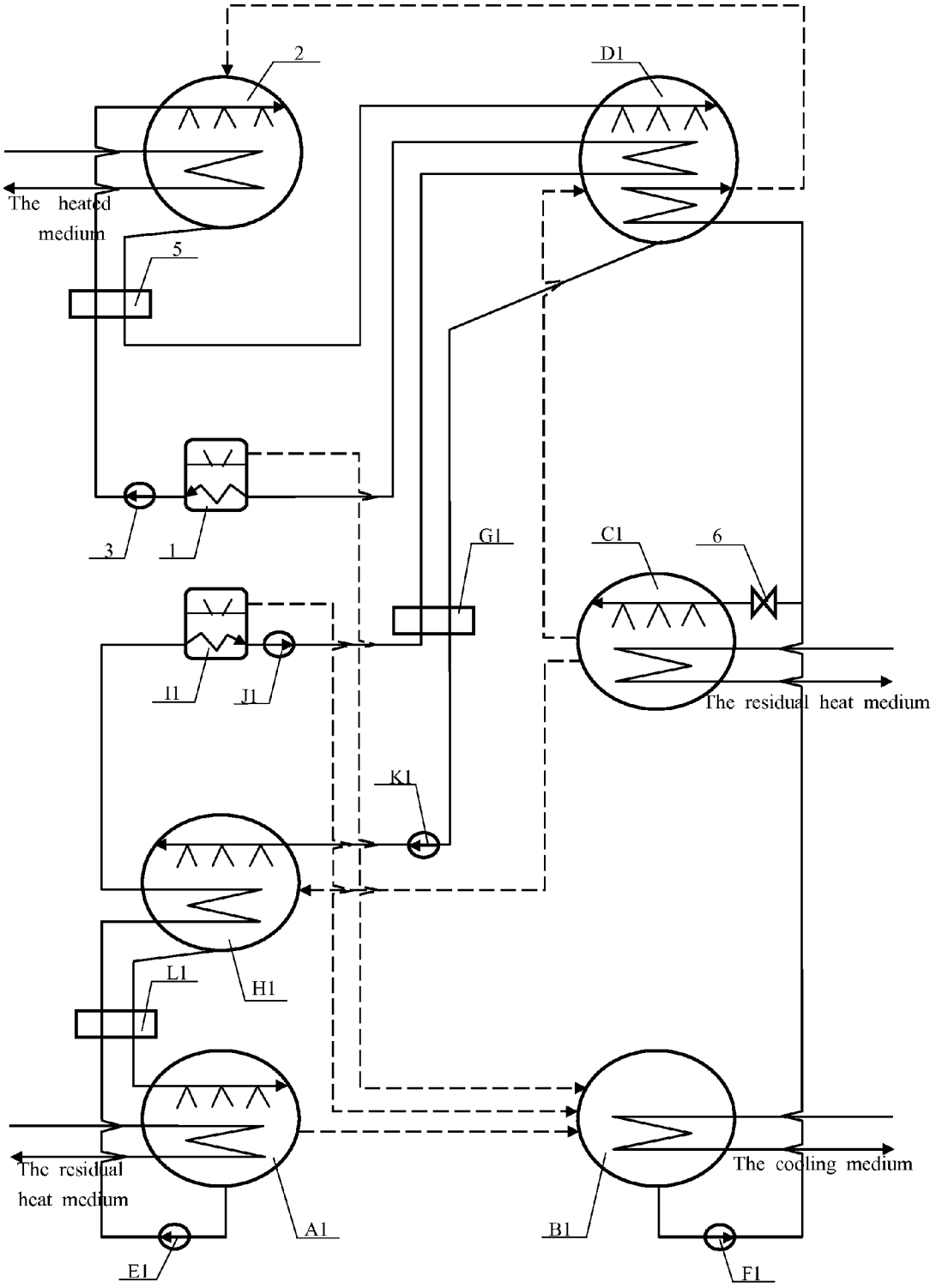
FIG. 3 is the structure and flow diagram of the two-stage high temperature second-type absorption heat pump which adopts the solution tandem cycle and is based on the recuperative single stage second-type absorption heat pump.

The two-stage high temperature second-type absorption heat pump shown in FIG. 3, based on the recuperative single stage second-type absorption heat pump, can be realized by the following way:

Firstly, structurally, we add the new added steam bleeding chamber 1, the new added absorber 2, the new added throttle 6, the new added solution pump 3, the new added solution heat exchanger 5 on the single stage second-type absorption heat pump which comprises generator, condenser, evaporator, the first absorber, the second absorber, the first solution pump, liquid refrigerant pump, the steam bleeding chamber, the second solution pump, the third solution pump, the first solution heat exchanger and the second solution heat exchanger.

In the recuperative single stage second-type absorption heat pump, generator A1 has the concentrated solution pipe which passes through the first solution pump E1, the second solution heat exchanger L1, the second absorber H1 and then connects the steam bleeding chamber I1. The steam bleeding chamber I1 has the concentrated solution pipe which passes through the second solution pump J1, the first solution heat exchanger G1 and then connects the first absorber D1. The first absorber D1 has the dilute solution pipe which passes through the first solution heat exchanger G1, the third solution pump K1 and then connects the second absorber H1. The second absorber H1 has the dilute solution pipe which passes through the second solution heat exchanger L1 and then connects generator A1. Generator A1 and evaporator C1 separately have the refrigerant vapor channel connected condenser B1. Condenser B1 has the liquid refrigerant pipe which passes through liquid refrigerant pump F1 and then connects evaporator C1. Evaporator C1 has the refrigerant vapor channel which separately connects the first absorber D1 and the second absorber H1. Generator A1 and evaporator C1 have the residual heat medium pipe connected external. Condenser B1 has the cooling medium pipe connected external. The first absorber D1 has the heated medium pipe connected external.

We adopt the solution tandem cycle as follows. We change that the steam bleeding chamber I1 has the concentrated solution pipe which passes through the second solution pump J1, the first solution heat exchanger G1 and then connects the first absorber D1 to that the steam bleeding chamber I1 has the concentrated solution pipe which passes through the second solution pump J1, the first solution heat exchanger G1, the first absorber D1 and then connects the new added steam bleeding chamber 1. The new added steam bleeding chamber 1 has the concentrated solution pipe that passes through the new added solution pump 3, the new added solution heat exchanger 5 and then connects the new added absorber 2. The new added absorber 2 has the dilute solution pipe which passes through the new added solution heat exchanger 5 and then connects the first absorber D1. We change that the first absorber D1 has the residual heat medium pipe connected external to that the first absorber D1 has the refrigerant vapor pipe connected the new added absorber 2 after that condenser B1 has the liquid refrigerant pipe which passes through liquid refrigerant pump F1 and then connects the first absorber D1. We change that condenser B1 has the liquid refrigerant pipe which passes through liquid refrigerant pump F1 and then connects evaporator C1 to that condenser B1 has the liquid refrigerant pipe which passes through liquid refrigerant pump F1, the new added throttle 6 and then connects evaporator C1.

Secondly, on the process, the process to form the high temperature heating-side is as following. In the recuperative single second-type absorption heat pump which comprises generator, condenser, evaporator, the first absorber, the second absorber, the first solution pump, liquid refrigerant pump, the steam bleeding chamber, the second solution pump, the third solution pump, the first solution heat exchanger and the second solution heat exchanger, the heating load is formed in absorber D1 and can be divided into two parts. One part of the heating load heats up the solution which flows through the second solution pump J1, absorber D1 form the steam bleeding chamber I1. The solution is vaporization and then enters the new added steam bleeding chamber 1. The other part heats up the liquid refrigerant which flows through liquid refrigerant pump F1, absorber D1 form condenser B1. And the liquid refrigerant becomes refrigerant vapor provided to the new added absorber 2.

After that the vapor phase and liquid phase of the solution which enters the new added steam bleeding chamber 1 is separated, the refrigerant vapor enters condenser B1 while the concentrated solution flows through the new added solution pump 3, the new added solution heat exchanger 5 and then connects the new added absorber 2. Then the concentrated solution in absorber 2 absorbs the refrigerant vapor came from absorber D1 and provides the high temperature heating load to the heated medium. The refrigerant vapor, which enters condenser B1 from the new added steam bleeding chamber 1, releases heat to the cooling medium and becomes liquid refrigerant. After that the liquid refrigerant flows through liquid refrigerant pump F1 and absorber D1 where it absorbs heat and becomes refrigerant vapor with high temperature entered the new added absorber 2.

Figure 4:
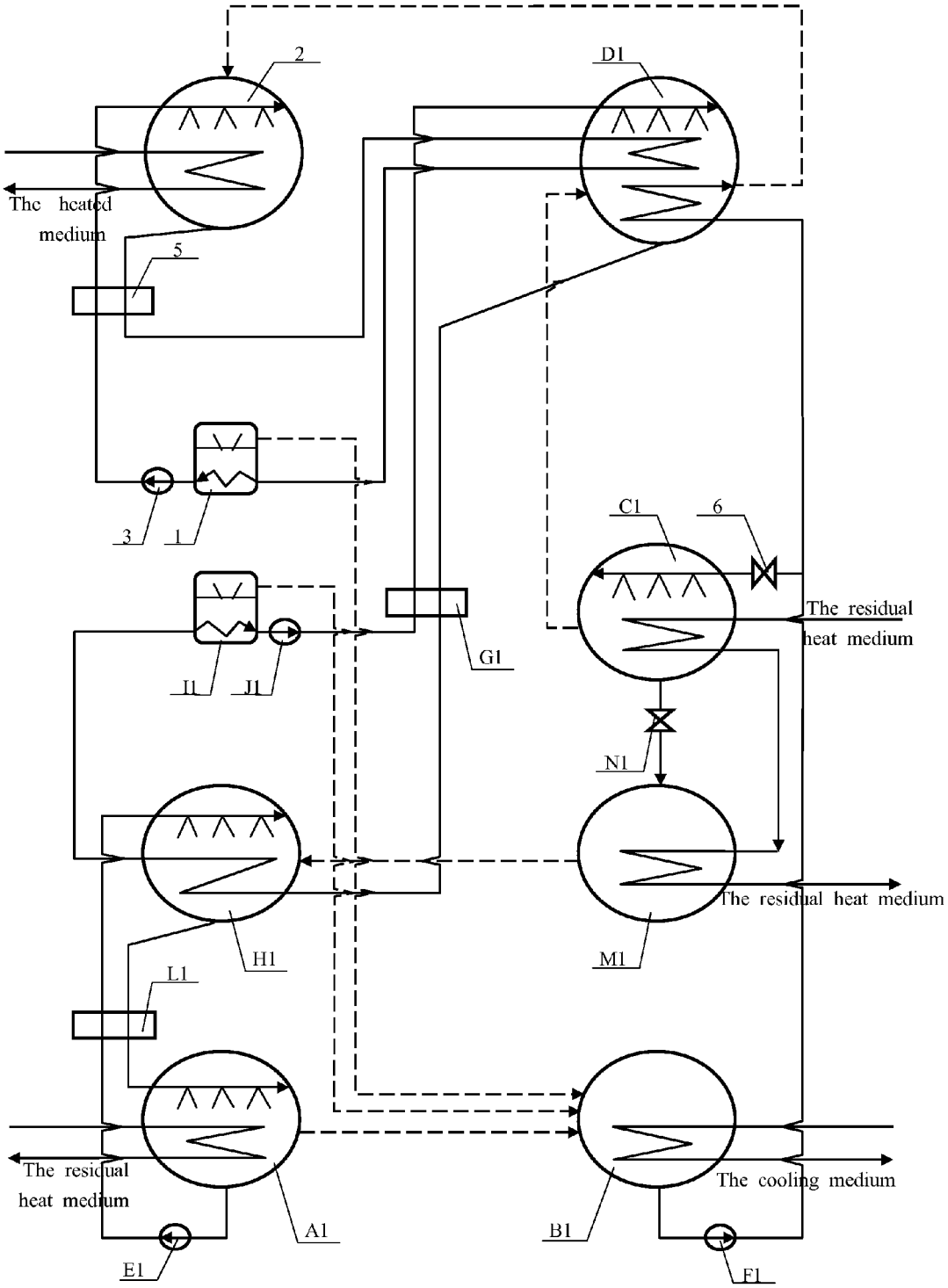
FIG. 4 is the structure and flow diagram of the two-stage high temperature second-type absorption heat pump which adopts the solution independent cycle and is based on the recuperative single stage second-type absorption heat pump.

The two-stage high temperature second-type absorption heat pump shown in FIG. 4, based on the recuperative single stage second-type absorption heat pump, can be realized by the following way:

Firstly, structurally, we add the new added steam bleeding chamber 1, the new added absorber 2, the new added throttle 6, the new added solution pump 3, the new added solution heat exchanger 5 on the single stage second-type absorption heat pump which comprises generator, condenser, the first evaporator, the second evaporator, the first absorber, the first solution pump, liquid refrigerant pump, the second absorber, the steam bleeding chamber, the second solution pump, throttle, the first solution heat exchanger and the second solution heat exchanger.

In the recuperative single stage second-type absorption heat pump, generator A1 has the concentrated solution pipe which passes through the first solution pump E1, the second solution heat exchanger L1 and then connects the second absorber H1. The second absorber H1 has the dilute solution pipe which passes through the second solution heat exchanger L1 and then connects generator A1. The steam bleeding chamber I1 has the concentrated solution pipe which passes through the second solution pump J1, the first solution heat exchanger G1 and then connects the first absorber D1. The first absorber D1 has the dilute solution pipe which passes through the first solution heat exchanger G1, the second absorber H1 and then connects the steam bleeding chamber I1.

Generator A1 and the steam bleeding chamber I1 separately have the refrigerant vapor channel connected condenser B1. Condenser B1 has the liquid refrigerant pipe which passes through liquid refrigerant pump F1 and then connects the first evaporator C1. The first evaporator C1 has the liquid refrigerant pipe which passes through throttle N1, the second evaporator M1. The first evaporator C1 has the refrigerant vapor channel connected the first absorber D1. The second evaporator M1 has the refrigerant vapor channel connected the second absorber H1. Generator A1, the first evaporator C1 and the second evaporator M1 have the residual heat medium pipe connected external. Condenser B1 has the cooling medium pipe connected external. The first absorber D1 has the heated medium pipe connected external.

We adopt the solution independent cycle as follows. The new added steam bleeding chamber 1 has the concentrated solution pipe that passes through the new added solution pump 3, the new added solution heat exchanger 5 and then connects the new added absorber 2. The new added absorber 2 has the dilute solution pipe which passes through the new added solution heat exchanger 5, the first absorber D1 and then connects the new added steam bleeding chamber 1. We change that the first absorber D1 has the residual heat medium pipe connected external to that the first absorber D1 has the refrigerant vapor pipe connected the new added absorber 2 after that condenser B1 has the liquid refrigerant pipe which passes through liquid refrigerant pump F1 and then connects the first absorber D1. At the same time, we change that condenser B1 has the liquid refrigerant pipe which passes through liquid refrigerant pump F1 and then connects the first evaporator C1 to that condenser B1 has the liquid refrigerant pipe which passes through liquid refrigerant pump F1, the new added throttle 6 and then connects the first evaporator C1. The new added steam bleeding chamber 1 have the refrigerant vapor channel connected condenser B1. The new added absorber 2 has the heated medium pipe connected external.

Secondly, on the process, the process to form the high temperature heating-side is as following. In the recuperative single second-type absorption heat pump which comprises generator, condenser, the first evaporator, the second evaporator, the first absorber, the first solution pump, liquid refrigerant pump, the second absorber, the steam bleeding chamber, the second solution pump, throttle, the first solution heat exchanger and the second solution heat exchanger, the heating load is formed in absorber D1 and can be divided into two parts. One part of the heating load heats up the solution which flows through the new added solution heat exchanger 5, absorber D1 form the new added absorber 2. The solution is vaporization and then enters the new added steam bleeding chamber 1. The other part heats up the liquid refrigerant which flows through liquid refrigerant pump F1, absorber D1 form condenser B1. And the liquid refrigerant becomes refrigerant vapor provided to the new added absorber 2.

After that the vapor phase and liquid phase of the solution which enters the new added steam bleeding chamber 1 is separated, the refrigerant vapor enters condenser B1 while the concentrated solution flows through the new added solution pump 3, the new added solution heat exchanger 5 and then connects the new added absorber 2. Then the concentrated solution in absorber 2 absorbs the refrigerant vapor came from absorber D1 and provides the high temperature heating load to the heated medium. The refrigerant vapor, which enters condenser B1 from the new added steam bleeding chamber 1, releases heat to the cooling medium and becomes liquid refrigerant. After that the liquid refrigerant flows through liquid refrigerant pump F1 and absorber D1 where it absorbs heat and becomes refrigerant vapor with high temperature entered the new added absorber 2.

Figure 5:
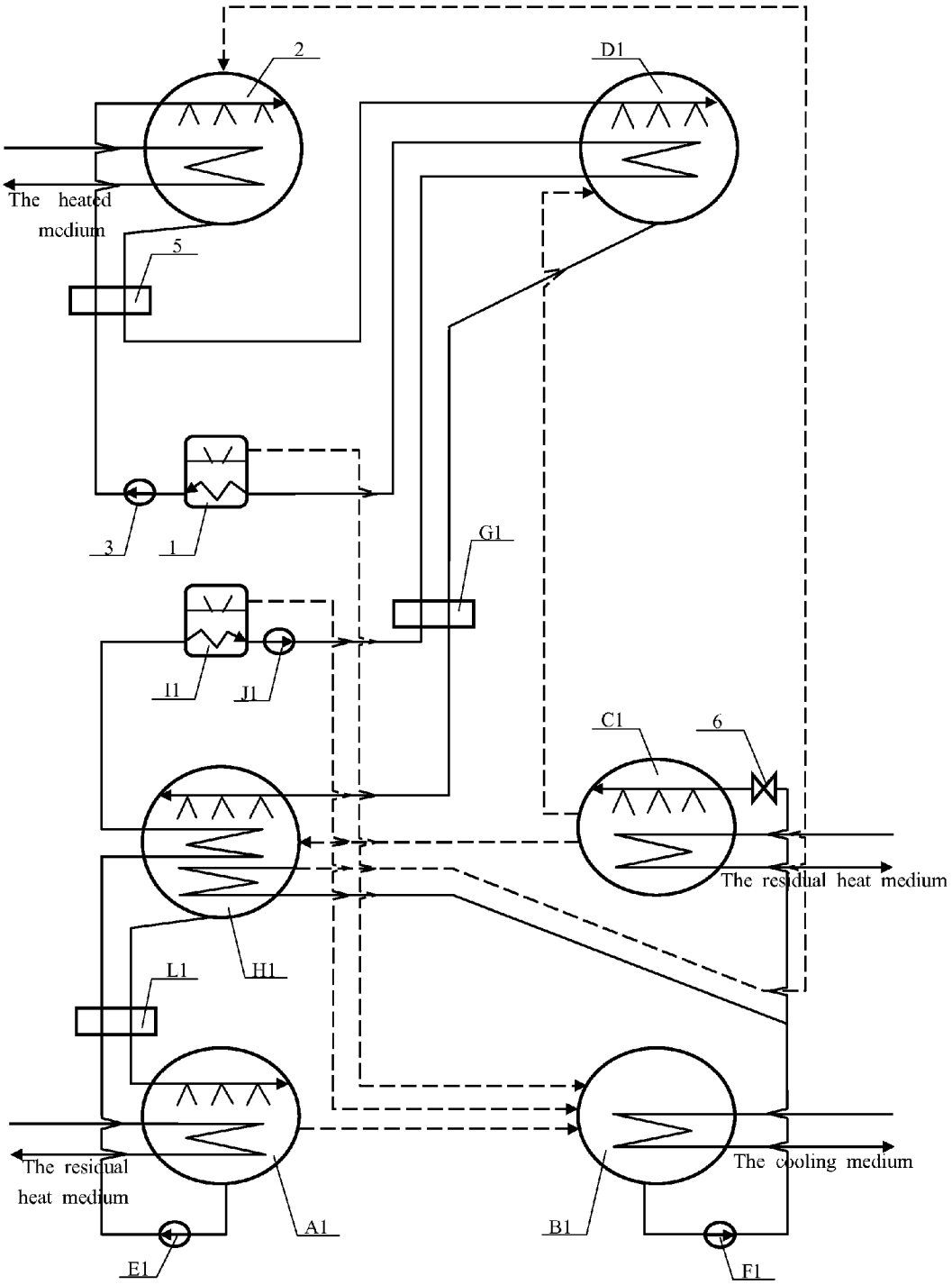
FIG. 5 is the structure and flow diagram of the two-stage high temperature second-type absorption heat pump which adopts the solution tandem cycle and is based on the recuperative single stage second-type absorption heat pump too.

The two-stage high temperature second-type absorption heat pump shown in FIG. 5, based on the recuperative single stage second-type absorption heat pump, can be realized by the following way:

In the two-stage high temperature second-type absorption heat pump shown in FIG. 3, based on the recuperative single stage second-type absorption heat pump, we adjust that the first absorber D1 has the refrigerant vapor channel connected the new added absorber 2 after that condenser B1 has liquid refrigerant pipe which passes through liquid refrigerant pump F1 and then connects the first absorber D1 to that the second absorber H1 has the refrigerant vapor channel connected the new added absorber 2 after that condenser B1 has liquid refrigerant pipe which passes through liquid refrigerant pump F1 and then connects the second absorber H1.

The recuperative single stage double-effect second-type absorption heat pump completes the improving of residual heat temperature for the first time. The second absorber H1 heats up the liquid refrigerant which flows through it and the liquid refrigerant becomes refrigerant vapor provided to the new added absorber 2. The first absorber D1 heats up the solution which flows through it and is provided to the new added steam bleeding chamber 1. The refrigerant vapor produced by the new added steam bleeding chamber 1 enters condenser C2 while the concentrated solution enters the new added absorber 2. Then the concentrated solution absorbs the refrigerant vapor came from the second absorber H1 and provides the high temperature heating load to the heated medium. Consequently, we get the two-stage high temperature second-type absorption heat pump based on the recuperative single stage double-effect second-type absorption heat pump.

Figure 6:
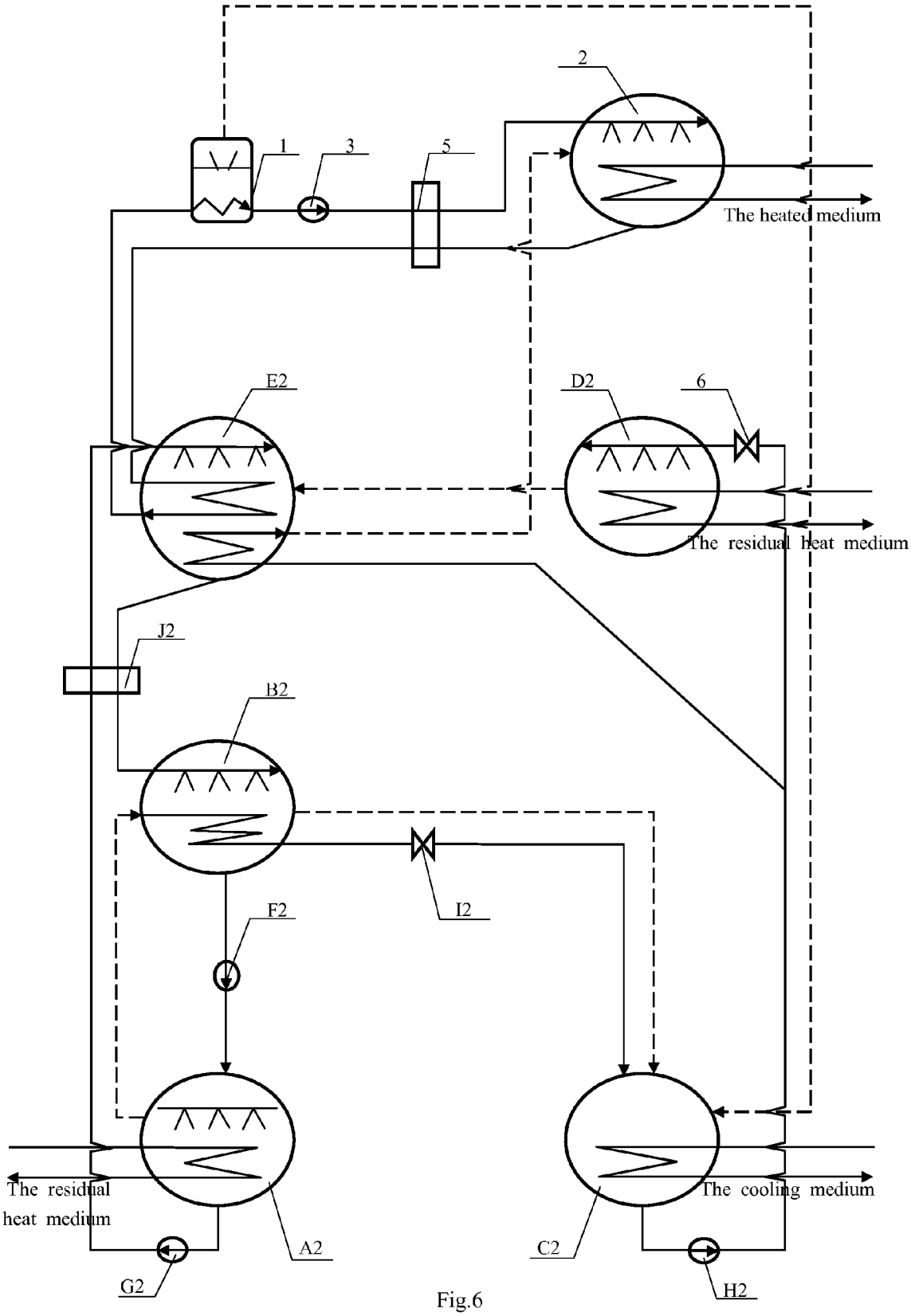
FIG. 6 is the structure and flow diagram of the two-stage high temperature second-type absorption heat pump which adopts the solution independent cycle and is based on the single stage tandem double-effect second-type absorption heat pump.

The two-stage high temperature second-type absorption heat pump shown in FIG. 6, based on the single stage tandem double-effect second-type absorption heat pump, can be realized by the following way:

Firstly, structurally, we add the new added steam bleeding chamber 1, the new added absorber 2, the new added throttle 6, the new added solution pump 3, the new added solution heat exchanger 5 on the single stage tandem double-effect second-type absorption heat pump which comprises high pressure generator A2, low pressure generator B2, condenser C2, evaporator D2, absorber E2, the first solution pump F2, the second solution pump G2, liquid refrigerant pump H2, throttle I2, solution heat exchanger J2.

In the single stage tandem double-effect second-type absorption heat pump, high pressure generator A2 has the concentrated solution pipe which passes through the second solution pump G2, solution heat exchanger J2 and then connects absorber E2. Low pressure generator B2 has the concentrated solution pipe which passes through the first solution pump F2 and then connects high pressure generator A2. After that high pressure generator A2 has the refrigerant vapor channel connected low pressure generator B2, low pressure generator B2 has the liquid refrigerant pipe which passes through throttle I2 and then connects condenser C2. Low pressure generator B2 has the refrigerant vapor channel connected condenser C2. Condenser C2 has the liquid refrigerant pipe which passes through liquid refrigerant pump H2 and then connects evaporator D2. Evaporator D2 has the refrigerant vapor channel connected absorber E2. High pressure generator A2 and evaporator D2 has the residual heat medium pipe connected external. Condenser C2 has the cooling medium pipe connected external. Absorber E2 has the heated medium pipe connected external.

We adopt the solution independent cycle as follows. The new added steam bleeding chamber 1 has the concentrated solution pipe that passes through the new added solution pump 3, the new added solution heat exchanger 5 and then connects the new added absorber 2. The new added absorber 2 has the dilute solution pipe which passes through the new added solution heat exchanger 5, absorber E2 and then connects the new added steam bleeding chamber 1. We change that absorber E2 has the heated medium pipe connected external to that absorber E2 has the refrigerant vapor pipe connected the new added absorber 2 after that condenser C2 has the liquid refrigerant pipe which passes through liquid refrigerant pump H2 and then connects absorber E2. We change that condenser C2 has the liquid refrigerant pipe which passes through liquid refrigerant pump H2 and then connects evaporator D2 to that condenser C2 has the liquid refrigerant pipe which passes through liquid refrigerant pump H2, the new added throttle 6 and then connects evaporator D2.

Secondly, on the process, the process to form the high temperature heating-side is as following. In the single stage tandem double-effect second-type absorption heat pump which comprises high pressure generator A2, low pressure generator B2, condenser C2, evaporator D2, absorber E2, the first solution pump F2, the second solution pump G2, liquid refrigerant pump H2, throttle I2, solution heat exchanger J2, the heating load is formed in absorber E2 and can be divided into two parts. One part of the heating load heats up the solution which flows through the new added solution heat exchanger 5, absorber E2 form the new added absorber 2. The solution is vaporization and then enters the new added steam bleeding chamber 1. The other part heats up the liquid refrigerant which flows through liquid refrigerant pump H2, absorber E2 form condenser C2. And the liquid refrigerant becomes refrigerant vapor provided to the new added absorber 2.

After that the vapor phase and liquid phase of the solution which enters the new added steam bleeding chamber 1 is separated, the refrigerant vapor enters condenser C2 while the concentrated solution flows through the new added solution pump 3, the new added solution heat exchanger 5 and then connects the new added absorber 2. Then the concentrated solution in absorber 2 absorbs the refrigerant vapor came from absorber E2 and provides the high temperature heating load to the heated medium. The refrigerant vapor, which enters condenser C2 from the new added steam bleeding chamber 1, releases heat to the cooling medium and becomes liquid refrigerant. After that the liquid refrigerant flows through liquid refrigerant pump H2 and absorber E2 where it absorbs heat and becomes refrigerant vapor with high temperature entered the new added absorber 2.

Figure 7:
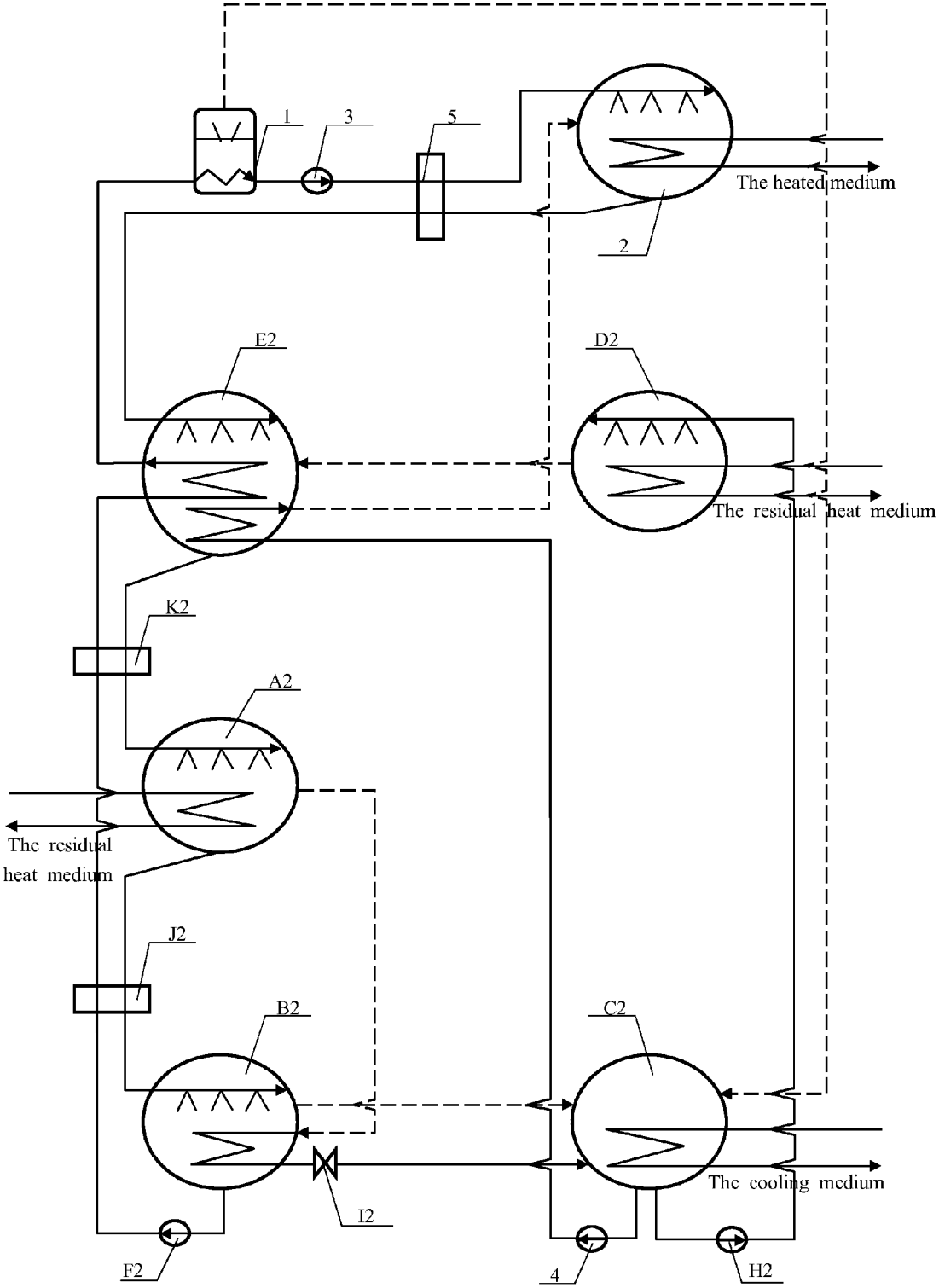
FIG. 7 is the structure and flow diagram of the two-stage high temperature second-type absorption heat pump which adopts the solution tandem cycle and is based on the single stage tandem double-effect second-type absorption heat pump.

The two-stage high temperature second-type absorption heat pump shown in FIG. 7, based on the single stage tandem double-effect second-type absorption heat pump, can be realized by the following way:

Firstly, structurally, we add the new added steam bleeding chamber 1, the new added absorber 2, the new added liquid refrigerant pump 4, the new added solution pump 3, the new added solution heat exchanger 5 on the single stage tandem double-effect second-type absorption heat pump which comprises high pressure generator A2, low pressure generator B2, condenser C2, evaporator D2, absorber E2, solution pump F2, liquid refrigerant pump H2, throttle I2, the first solution heat exchanger J2 and the second solution heat exchanger K2.

In the single stage tandem double-effect second-type absorption heat pump, high pressure generator A2 has the concentrated solution pipe which passes through the first solution heat exchanger J2 and then connects low pressure generator B2. Low pressure generator B2 has the concentrated solution pipe which passes through the first solution heat exchanger J2 and the second solution heat exchanger K2 and then connects absorber E2. Absorber E2 has the liquid refrigerant pipe which passes through the second solution heat exchanger K2 and then connects high pressure generator A2. After that high pressure generator A2 has the refrigerant vapor channel connected low pressure generator B2, low pressure generator B2 has the liquid refrigerant pipe which passes through throttle I2 and then connects condenser C2. Condenser C2 has the liquid refrigerant pipe which passes through liquid refrigerant pump H2 and then connects evaporator D2. Evaporator D2 has the refrigerant vapor channel connected absorber E2. High pressure generator A2 and evaporator D2 has the residual heat medium pipe connected external. Condenser C2 has the cooling medium pipe connected external. Absorber E2 has the heated medium pipe connected external.

We adopt the solution tandem cycle as follows. We adjust that low pressure generator B2 has the concentrated solution pipe which passes through solution pump F2, the first solution heat exchanger J2, the second solution heat exchanger K2 and then connects absorber E2 to that low pressure generator B2 has the concentrated solution pipe which passes through solution pump F2, the first solution heat exchanger J2, the second solution heat exchanger K2, absorber E2 and then connects the new added steam bleeding chamber 1. The new added steam bleeding chamber 1 has the concentrated solution pipe that passes through the new added solution pump 3, the new added solution heat exchanger 5 and then connects the new added absorber 2. The new added absorber 2 has the dilute solution pipe which passes through the new added solution heat exchanger 5 and then connects absorber E2. We change that absorber E2 has the heated medium pipe connected external to that absorber E2 has the refrigerant vapor pipe connected the new added absorber 2 after that condenser C2 has the liquid refrigerant pipe which passes through the new added liquid refrigerant pump 4 and then connects absorber E2. The new added steam bleeding chamber 1 has the refrigerant vapor channel connected condenser C2. The new added absorber 2 has the heated medium pipe connected external.

Secondly, on the process, the process to form the high temperature heating-side is as following. In the single stage tandem double-effect second-type absorption heat pump which comprises high pressure generator A2, low pressure generator B2, condenser C2, evaporator D2, absorber E2, solution pump F2, liquid refrigerant pump H2, throttle I2, the first solution heat exchanger J2 and the second solution heat exchanger K2, the heating load is formed in absorber E2 and can be divided into two parts. One part of the heating load heats up the solution which flows through solution pump F2, the first solution heat exchanger J2 and the second solution heat exchanger K2 form low pressure generator B2. The solution is vaporization and enters the new added steam bleeding chamber 1. The other part heats up the liquid refrigerant which flows through the new added liquid refrigerant pump 4, absorber E2 form condenser C2. And the liquid refrigerant becomes refrigerant vapor provided to the new added absorber 2.

The concentrated solution in absorber 2 absorbs the refrigerant vapor came from absorber E2 and provides the high temperature heating load to the heated medium. The dilute solution of the new added absorber 2 flows through the new added solution heat exchanger 5 and then enters absorber E2. The refrigerant vapor, which enters condenser C2 from the new added steam bleeding chamber 1, releases heat to the cooling medium and becomes liquid refrigerant. After that the liquid refrigerant flows through the new added liquid refrigerant pump 4 and absorber E2 where it absorbs heat and becomes refrigerant vapor with high temperature entered the new added absorber 2.

Figure 8:
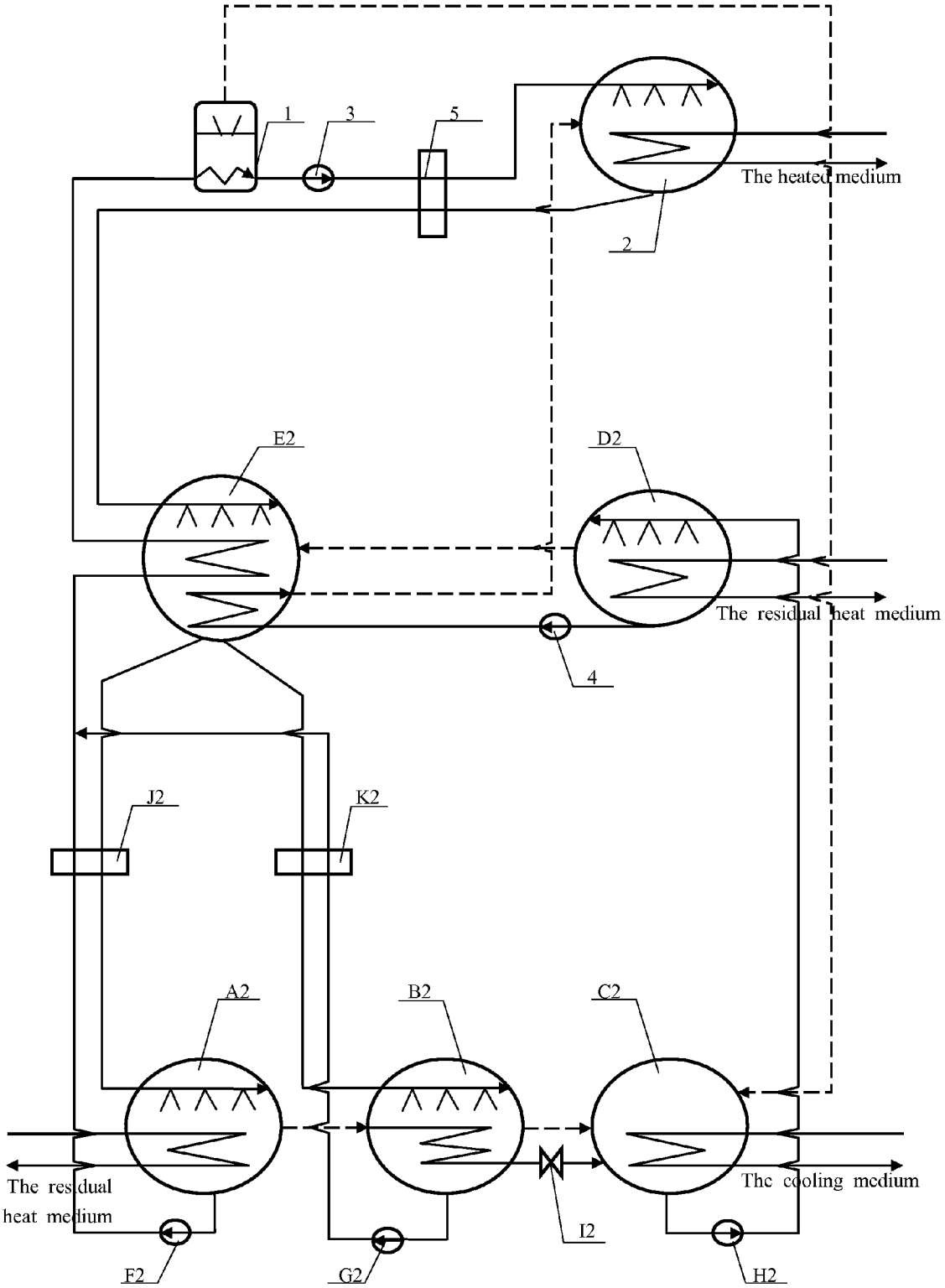
FIG. 8 is the structure and flow diagram of the two-stage high temperature second-type absorption heat pump which adopts the solution tandem cycle and is based on the single stage parallel double-effect second-type absorption heat pump.

The two-stage high temperature second-type absorption heat pump shown in FIG. 8, based on the single stage parallel double-effect second-type absorption heat pump, can be realized by the following way:

Firstly, structurally, we add the new added steam bleeding chamber 1, the new added absorber 2, the new added liquid refrigerant pump 4, the new added solution pump 3, the new added solution heat exchanger 5 on the single stage parallel double-effect second-type absorption heat pump which comprises high pressure generator A2, low pressure generator B2, condenser C2, evaporator D2, absorber E2, the first solution pump F2, the second solution pump G2, liquid refrigerant pump H2, throttle I2, the first solution heat exchanger J2 and the second solution heat exchanger K2.

In the single stage parallel double-effect second-type absorption heat pump, high pressure generator A2 has the concentrated solution pipe which passes through the first solution pump F2, the first solution heat exchanger J2 and then connects absorber E2. Absorber E2 has the dilute solution pipe which passes through the first solution heat exchanger J2 and then connects high pressure generator A2. Low pressure generator B2 has the concentrated solution pipe which passes through the second solution pump G2, the second solution heat exchanger K2 and then connects absorber E2. Absorber E2 has the dilute solution pipe which passes through the second solution heat exchanger K2 and then connects low pressure generator B2. After that high pressure generator A2 has the refrigerant vapor channel connected low pressure generator B2, low pressure generator B2 has the liquid refrigerant pipe which passes through throttle I2 and then connects condenser C2. Low pressure generator B2 has the refrigerant vapor channel connected condenser C2. Condenser C2 has the liquid refrigerant pipe which passes through liquid refrigerant pump H2 and then connects evaporator D2. Evaporator D2 has the refrigerant vapor channel connected absorber E2. High pressure generator A2 and evaporator D2 has the residual heat medium pipe connected external. Condenser C2 has the cooling medium pipe connected external. Absorber E2 has the heated medium pipe connected external.

We adopt the solution tandem cycle as follows. We adjust that high pressure generator A2 has the concentrated solution pipe which passes through solution pump F2, the first solution heat exchanger J2, and then connects absorber E2 and that low pressure generator B2 has the concentrated solution pipe which passes through the second solution pump G2, the second solution heat exchanger K2 and then connects absorber E2 to that absorber E2 connects the new added steam bleeding chamber after that the concentrated solution pipe, which passes through the first solution pump F2, the first solution heat exchanger J2 from high pressure generator A2, joins with the concentrated solution pipe which passes through the second solution pump G2, the second solution heat exchanger K2 from low pressure generator B2.

The new added steam bleeding chamber 1 has the concentrated solution pipe that passes through the new added solution pump 3, the new added solution heat exchanger 5 and then connects the new added absorber 2. The new added absorber 2 has the dilute solution pipe which passes through the new added solution heat exchanger 5 and then connects absorber E2. We change that absorber E2 has the heated medium pipe connected external to that absorber E2 has the refrigerant vapor pipe connected the new added absorber 2 after that condenser C2 has the liquid refrigerant pipe which passes through the new added liquid refrigerant pump 4 and then connects absorber E2. The new added steam bleeding chamber 1 has the refrigerant vapor channel connected condenser C2. The new added absorber 2 has the heated medium pipe connected external.

Secondly, on the process, the process to form the high temperature heating-side is as following. In the single stage parallel double-effect second-type absorption heat pump which comprises high pressure generator A2, low pressure generator B2, condenser C2, evaporator D2, absorber E2, the first solution pump F2, the second solution pump G2, liquid refrigerant pump H2, throttle I2, the first solution heat exchanger J2 and the second solution heat exchanger K2, the heating load is formed in absorber E2 and can be divided into two parts. One part of the heating load heats up the solution which flows through solution pump F2, the first solution heat exchanger J2, absorber E2 from high pressure generator A2 and heats up the solution which flows through the second solution pump G2, the second solution heat exchanger K2, absorber E2 form low pressure generator B2 too. The solution is vaporization and enters the new added steam bleeding chamber 1. The other part heats up the liquid refrigerant which flows through the new added liquid refrigerant pump 4, absorber E2 form evaporator D2. And the liquid refrigerant becomes refrigerant vapor provided to the new added absorber 2.

After that the vapor phase and liquid phase of the solution which enters the new added steam bleeding chamber 1 is separated, the refrigerant vapor enters condenser C2 while the concentrated solution flows through the new added solution pump 3, the new added solution heat exchanger 5 and then connects the new added absorber 2. The concentrated solution in absorber 2 absorbs the refrigerant vapor came from absorber E2 and provides the high temperature heating load to the heated medium. The dilute solution of the new added absorber 2 flows through the new added solution heat exchanger 5 and then enters absorber E2. The refrigerant vapor, which enters condenser C2 from the new added steam bleeding chamber 1, releases heat to the cooling medium and becomes liquid refrigerant. After that the liquid refrigerant flows through liquid refrigerant pump H2, the new added liquid refrigerant pump 4 and absorber E2 where it absorbs heat and becomes refrigerant vapor with high temperature entered the new added absorber 2.

Figure 9:
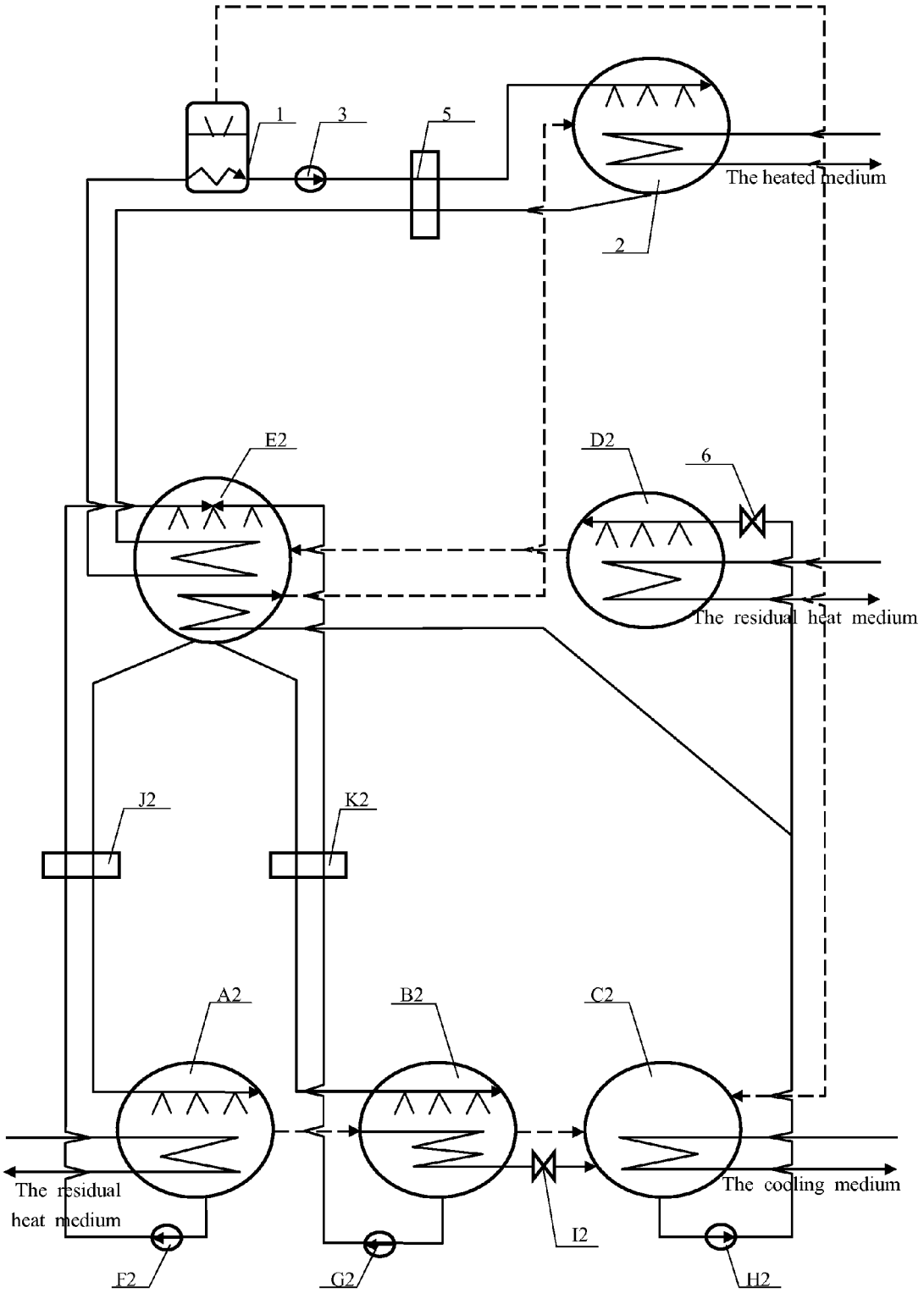
FIG. 9 is the structure and flow diagram of the two-stage high temperature second-type absorption heat pump which adopts the solution independent cycle and is based on the single stage parallel double-effect second-type absorption heat pump.

The two-stage high temperature second-type absorption heat pump shown in FIG. 9, based on the single stage parallel double-effect second-type absorption heat pump, can be realized by the following way:

Firstly, structurally, we add the new added steam bleeding chamber 1, the new added absorber 2, the new added throttle 6, the new added solution pump 3, the new added solution heat exchanger 5 on the single stage parallel double-effect second-type absorption heat pump which is mentioned in FIG. 8 and comprises high pressure generator A2, low pressure generator B2, condenser C2, evaporator D2, absorber E2, the first solution pump F2, the second solution pump G2, liquid refrigerant pump H2, throttle I2, the first solution heat exchanger J2 and the second solution heat exchanger K2.

We adopt the solution independent cycle as follows. The new added steam bleeding chamber 1 has the concentrated solution pipe that passes through the new added solution pump 3, the new added solution heat exchanger 5 and then connects the new added absorber 2. The new added absorber 2 has the dilute solution pipe which passes through the new added solution heat exchanger 5, absorber E2 and then connects the new added steam bleeding chamber 1. We change that absorber E2 has the heated medium pipe connected external to that absorber E2 has the refrigerant vapor pipe connected the new added absorber 2 after that evaporator D2 has the liquid refrigerant pipe which passes through liquid refrigerant pump H2 and then connects absorber E2. And we change that condenser C2 has the liquid refrigerant pipe which passes through liquid refrigerant pump H2 and then connects evaporator D2 to that condenser C2 has the liquid refrigerant pipe which passes through liquid refrigerant pump H2, the new added throttle 6 and then connects evaporator D2. The new added steam bleeding chamber 1 has the refrigerant vapor channel connected condenser C2. The new added absorber 2 has the heated medium pipe connected external.

Secondly, on the process, the process to form the high temperature heating-side is as following. In the single stage parallel double-effect second-type absorption heat pump which comprises high pressure generator A2, low pressure generator B2, condenser C2, evaporator D2, absorber E2, the first solution pump F2, the second solution pump G2, liquid refrigerant pump H2, throttle I2, the first solution heat exchanger J2 and the second solution heat exchanger K2, the heating load is formed in absorber E2 and can be divided into two parts. One part of the heating load heats up the solution which flows through the new added solution heat exchanger 5, absorber E2 from the new added absorber 2. The solution is vaporization and enters the new added steam bleeding chamber 1. The other part heats up the liquid refrigerant which flows through liquid refrigerant pump H2, absorber E2 form condenser C2. And the liquid refrigerant becomes refrigerant vapor provided to the new added absorber 2.

After that the vapor phase and liquid phase of the solution which enters the new added steam bleeding chamber 1 is separated, the refrigerant vapor enters condenser C2 while the concentrated solution flows through the new added solution pump 3, the new added solution heat exchanger 5 and then connects the new added absorber 2. The concentrated solution in absorber 2 absorbs the refrigerant vapor came from absorber E2 and provides the high temperature heating load to the heated medium. The refrigerant vapor, which enters condenser C2 from the new added steam bleeding chamber 1, releases heat to the cooling medium and becomes liquid refrigerant. After that the liquid refrigerant flows through liquid refrigerant pump H2 and absorber E2 where it absorbs heat and becomes refrigerant vapor with high temperature entered the new added absorber 2.

Figure 10:
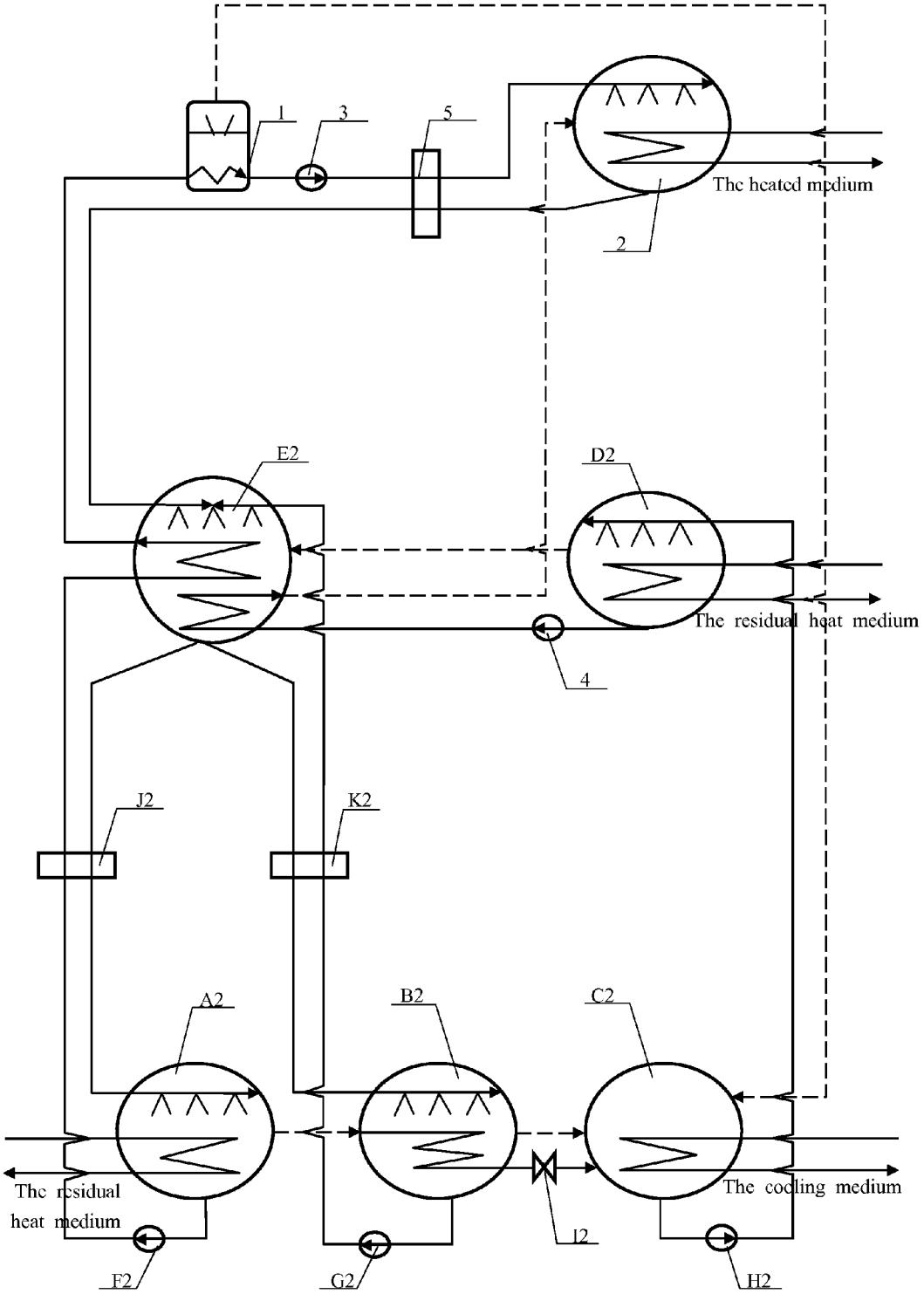
FIG. 10 is the structure and flow diagram of the two-stage high temperature second-type absorption heat pump which adopts the solution tandem cycle and is based on the single stage parallel double-effect second-type absorption heat pump too.

The two-stage high temperature second-type absorption heat pump shown in FIG. 10, based on the single stage parallel double-effect second-type absorption heat pump, can be realized by the following way:

Firstly, structurally, we add the new added steam bleeding chamber 1, the new added absorber 2, the new added liquid refrigerant pump 4, the new added solution pump 3, the new added solution heat exchanger 5 on the single stage parallel double-effect second-type absorption heat pump which is mentioned in FIG. 8 and comprises high pressure generator A2, low pressure generator B2, condenser C2, evaporator D2, absorber E2, the first solution pump F2, the second solution pump G2, liquid refrigerant pump H2, throttle I2, the first solution heat exchanger J2 and the second solution heat exchanger K2.

We adopt the solution tandem cycle as follows. We adjust that high pressure generator A2 has the concentrated solution pipe which passes through the first solution pump F2, the first solution heat exchanger J2 and then connects absorber E2 to that high pressure generator A2 has the concentrated solution pipe which passes through the first solution pump F2, the first solution heat exchanger J2, absorber E2 and then connects the new added steam bleeding chamber 1. The new added steam bleeding chamber 1 has the concentrated solution pipe that passes through the new added solution pump 3, the new added solution heat exchanger 5 and then connects the new added absorber 2. The new added absorber 2 has the dilute solution pipe which passes through the new added solution heat exchanger 5 and then connects absorber E2. We change that absorber E2 has the heated medium pipe connected external to that absorber E2 has the refrigerant vapor pipe connected the new added absorber 2 after that evaporator D2 has the liquid refrigerant pipe which passes through the new added liquid refrigerant pump 4 and then connects absorber E2. The new added steam bleeding chamber 1 has the refrigerant vapor channel connected condenser C2. The new added absorber 2 has the heated medium pipe connected external.

Secondly, on the process, the process to form the high temperature heating-side is as following. In the single stage parallel double-effect second-type absorption heat pump which comprises high pressure generator A2, low pressure generator B2, condenser C2, evaporator D2, absorber E2, the first solution pump F2, the second solution pump G2, liquid refrigerant pump H2, throttle I2, the first solution heat exchanger J2 and the second solution heat exchanger K2, the heating load is formed in absorber E2 and can be divided into two parts. One part of the heating load heats up the solution which flows through solution pump F2, the first solution heat exchanger J2, absorber E2 from high pressure generator A2. The solution is vaporization and enters the new added steam bleeding chamber 1. The other part heats up the liquid refrigerant which flows through the new added liquid refrigerant pump 4, absorber E2 form evaporator D2. And the liquid refrigerant becomes refrigerant vapor provided to the new added absorber 2.

After that the vapor phase and liquid phase of the solution which enters the new added steam bleeding chamber 1 is separated, the refrigerant vapor enters condenser C2 while the concentrated solution flows through the new added solution pump 3, the new added solution heat exchanger 5 and then connects the new added absorber 2. The concentrated solution in absorber 2 absorbs the refrigerant vapor came from absorber E2 and provides the high temperature heating load to the heated medium. The dilute solution of the new added absorber 2 flows through the new added solution heat exchanger 5 and then enters absorber E2. The refrigerant vapor, which enters condenser C2 from the new added steam bleeding chamber 1, releases heat to the cooling medium and becomes liquid refrigerant. After that the liquid refrigerant flows through liquid refrigerant pump H2, the new added liquid refrigerant pump 4 and absorber E2 where it absorbs heat and becomes refrigerant vapor with high temperature entered the new added absorber 2.

Figure 11:
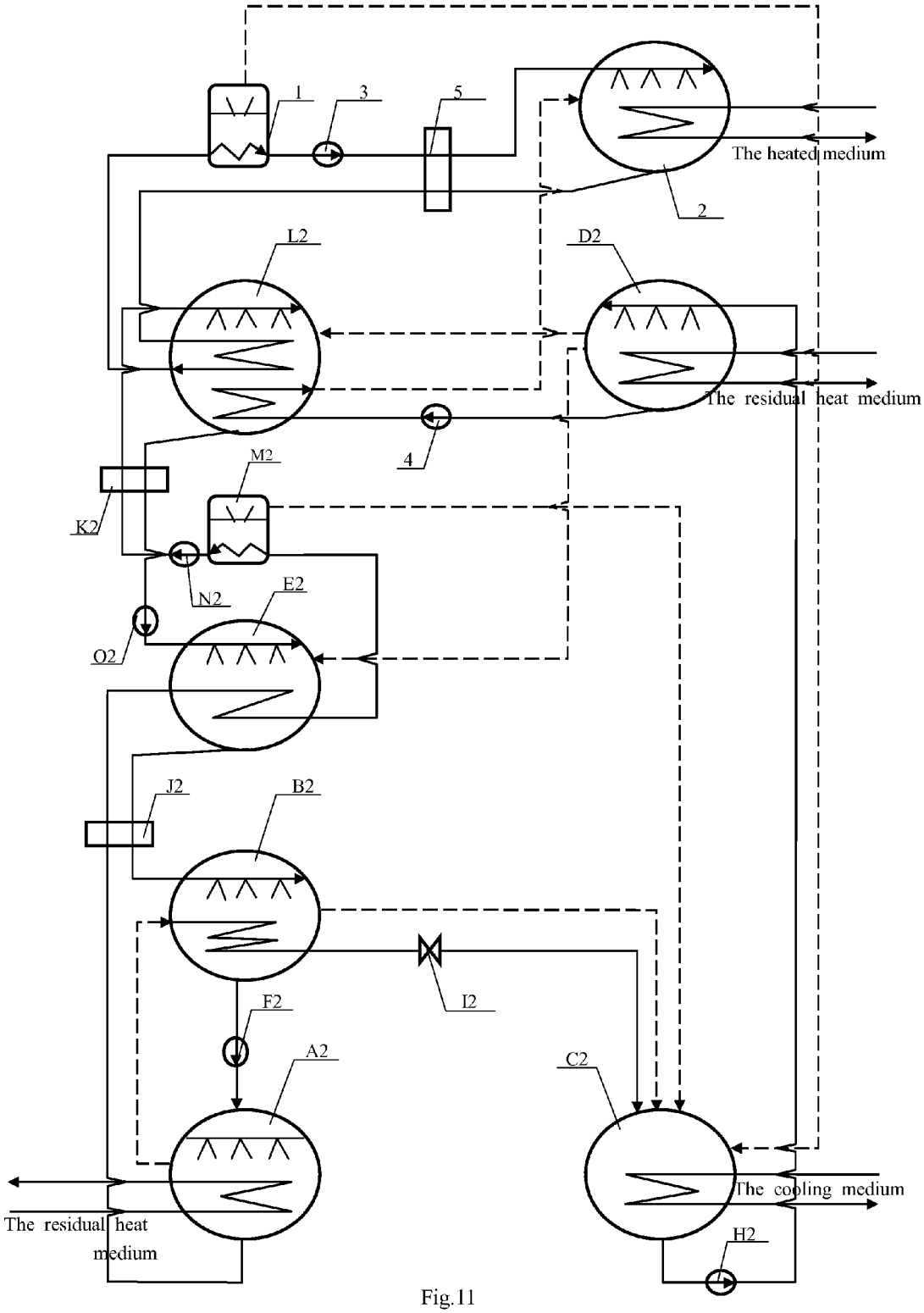
FIG. 11 is the structure and flow diagram of the two-stage high temperature second-type absorption heat pump which adopts the solution independent cycle and is based on the recuperative single stage tandem double-effect second-type absorption heat pump.

The two-stage high temperature second-type absorption heat pump shown in FIG. 11, based on the recuperative single stage tandem double-effect second-type absorption heat pump, can be realized by the following way:

Firstly, structurally, according to the method expounded in claim 2, we add the new added steam bleeding chamber 1, the new added absorber 2, the new added liquid refrigerant pump 4, the new added solution pump 3, the new added solution heat exchanger 5 on the single stage tandem double-effect second-type absorption heat pump which can be achieved by adding the second solution heat exchanger K2, the second absorber L2, the steam bleeding chamber M2, the third solution pump N2 and the fourth solution pump O2 on the single stage tandem double-effect absorption heat pump. The single stage tandem double-effect absorption heat pump, which is mentioned in FIG. 6, comprises high pressure generator A2, low pressure generator B2, condenser C2, evaporator D2, the first absorber E2, the first solution pump F2, the second solution pump G2, liquid refrigerant pump H2, throttle I2, solution heat exchanger J2.

In the recuperative single stage tandem double-effect second-type absorption heat pump, we cancel the second solution pump G2. We adjust that high pressure generator A2 has the concentrated solution pipe which passes through the second solution pump G2, the first solution heat exchanger J2 and then connects absorber E2 to that high pressure generator A2 has the concentrated solution pipe which passes through the second solution pump G2, the first solution heat exchanger J2, absorber E2 and then connects the steam bleeding chamber M2. The steam bleeding chamber M2 has the concentrated solution pipe which passes through the third solution pump N2, the second solution heat exchanger K2 and then connects the second absorber L2. The second absorber L2 has the dilute solution pipe which passes through the second solution heat exchanger K2 and the fourth solution pump O2 and then connects absorber E2. The steam bleeding chamber M2 has refrigerant vapor channel connected condenser C2. Evaporator D2 has refrigerant vapor channel connected the second absorber L2. The second absorber L2 has the heated medium pipe connected external. We cancel that absorber E2 has the heated medium pipe connected external.

We adopt the solution tandem cycle as following. The new added steam bleeding chamber 1 has the concentrated solution pipe which passes through the new added solution pump 3 and the new added solution heat exchanger 5 and then connects the new added absorber 2. The new added absorber 2 has the dilute solution pipe which passes through the new added solution heat exchanger 5, the second absorber L2 and then connects the new added steam bleeding chamber 1. We change that the second absorber L2 has the heated medium pipe connected external to that the second absorber L2 has refrigerant vapor channel connected the new added absorber 2 after that evaporator D2 add the liquid refrigerant pipe which passes through the new added liquid refrigerant pump 4 and then connects the second absorber L2. The new added steam bleeding chamber 1 has refrigerant vapor channel connected condenser C2. The new added absorber 2 has the heated medium pipe connected external.

Secondly, on the process, the process to form the high temperature heating-side is as following. In the single stage tandem double-effect second-type absorption heat pump, the heating load is formed in the second absorber L2 and can be divided into two parts. One part of the heating load heats up the solution which flows through the new added solution heat exchanger 5, the second absorber L2 from the new added absorber 2. The solution is vaporization and enters the new added steam bleeding chamber 1. The other part heats up the liquid refrigerant which flows through the new added liquid refrigerant pump 4 and the second absorber L2 form evaporator D2. And the liquid refrigerant becomes refrigerant vapor provided to the new added absorber 2.

After that the vapor phase and liquid phase of the solution which enters the new added steam bleeding chamber 1 is separated, the refrigerant vapor enters condenser C2 while the concentrated solution flows through the new added solution pump 3, the new added solution heat exchanger 5 and then connects the new added absorber 2. The concentrated solution in absorber 2 absorbs the refrigerant vapor came from the second absorber L2 and provides the high temperature heating load to the heated medium. The refrigerant vapor, which enters condenser C2 from the new added steam bleeding chamber 1, releases heat to the cooling medium and becomes liquid refrigerant. After that the liquid refrigerant flows through liquid refrigerant pump H2, the new added liquid refrigerant pump 4 and the second absorber L2 where it absorbs heat and becomes refrigerant vapor with high temperature entered the new added absorber 2.

Figure 12:
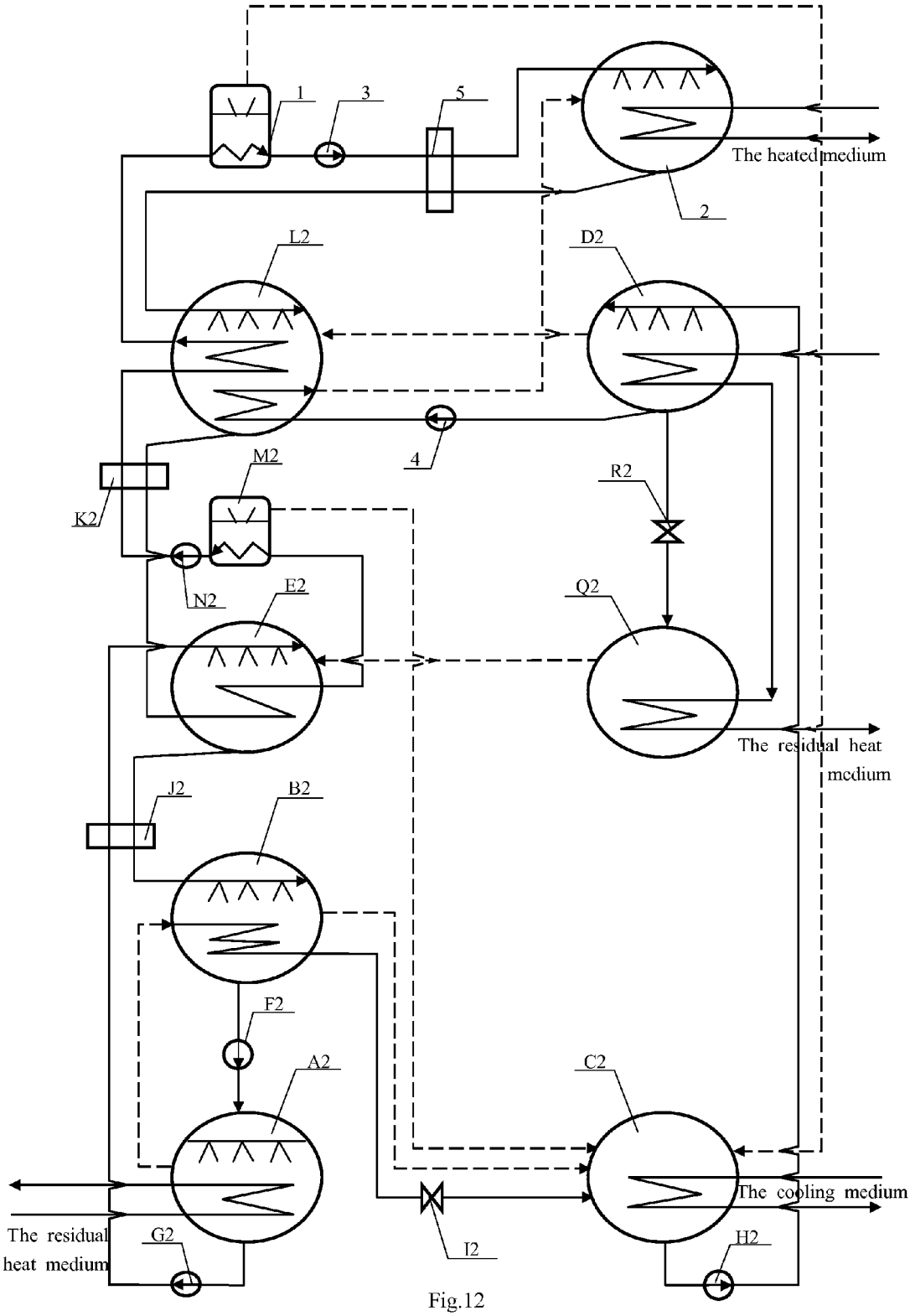
FIG. 12 is the structure and flow diagram of the two-stage high temperature second-type absorption heat pump which adopts the solution tandem cycle and is based on the recuperative single stage tandem double-effect second-type absorption heat pump.

The two-stage high temperature second-type absorption heat pump shown in FIG. 12, based on the recuperative single stage tandem double-effect second-type absorption heat pump, can be realized by the following way:

Firstly, structurally, according to the method expounded in claim 1, we add the new added steam bleeding chamber 1, the new added absorber 2, the new added liquid refrigerant pump 4, the new added solution pump 3, the new added solution heat exchanger 5 on the single stage tandem double-effect second-type absorption heat pump which can be achieved by adding the second solution heat exchanger K2, the second absorber L2, the steam bleeding chamber M2, the third solution pump N2, the second evaporator Q2 and the second throttle R2 on the single stage tandem double-effect absorption heat pump. The single stage tandem double-effect absorption heat pump, which is mentioned in FIG. 6, comprises high pressure generator A2, low pressure generator B2, condenser C2, evaporator D2, the first absorber E2, the first solution pump F2, the second solution pump G2, liquid refrigerant pump H2, throttle I2, solution heat exchanger J2.

In the recuperative single stage tandem double-effect second-type absorption heat pump, the steam bleeding chamber M2 has the concentrated solution pipe which passes through the third solution pump N2, the second solution heat exchanger K2 and then connects the second absorber L2. The second absorber L2 has the dilute solution pipe which passes through the second solution heat exchanger K2, the first absorber E2 and then connects the steam bleeding chamber M2. The steam bleeding chamber M2 has refrigerant vapor channel connected condenser C2. Evaporator D2 has refrigerant vapor channel which passes through the second throttle R2 and then connects the second evaporator Q2. The second evaporator Q2 has refrigerant vapor channel connected the second absorber L2. The second absorber L2 has the heated medium pipe connected external. We cancel that absorber E2 has the heated medium pipe connected external.

We adopt the solution tandem cycle as following. We change that the steam bleeding chamber M2 has the concentrated solution pipe which passes through the third solution pump N2, the second solution heat exchanger K2 and then connects the second absorber L2 to that the steam bleeding chamber M2 has the concentrated solution pipe which passes through the third solution pump N2, the second solution heat exchanger K2, the second absorber L2 and then connects the new added steam bleeding chamber 1. The new added steam bleeding chamber 1 has the concentrated solution pipe which passes through the new added solution pump 3 and the new added solution heat exchanger 5 and then connects the new added absorber 2. The new added absorber 2 has the dilute solution pipe which passes through the new added solution heat exchanger 5 and then connects the second absorber L2.

We change that the second absorber L2 has the heated medium pipe connected external to that the second absorber L2 has refrigerant vapor channel connected the new added absorber 2 after that the first evaporator D2 add the liquid refrigerant pipe which passes through the new added liquid refrigerant pump 4 and then connects the second absorber L2. The new added steam bleeding chamber 1 has refrigerant vapor channel connected condenser C2. The new added absorber 2 has the heated medium pipe connected external.

Secondly, on the process, the process to form the high temperature heating-side is as following. In the single stage tandem double-effect second-type absorption heat pump, the heating load is formed in the second absorber L2 and can be divided into two parts. One part of the heating load heats up the solution which flows through the third solution pump N2, the second solution heat exchanger K2, the second absorber L2 from the steam bleeding chamber M2. The solution is vaporization and enters the new added steam bleeding chamber 1. The other part heats up the liquid refrigerant which flows through the new added liquid refrigerant pump 4 and the second absorber L2 form evaporator D2. And the liquid refrigerant becomes refrigerant vapor provided to the new added absorber 2.

After that the vapor phase and liquid phase of the solution which enters the new added steam bleeding chamber 1 is separated, the refrigerant vapor enters condenser C2 while the concentrated solution flows through the new added solution pump 3, the new added solution heat exchanger 5 and then connects the new added absorber 2. The concentrated solution in absorber 2 absorbs the refrigerant vapor came from the second absorber L2 and provides the high temperature heating load to the heated medium. The dilute solution of the new added absorber 2 flows through the new added solution heat exchanger 5 and then enters the second absorber L2. The refrigerant vapor, which enters condenser C2 from the new added steam bleeding chamber 1, releases heat to the cooling medium and becomes liquid refrigerant. After that the liquid refrigerant flows through liquid refrigerant pump H2, the new added liquid refrigerant pump 4 and the second absorber L2 where it absorbs heat and becomes refrigerant vapor with high temperature entered the new added absorber 2.

Figure 13:
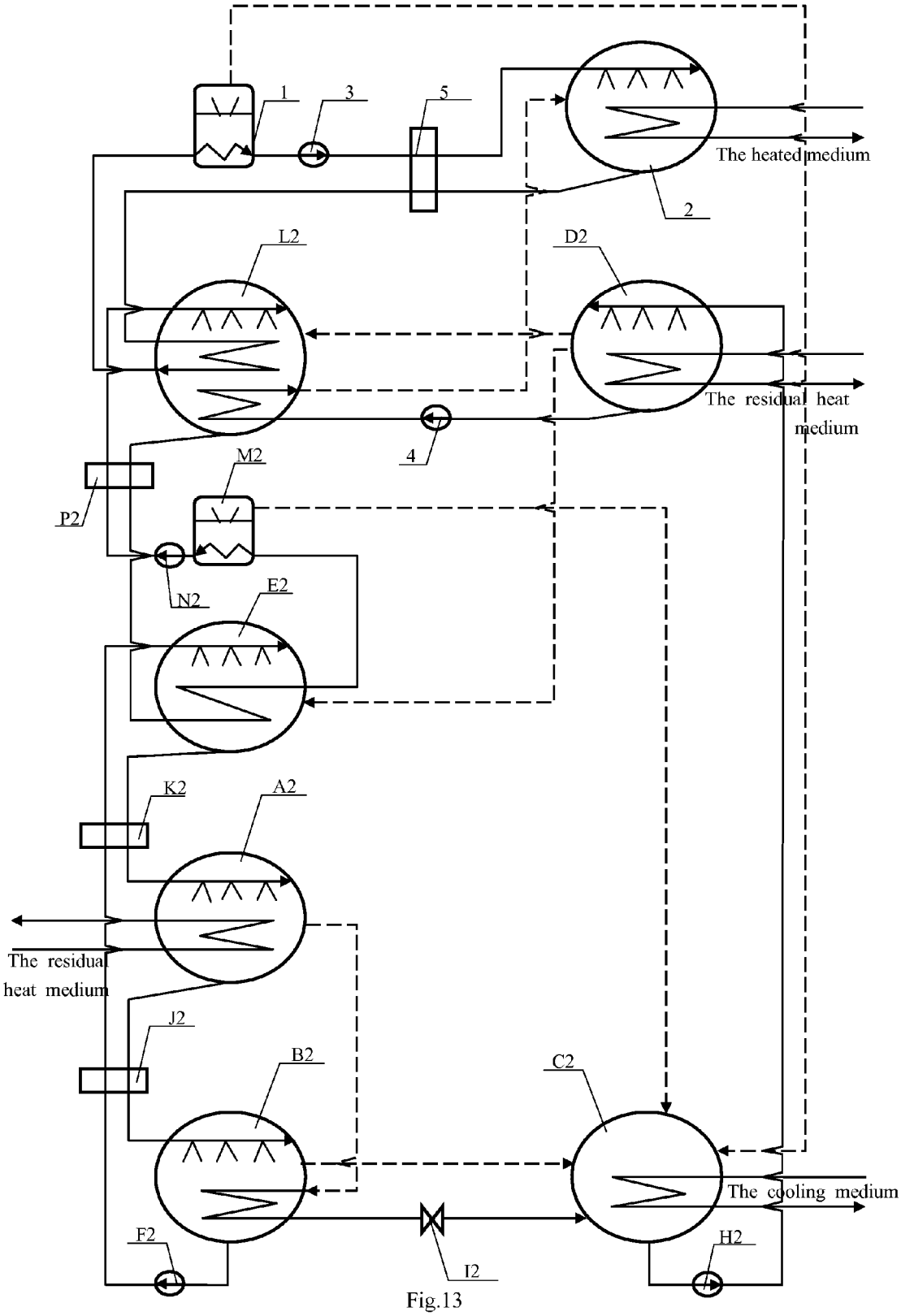
FIG. 13 is the structure and flow diagram of the two-stage high temperature second-type absorption heat pump which adopts the solution independent cycle and is based on the recuperative single stage tandem double-effect second-type absorption heat pump.

The two-stage high temperature second-type absorption heat pump shown in FIG. 13, based on the recuperative single stage tandem double-effect second-type absorption heat pump, can be realized by the following way:

Firstly, structurally, according to the method expounded in claim 2, we add the new added steam bleeding chamber 1, the new added absorber 2, the new added liquid refrigerant pump 4, the new added solution pump 3, the new added solution heat exchanger 5 on the single stage tandem double-effect second-type absorption heat pump which can be achieved by adding the third solution heat exchanger P2, the second absorber L2, the steam bleeding chamber M2, the third solution pump N2 on the single stage tandem double-effect absorption heat pump. The single stage tandem double-effect absorption heat pump, which is mentioned in FIG. 7, comprises high pressure generator A2, low pressure generator B2, condenser C2, evaporator D2, absorber E2, solution pump F2, liquid refrigerant pump H2, throttle I2, the first solution heat exchanger J2 and the second solution heat exchanger K2.

In the recuperative single stage tandem double-effect second-type absorption heat pump, the steam bleeding chamber M2 has the concentrated solution pipe which passes through the third solution pump N2, the third solution heat exchanger P2 and then connects the second absorber L2. The second absorber L2 has the dilute solution pipe which passes through the third solution heat exchanger P2, the first absorber E2 and then connects the steam bleeding chamber M2. The steam bleeding chamber M2 has refrigerant vapor channel connected condenser C2. Evaporator D2 has refrigerant vapor channel connected the second absorber L2. The second absorber L2 has the heated medium pipe connected external. We cancel that absorber E2 has the heated medium pipe connected external.

We adopt the solution independent cycle as following. The new added steam bleeding chamber 1 has the concentrated solution pipe which passes through the new added solution pump 3 and the new added solution heat exchanger 5 and then connects the new added absorber 2. The new added absorber 2 has the dilute solution pipe which passes through the new added solution heat exchanger 5, the second absorber L2 and then connects the new added steam bleeding chamber 1.

We change that the second absorber L2 has the heated medium pipe connected external to that the second absorber L2 has refrigerant vapor channel connected the new added absorber 2 after that evaporator D2 add the liquid refrigerant pipe which passes through the new added liquid refrigerant pump 4 and then connects the second absorber L2. The new added steam bleeding chamber 1 has refrigerant vapor channel connected condenser C2. The new added absorber 2 has the heated medium pipe connected external.

Secondly, on the process, the process to form the high temperature heating-side is as following. In the single stage tandem double-effect second-type absorption heat pump, the heating load is formed in the second absorber L2 and can be divided into two parts. One part of the heating load heats up the solution which flows through the new added solution heat exchanger 5, absorber E2 from the new added absorber 2. The solution is vaporization and enters the new added steam bleeding chamber 1. The other part heats up the liquid refrigerant which flows through the new added liquid refrigerant pump 4 and the second absorber L2 form evaporator D2. And the liquid refrigerant becomes refrigerant vapor provided to the new added absorber 2.

After that the vapor phase and liquid phase of the solution which enters the new added steam bleeding chamber 1 is separated, the refrigerant vapor enters condenser C2 while the concentrated solution flows through the new added solution pump 3, the new added solution heat exchanger 5 and then connects the new added absorber 2. The concentrated solution in absorber 2 absorbs the refrigerant vapor came from the second absorber L2 and provides the high temperature heating load to the heated medium. The refrigerant vapor, which enters condenser C2 from the new added steam bleeding chamber 1, releases heat to the cooling medium and becomes liquid refrigerant. After that the liquid refrigerant flows through liquid refrigerant pump H2, the new added liquid refrigerant pump 4 and the second absorber L2 where it absorbs heat and becomes refrigerant vapor with high temperature entered the new added absorber 2.

The two-stage high temperature second-type absorption heat pump shown in FIG. 14, based on the recuperative single stage tandem double-effect second-type absorption heat pump, can be realized by the following way:

Firstly, structurally, according to the method expounded in claim 1, we add the new added steam bleeding chamber 1, the new added absorber 2, the new added liquid refrigerant pump 4, the new added solution pump 3, the new added solution heat exchanger 5 on the single stage tandem double-effect second-type absorption heat pump which can be achieved by adding the third solution heat exchanger P2, the second absorber L2, the steam bleeding chamber M2, the third solution pump N2, the second evaporator Q2 and the second throttle R2 on the single stage tandem double-effect absorption heat pump. The single stage tandem double-effect absorption heat pump, which is mentioned in FIG. 7, comprises high pressure generator A2, low pressure generator B2, condenser C2, evaporator D2, absorber E2, solution pump F2, liquid refrigerant pump H2, throttle I2, the first solution heat exchanger J2, the second solution heat exchanger K2.

In the recuperative single stage tandem double-effect second-type absorption heat pump, the steam bleeding chamber M2 has the concentrated solution pipe which passes through the third solution pump N2, the third solution heat exchanger P2 and then connects the second absorber L2. The second absorber L2 has the dilute solution pipe which passes through the third solution heat exchanger P2, the first absorber E2 and then connects the steam bleeding chamber M2. The steam bleeding chamber M2 has refrigerant vapor channel connected condenser C2. The first evaporator D2 has refrigerant vapor channel which passes through the second throttle R2 and then connects the second evaporator Q2. The second evaporator Q2 has the refrigerant vapor channel connected the second absorber L2. The second absorber L2 has the heated medium pipe connected external. We cancel that absorber E2 has the heated medium pipe connected external.

We adopt the solution tandem cycle as following. We change that the steam bleeding chamber M2 has the concentrated solution pipe which passes through the third solution pump N2, the third solution heat exchanger P2 and then connects the second absorber L2 to that the steam bleeding chamber M2 has the concentrated solution pipe which passes through the third solution pump N2, the third solution heat exchanger P2, the second absorber L2 and then connects the new added steam bleeding chamber 1. The new added steam bleeding chamber 1 has the concentrated solution pipe which passes through the new added solution pump 3 and the new added solution heat exchanger 5 and then connects the new added absorber 2. The new added absorber 2 has the dilute solution pipe which passes through the new added solution heat exchanger 5 and then connects the second absorber L2.

We change that the second absorber L2 has the heated medium pipe connected external to that the second absorber L2 has refrigerant vapor channel connected the new added absorber 2 after that the first evaporator D2 add the liquid refrigerant pipe which passes through the new added liquid refrigerant pump 4 and then connects the second absorber L2. The new added steam bleeding chamber 1 has refrigerant vapor channel connected condenser C2. The new added absorber 2 has the heated medium pipe connected external.

Secondly, on the process, the process to form the high temperature heating-side is as following. In the single stage tandem double-effect second-type absorption heat pump, the heating load is formed in the second absorber L2 and can be divided into two parts. One part of the heating load heats up the solution which flows through the third solution pump N2, the third solution heat exchanger P2, the second absorber L2 from the steam bleeding chamber M2. The solution is vaporization and enters the new added steam bleeding chamber 1. The other part heats up the liquid refrigerant which flows through the new added liquid refrigerant pump 4 and the second absorber L2 form the first evaporator D2. And the liquid refrigerant becomes refrigerant vapor provided to the new added absorber 2.

After that the vapor phase and liquid phase of the solution which enters the new added steam bleeding chamber 1 is separated, the refrigerant vapor enters condenser C2 while the concentrated solution flows through the new added solution pump 3, the new added solution heat exchanger 5 and then connects the new added absorber 2. The concentrated solution in absorber 2 absorbs the refrigerant vapor came from the second absorber L2 and provides the high temperature heating load to the heated medium. The dilute solution of the new added absorber 2 flows through the new added solution heat exchanger 5 and then enters the second absorber L2. The refrigerant vapor, which enters condenser C2 from the new added steam bleeding chamber 1, releases heat to the cooling medium and becomes liquid refrigerant. After that the liquid refrigerant flows through liquid refrigerant pump H2, the new added liquid refrigerant pump 4 and the second absorber L2 where it absorbs heat and becomes refrigerant vapor with high temperature entered the new added absorber 2.

Figure 15:
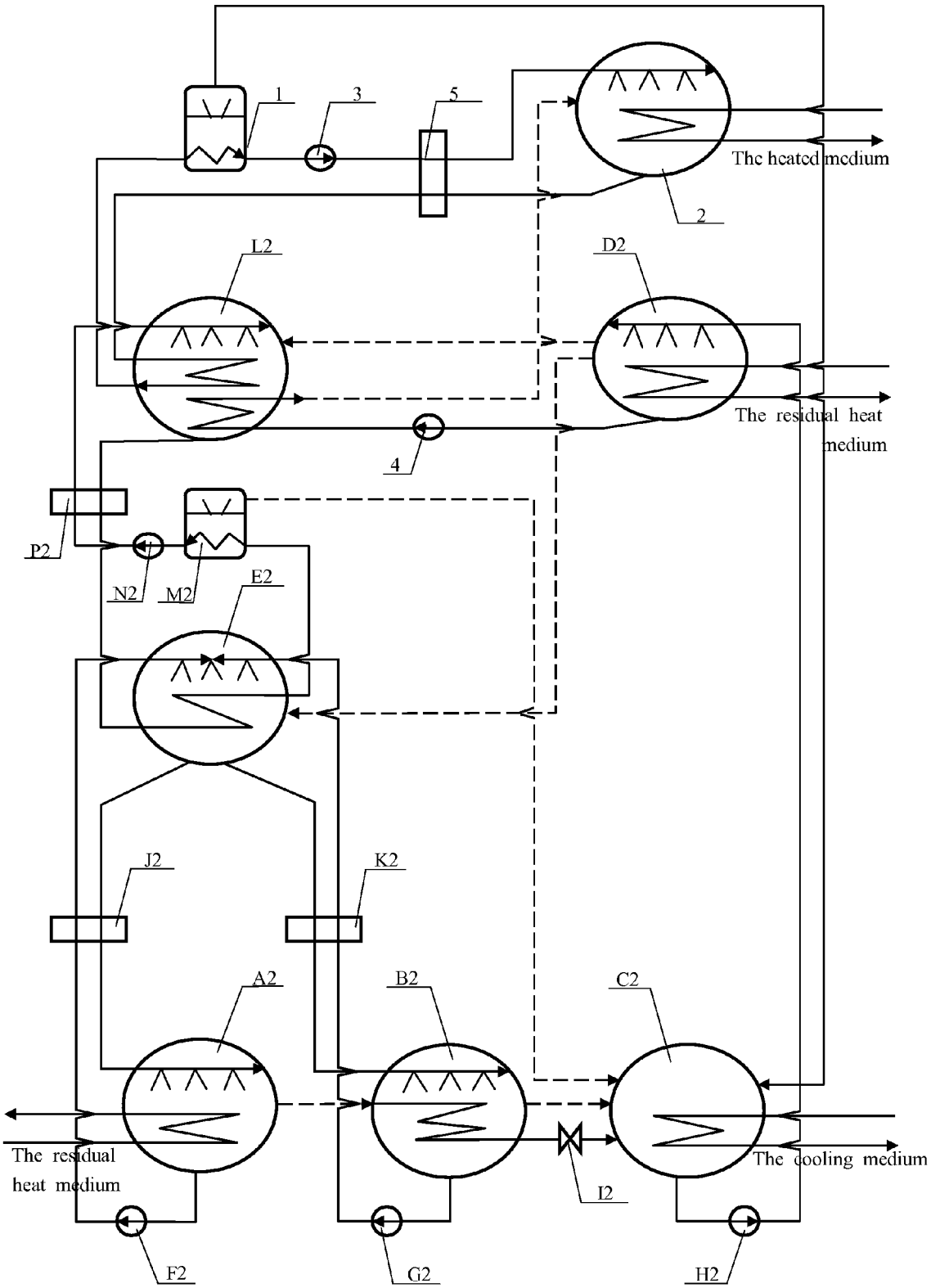
FIG. 15 is the structure and flow diagram of the two-stage high temperature second-type absorption heat pump which adopts the solution independent cycle and is based on the recuperative single stage parallel double-effect second-type absorption heat pump According to the method provided by the invention.

The two-stage high temperature second-type absorption heat pump shown in FIG. 15, based on the recuperative single stage tandem double-effect second-type absorption heat pump, can be realized by the following way:

Firstly, structurally, according to the method expounded in claim 2, we add the new added steam bleeding chamber 1, the new added absorber 2, the new added liquid refrigerant pump 4, the new added solution pump 3, the new added solution heat exchanger 5 on the single stage parallel double-effect second-type absorption heat pump which can be achieved by adding the third solution heat exchanger P2, the second absorber L2, the steam bleeding chamber M2, the third solution pump N2 on the single stage tandem double-effect absorption heat pump. The single stage tandem double-effect absorption heat pump, which is mentioned in FIG. 8, comprises high pressure generator A2, low pressure generator B2, condenser C2, evaporator D2, absorber E2, solution pump F2, liquid refrigerant pump H2, throttle I2, the first solution heat exchanger J2 and the second solution heat exchanger K2.

In the recuperative single stage tandem double-effect second-type absorption heat pump, the steam bleeding chamber M2 has the concentrated solution pipe which passes through the third solution pump N2, the third solution heat exchanger P2 and then connects the second absorber L2. The second absorber L2 has the dilute solution pipe which passes through the third solution heat exchanger P2, the first absorber E2 and then connects the steam bleeding chamber M2. The steam bleeding chamber M2 has refrigerant vapor channel connected condenser C2. Evaporator D2 adds the refrigerant vapor channel connected the second absorber L2. The second absorber L2 has the heated medium pipe connected external. We cancel that absorber E2 has the heated medium pipe connected external.

We adopt the solution independent cycle as following. The new added steam bleeding chamber 1 has the concentrated solution pipe which passes through the new added solution pump 3 and the new added solution heat exchanger 5 and then connects the new added absorber 2. The new added absorber 2 has the dilute solution pipe which passes through the new added solution heat exchanger 5, the second absorber L2 and then connects the new added steam bleeding chamber 1.

We change that the second absorber L2 has the heated medium pipe connected external to that the second absorber L2 has refrigerant vapor channel connected the new added absorber 2 after that the first evaporator D2 add the liquid refrigerant pipe which passes through the new added liquid refrigerant pump 4 and then connects the second absorber L2. The new added steam bleeding chamber 1 has refrigerant vapor channel connected condenser C2. The new added absorber 2 has the heated medium pipe connected external.

Secondly, on the process, the process to form the high temperature heating-side is as following. In the single stage parallel double-effect second-type absorption heat pump, the heating load is formed in the second absorber L2 and can be divided into two parts. One part of the heating load heats up the solution which flows through the new added solution heat exchanger 5, absorber E2 from the new added absorber 2. The solution is vaporization and enters the new added steam bleeding chamber 1. The other part heats up the liquid refrigerant which flows through the new added liquid refrigerant pump 4 and the second absorber L2 form evaporator D2. And the liquid refrigerant becomes refrigerant vapor provided to the new added absorber 2.

After that the vapor phase and liquid phase of the solution which enters the new added steam bleeding chamber 1 is separated, the refrigerant vapor enters condenser C2 while the concentrated solution flows through the new added solution pump 3, the new added solution heat exchanger 5 and then connects the new added absorber 2. The concentrated solution in absorber 2 absorbs the refrigerant vapor came from the second absorber L2 and provides the high temperature heating load to the heated medium. The refrigerant vapor, which enters condenser C2 from the new added steam bleeding chamber 1, releases heat to the cooling medium and becomes liquid refrigerant. After that the liquid refrigerant flows through liquid refrigerant pump H2, the new added liquid refrigerant pump 4 and the second absorber L2 where it absorbs heat and becomes refrigerant vapor with high temperature entered the new added absorber 2.

The two-stage high temperature second-type absorption heat pump shown in FIG. 16, based on the recuperative single stage tandem double-effect second-type absorption heat pump, can be realized by the following way:

Firstly, structurally, according to the method expounded in claim 1, we add the new added steam bleeding chamber 1, the new added absorber 2, the new added liquid refrigerant pump 4, the new added solution pump 3, the new added solution heat exchanger 5 on the single stage tandem double-effect second-type absorption heat pump which can be achieved by adding the third solution heat exchanger P2, the second absorber L2, the steam bleeding chamber M2, the third solution pump N2, the second evaporator Q2 and the second throttle R2 on the single stage tandem double-effect absorption heat pump. The single stage tandem double-effect absorption heat pump, which is mentioned in FIG. 8, comprises high pressure generator A2, low pressure generator B2, condenser C2, evaporator D2, absorber E2, solution pump F2, liquid refrigerant pump H2, throttle I2, the first solution heat exchanger J2, the second solution heat exchanger K2.

In the recuperative single stage tandem double-effect second-type absorption heat pump, high pressure generator A2 has the concentrated solution pipe which passes through solution pump F2, the first solution heat exchanger J2 and then connects the first absorber E2 to that high pressure generator A2 has the concentrated solution pipe which passes through solution pump F2, the first solution heat exchanger J2 the first absorber E2 and then connects the steam bleeding chamber M2. We adjust that low pressure generator B2 has the concentrated solution pipe which passes the second solution pump G2, the second solution heat exchanger K2 and then connects the first absorber E2 to that the concentrated solution pipe which passes through solution pump F2, the first solution heat exchanger J2 from high pressure generator A2 joins with the other concentrated solution pipe which passes through the second solution pump G2, the second solution heat exchanger K2 from low pressure generator B2.

The steam bleeding chamber M2 has the concentrated solution pipe which passes through the third solution pump N2, the third solution heat exchanger P2 and then connects the second absorber L2. The second absorber L2 has the dilute solution pipe which passes through the third solution heat exchanger P2 and then connects the first absorber E2. The steam bleeding chamber M2 has refrigerant vapor channel connected condenser C2. The first evaporator D2 has refrigerant vapor channel which passes through the second throttle R2 and then connects the second evaporator Q2. The second evaporator Q2 has refrigerant vapor channel connected the second absorber L2. The second absorber L2 has the heated medium pipe connected external. We cancel that absorber E2 has the heated medium pipe connected external We adopt the solution tandem cycle as following. We change that the steam bleeding chamber M2 has the concentrated solution pipe which passes through the third solution pump N2, the third solution heat exchanger P2 and then connects the second absorber L2 to that the steam bleeding chamber M2 has the concentrated solution pipe which passes through the third solution pump N2, the third solution heat exchanger P2 the second absorber L2 and then connects the new added steam bleeding chamber 1. The new added steam bleeding chamber 1 has the concentrated solution pipe which passes through the new added solution pump 3 and the new added solution heat exchanger 5 and then connects the new added absorber 2. The new added absorber 2 has the dilute solution pipe which passes through the new added solution heat exchanger 5 and then connects the second absorber L2.

We change that the second absorber L2 has the heated medium pipe connected external to that the second absorber L2 has refrigerant vapor channel connected the new added absorber 2 after that the first evaporator D2 add the liquid refrigerant pipe which passes through the new added liquid refrigerant pump 4 and then connects the second absorber L2. The new added steam bleeding chamber 1 has refrigerant vapor channel connected condenser C2. The new added absorber 2 has the heated medium pipe connected external.

Secondly, on the process, the process to form the high temperature heating-side is as following. In the single stage parallel double-effect second-type absorption heat pump, the heating load is formed in the second absorber L2 and can be divided into two parts. One part of the heating load heats up the solution which flows through the third solution pump N2, the third solution heat exchanger P2, the second absorber L2 from the steam bleeding chamber M2. The solution is vaporization and enters the new added steam bleeding chamber 1. The other part heats up the liquid refrigerant which flows through the new added liquid refrigerant pump 4 and the second absorber L2 form the first evaporator D2. And the liquid refrigerant becomes refrigerant vapor provided to the new added absorber 2.

After that the vapor phase and liquid phase of the solution which enters the new added steam bleeding chamber 1 is separated, the refrigerant vapor enters condenser C2 while the concentrated solution flows through the new added solution pump 3, the new added solution heat exchanger 5 and then connects the new added absorber 2. The concentrated solution in absorber 2 absorbs the refrigerant vapor came from the second absorber L2 and the provided the high temperature heating load to the heated medium. The dilute solution of the new added absorber 2 flows through the new added solution heat exchanger 5 and then enters the second absorber L2. The refrigerant vapor, which enters condenser C2 from the new added steam bleeding chamber 1, releases heat to the cooling medium and becomes liquid refrigerant. After that the liquid refrigerant flows through liquid refrigerant pump H2, the new added liquid refrigerant pump 4 and the second absorber L2 where it absorbs heat and becomes refrigerant vapor with high temperature entered the new added absorber 2.

The two-stage high temperature second-type absorption heat pump shown in FIG. 17, based on the recuperative single stage tandem double-effect second-type absorption heat pump, can be realized by the following way:

In the two-stage high temperature second-type absorption heat pump shown in FIG. 14, based on the recuperative single stage tandem double-effect second-type absorption heat pump, we adjust that the second absorber L2 has the refrigerant vapor channel connected the new added absorber 2 after that the first absorber D2 has liquid refrigerant pipe which passes through the new added liquid refrigerant pump 4 and then connects the second absorber L2 to that the first absorber E2 has the refrigerant vapor channel connected the new added absorber 2 after that the first absorber D21 has liquid refrigerant pipe which passes through the new added liquid refrigerant pump 4 and then connects the first absorber E2.

The recuperative single stage tandem double-effect second-type absorption heat pump completes the improving of residual heat temperature for the first time. The first absorber E2 heats up the liquid refrigerant which flows through it and the liquid refrigerant becomes refrigerant vapor provided to the new added absorber 2. The second absorber L2 heats up the solution which flows through it and is provided to the new added steam bleeding chamber 1. The refrigerant vapor produced by the new added steam bleeding chamber 1 enters condenser C2 while the concentrated solution enters the new added absorber 2. Then the concentrated solution absorbs the refrigerant vapor came from the second absorber L2 and provides the high temperature heating load to the heated medium. Consequently, we get the two-stage high temperature second-type absorption heat pump based on the recuperative single stage double-effect second-type absorption heat pump.

The three-stage high temperature second-type absorption heat pump shown in FIG. 18, based on the single generator two-stage second-type absorption heat pump, can be realized by the following way:

Firstly, structurally, we add the new added steam bleeding chamber 1, the new added absorber 2, the new added liquid refrigerant pump 4, the new added solution pump 3, the new added solution heat exchanger 5 on the single generator two-stage second-type absorption heat pump which comprises generator, condenser, evaporator, absorption-evaporator, absorber, solution pump, liquid refrigerant pump, throttle, the first solution heat exchanger and the second solution heat exchanger.

In the single generator two-stage second-type absorption heat pump, generator A3 has the concentrated solution pipe which passes through solution pump F3, the first solution heat exchanger I3, the second solution heat exchanger J3 and then connects the second absorber E3. The second absorber E3 has the concentrated solution pipe which passes through the second solution heat exchanger J3 and then connects absorption-evaporator D3. Absorption-evaporator D3 has the dilute solution pipe which passes through the first solution heat exchanger I3 and then connects generator A3. Generator A3 has refrigerant vapor channel connected condenser B3. Condenser B3 has the liquid refrigerant pipe which passes through the first liquid refrigerant pump G3, throttle H3 and then connect evaporator C3. After that, the pipe connects absorption-evaporator D3. And then, absorption-evaporator D3 has refrigerant vapor channel connected the second absorber E3. Evaporator C3 has refrigerant vapor channel connected absorption-evaporator D3. Generator A3 and evaporator C3 separately have the heated medium pipe connected external. Condenser B3 has the cooling medium pipe connected external. Absorber E3 has the heated medium pipe connected external.

We adopt the solution tandem cycle as following. We change that generator A3 has the concentrated solution pipe which passes through solution pump F3, the first solution heat exchanger I3, the second solution heat exchanger J3 and then connects the second absorber E3 to that generator A3 has the concentrated solution pipe which passes through solution pump F3, the first solution heat exchanger I3, the second solution heat exchanger J3, the second absorber E3 and then connects the new added steam bleeding chamber 1. The new added steam bleeding chamber 1 has the concentrated solution pipe which passes through the new added solution pump 3 and the new added solution heat exchanger 5 and then connects the new added absorber 2. The new added absorber 2 has the dilute solution pipe which passes through the new added solution heat exchanger 5 and then connects absorber E3.

We change that absorber E3 has the heated medium pipe connected external to that absorber E3 has refrigerant vapor channel connected the new added absorber 2 after that condenser B3 add the liquid refrigerant pipe which passes through the new added liquid refrigerant pump 4 and then connects absorber E3. The new added steam bleeding chamber 1 has refrigerant vapor channel connected condenser B3. The new added absorber 2 has the heated medium pipe connected external.

Secondly, on the process, the process to form the high temperature heating-side is as following. In the single generator two-stage second-type absorption heat pump, the heating load is formed in absorber E3 and can be divided into two parts. One part of the heating load heats up the solution which flows through solution pump F3, the first solution heat exchanger I3, the second solution heat exchanger J3 and then connects the second absorber E3 from generator A3. The solution is vaporization and enters the new added steam bleeding chamber 1. The other part heats up the liquid refrigerant which flows through the new added liquid refrigerant pump 4 and the second absorber E3 form evaporator C3. And the liquid refrigerant becomes refrigerant vapor provided to the new added absorber 2.

After that the vapor phase and liquid phase of the solution which enters the new added steam bleeding chamber 1 is separated, the refrigerant vapor enters condenser B3 while the concentrated solution flows through the new added solution pump 3, the new added solution heat exchanger 5 and then connects the new added absorber 2. The concentrated solution in absorber 2 absorbs the refrigerant vapor came from the second absorber E3 and provides the high temperature heating load to the heated medium. The dilute solution of the new added absorber 2 flows through the new added solution heat exchanger 5 and then enters the second absorber E3. The refrigerant vapor, which enters condenser B3 from the new added steam bleeding chamber 1, releases heat to the cooling medium and becomes liquid refrigerant. After that the liquid refrigerant flows through the new added liquid refrigerant pump 4 and the second absorber E3 where it absorbs heat and becomes refrigerant vapor with high temperature entered the new added absorber 2.

The three-stage high temperature second-type absorption heat pump shown in FIG. 19, based on the single generator two-stage second-type absorption heat pump, can be realized by the following way:

Firstly, structurally, we add the new added steam bleeding chamber 1, the new added absorber 2, the new added liquid refrigerant pump 4, the new added solution pump 3, the new added solution heat exchanger 5 on the single generator two-stage second-type absorption heat pump which comprises generator, condenser, evaporator, absorption-evaporator, absorber, solution pump, the first liquid refrigerant pump, the second liquid refrigerant pump, throttle, the first solution heat exchanger and the second solution heat exchanger.

In the single generator two-stage second-type absorption heat pump, generator A3 has the concentrated solution pipe which passes through solution pump F3, the first solution heat exchanger I3, the second solution heat exchanger J3 and then connects the second absorber E3. The second absorber E3 has the concentrated solution pipe which passes through the second solution heat exchanger J3 and then connects absorption-evaporator D3. Absorption-evaporator D3 has the dilute solution pipe which passes through the first solution heat exchanger I3 and then connects generator A3. Generator A3 has refrigerant vapor channel connected condenser B3.

Condenser B3 has the liquid refrigerant pipe which passes through the first liquid refrigerant pump G3 and then connects evaporator C3. After that evaporator C3 has the liquid refrigerant pipe which passes through the second liquid refrigerant pump K3 and then connects absorption-evaporator D3, absorption-evaporator D3 has refrigerant vapor channel connected the second absorber E3. Evaporator C3 has refrigerant vapor channel connected absorption-evaporator D3. Generator A3 and evaporator C3 separately have the heated medium pipe connected external. Condenser B3 has the cooling medium pipe connected external. Absorber E3 has the heated medium pipe connected external.

We adopt the solution independent cycle as following. The new added steam bleeding chamber 1 has the concentrated solution pipe which passes through the new added solution pump 3 and the new added solution heat exchanger 5 and then connects the new added absorber 2. The new added absorber 2 has the dilute solution pipe which passes through the new added solution heat exchanger 5, absorber E3 and then connects the new added steam bleeding chamber 1. We change that absorber E3 has the heated medium pipe connected external to that absorber E3 has refrigerant vapor channel connected the new added absorber 2 after that evaporator C3 add the liquid refrigerant pipe which passes through the second liquid refrigerant pump K3 and then connects absorber E3.

At the same time, we adjust that evaporator C3 has the liquid refrigerant pipe which passes through the second liquid refrigerant pump K3 and then connects absorption-evaporator D3 to that evaporator C3 has the liquid refrigerant pipe which passes through the second liquid refrigerant pump K3, the new added throttle 6 and then connects absorption-evaporator D3. The new added steam bleeding chamber 1 has refrigerant vapor channel connected condenser B3. The new added absorber 2 has the heated medium pipe connected external.

Secondly, on the process, the process to form the high temperature heating-side is as following. In the single generator two-stage second-type absorption heat pump, the heating load is formed in absorber E3 and can be divided into two parts. One part of the heating load heats up the solution which flows through the new added solution heat exchanger 5, absorber E3 from the new added absorber 2. The solution is vaporization and enters the new added steam bleeding chamber 1. The other part heats up the liquid refrigerant which flows through the second liquid refrigerant pump K3 and absorber E3 form evaporator C3. And the liquid refrigerant becomes refrigerant vapor provided to the new added absorber 2.

After that the vapor phase and liquid phase of the solution which enters the new added steam bleeding chamber 1 is separated, the refrigerant vapor enters condenser B3 while the concentrated solution flows through the new added solution pump 3, the new added solution heat exchanger 5 and then connects the new added absorber 2. The concentrated solution in absorber 2 absorbs the refrigerant vapor came from absorber E3 and provides the high temperature heating load to the heated medium. The refrigerant vapor, which enters condenser B3 from the new added steam bleeding chamber 1, releases heat to the cooling medium and becomes liquid refrigerant. After that the liquid refrigerant flows through the first liquid refrigerant pump G3, the second liquid refrigerant pump K3 and absorber E3 where it absorbs heat and becomes refrigerant vapor with high temperature entered the new added absorber 2.

The three-stage high temperature second-type absorption heat pump shown in FIG. 20, based on the single stage second-type absorption heat pump, can be realized by the following way:

Firstly, structurally, we add the new added second steam bleeding chamber 7, the new added second absorber 8, the new added second liquid refrigerant pump 12, the new added second solution pump 9 and the new added second solution heat exchanger 11 on the single generator two-stage second-type absorption heat pump which is based on single stage second-type absorption heat pump.

We adopt the solution tandem cycle as following. We change that the new added steam bleeding chamber 1 has the concentrated solution pipe which passes through the new added solution pump 3 and the new added solution heat exchanger 5 and then connects the new added absorber 2 to that the new added steam bleeding chamber 1 has the concentrated solution pipe which passes through the new added solution pump 3 and the new added solution heat exchanger 5, the new added absorber 2 and then connects the new added second steam bleeding chamber 7. The new added second steam bleeding chamber 7 has the concentrated solution pipe which passes through the new added second solution pump 9 and the new added second solution heat exchanger 11 and then connects the new added second absorber 8. The new added second absorber 8 has the dilute solution pipe which passes through the new added second solution heat exchanger 11 and then connects the new added absorber 2.

We change that the new added absorber 2 has the heated medium pipe connected external to that the new added absorption-evaporator 2 has refrigerant vapor channel connected the new added second absorber 8 after that evaporator adds the liquid refrigerant pipe which passes through the new added second liquid refrigerant pump 12 and then connects the new added absorber 2. The new added second steam bleeding chamber 7 has refrigerant vapor channel connected condenser. The new added second absorber 8 has the heated medium pipe connected external.

Secondly, on the process, the process to form the high temperature heating-side is as following. In the single generator two-stage second-type absorption heat pump which is based on the single stage second-type absorption heat pump, the heating load is formed in the new added absorber 2 and can be divided into two parts. One part of the heating load heats up the solution which flows through the new added solution pump 3, the new added solution heat exchanger 5 and the new added absorber 2 from the new added steam bleeding chamber 1. The solution is vaporization and enters the new added second steam bleeding chamber 7. The other part heats up the liquid refrigerant which flows through the second liquid refrigerant pump 12 and the new added absorber 2 form evaporator C1. And the liquid refrigerant becomes refrigerant vapor provided to the new added absorber 2.

After that the vapor phase and liquid phase of the solution which enters the new added second steam bleeding chamber 7 is separated, the refrigerant vapor enters condenser B1 while the concentrated solution flows through the new added second solution pump 9 and the new added second solution heat exchanger 11 and then connects the new added second absorber 8. The concentrated solution in the new added second absorber 8 absorbs the refrigerant vapor came from the new added absorber 2 and provides the high temperature heating load to the heated medium. The new added second absorber 8 has the dilute solution which flows through the new added solution heat exchanger 11 and then enters the new added absorber 2. The refrigerant vapor, which enters condenser B1 from the new added second steam bleeding chamber 7, releases heat to the cooling medium and becomes liquid refrigerant. After that the liquid refrigerant flows through liquid refrigerant pump F1, the new added second liquid refrigerant pump 12, the new added absorber 2 where it absorbs heat and becomes refrigerant vapor with high temperature entered the new added second absorber 8.

The three-stage high temperature second-type absorption heat pump shown in FIG. 21, based on the single stage second-type absorption heat pump, can be realized by the following way:

Firstly, structurally, based on the single stage second-type absorption heat pump mentioned in FIG. 2 we add the new added steam bleeding chamber 1, the new added absorber 2, the new added liquid refrigerant pump 4, the new added solution pump 3, the new added solution heat exchanger 5 at first. Then we change that generator A1 has concentrated solution pipe which passes through solution heat exchanger G1 and then connects absorber D1 to that generator A1 has concentrated solution pipe which passes through solution heat exchanger G1, absorber D1 and then connects the new added steam bleeding chamber 1. The new added steam bleeding chamber 1 has concentrated solution pipe which passes through the new added solution pump 3 and the new added solution heat exchanger 5 and then connects the new added absorber 2. The new added absorber 2 has the dilute solution pipe which passes through the new added solution heat exchanger 5 and then connects absorber D1. We change that absorber D1 has the heated medium pipe connected external to that absorber D1 has the refrigerant vapor channel connected the new added absorber 2 after that condenser B1 has the liquid refrigerant pipe which passes through the new added liquid refrigerant pump 4 and then connects absorber D1. The new added steam bleeding chamber 1 has the refrigerant vapor channel connected condenser B1. The new added absorber 2 has the heated medium pipe connected external. Then we get the two-stage high temperature second-type absorption heat pump.

We add the new added second steam bleeding chamber 7, the new added second absorber 8, the new added second throttle 10, the new added second solution pump 9 and the new added second solution heat exchanger 11 more. The new added second steam bleeding chamber 7 has concentrated solution pipe which passes through the new added second solution pump 9 and the new added second solution heat exchanger 11 and then connects the new added second absorber 8. The new added second absorber 8 has the dilute solution pipe which passes through the new added second solution heat exchanger 11, the new added absorber 2 and then connects the new added second steam bleeding chamber 7. We change that the new added absorber 2 has the heated medium pipe connected external to that the new added absorber 2 has the refrigerant channel connected the new added second absorber 8 after that condenser has the liquid refrigerant pipe which passes through liquid refrigerant pump and then connects the new added absorber 2. At the same time, we adjust that condenser has the liquid refrigerant pipe which passes through liquid refrigerant pump and then connects evaporator C1 to that condenser has the liquid refrigerant pipe which passes through liquid refrigerant pump, the new added second throttle 10 and then connects evaporator C1. The new added second steam bleeding chamber 7 has the refrigerant vapor channel connected condenser. The new added second absorber 8 has the heated medium pipe connected external. Consequently, we achieve the three-stage high temperature second-type absorption heat pump shown in FIG. 21 based on the single stage second-type absorption heat pump.

Secondly, on the process, the process to form the high temperature heating-side is as following. In the single generator two-stage second-type absorption heat pump which is based on the single stage second-type absorption heat pump, the heating load is formed in the new added absorber 2 and can be divided into two parts. One part of the heating load heats up the solution which flows through the new added second solution heat exchanger 11, the new added absorber 2 from the new added second absorber 8. The solution is vaporization and enters the new added second steam bleeding chamber 7. The other part heats up the liquid refrigerant which flows through liquid refrigerant pump F1 and the new added absorber 2 form condenser B1. And the liquid refrigerant becomes refrigerant vapor provided to the new added second absorber 8.

After that the vapor phase and liquid phase of the solution which enters the new added second steam bleeding chamber 7 is separated, the refrigerant vapor enters condenser B1 while the concentrated solution flows through the new added second solution pump 9 and the new added second solution heat exchanger 11 and then connects the new added second absorber 8. The concentrated solution in the new added second absorber 8 absorbs the refrigerant vapor came from the new added absorber 2 and provides the high temperature heating load to the heated medium. The new added second absorber 8 has the dilute solution which flows through the new added solution heat exchanger 11 and then enters the new added absorber 2. The refrigerant vapor, which enters condenser B1 from the new added second steam bleeding chamber 7, releases heat to the cooling medium and becomes liquid refrigerant. After that the liquid refrigerant flows through liquid refrigerant pump F1, the new added second liquid refrigerant pump 12, the new added absorber 2 where it absorbs heat and becomes refrigerant vapor with high temperature entered the new added second absorber 8.

The two-stage high temperature second-type absorption heat pump with two-terminal heating shown in FIG. 22 can be realized by adding low temperature heating-side on the two-stage high temperature second-type absorption heat pump which is based on the single stage second-type absorption heat pump, the specific process is as following:

In the two-stage high temperature second-type absorption heat pump which is based on the single stage second-type absorption heat pump shown in FIG. 1, we add the re-added absorber a1, the re-added solution heat exchanger b1 and the re-added solution regulator c1. We add the concentrated solution pipe from the new added steam bleeding chamber 1 which passes through the new added solution pump 3, the re-added solution regulator c1 and then connects the re-added absorber a1. The re-added absorber a1 has the dilute solution pipe which passes through the re-added solution heat exchanger b1 and then connects generator A1. We change that generator A1 has the concentrated solution pipe which passes through solution pump E1, solution heat exchanger G1 and then connects absorber D1 to that generator A1 has the concentrated solution pipe which passes through solution pump E1, the re-added solution heat exchanger b1, solution heat exchanger G1 and then connects absorber D1. Evaporator adds the refrigerant vapor channel connected the re-added absorber a1. The re-added absorber a1 has the heated medium pipe connected external. Consequently, we achieve the two-stage high temperature second-type absorption heat pump with low temperature heating-side.

The two-stage high temperature second-type absorption heat pump with two-terminal heating shown in FIG. 23 can be realized by adding low temperature heating-side on the two-stage high temperature second-type absorption heat pump which is based on the single stage second-type absorption heat pump, the specific process is as following:

In the two-stage high temperature second-type absorption heat pump which is based on the single stage second-type absorption heat pump shown in FIG. 1, we add the re-added absorber a1, the re-added solution heat exchanger b1, the re-added evaporator d1, the re-added throttle e1. Evaporator has liquid refrigerant pipe which passes through the re-added throttle e1 and then connects the re-added evaporator d1. We adjust that evaporator has liquid refrigerant channel connected the first absorber D1 to that evaporator has refrigerant vapor channel connected the re-added absorber a1 and the re-added evaporator d1 has refrigerant vapor channel connected absorber D1. The new added steam bleeding chamber 1 has the concentrated solution pipe which passes through the new added solution pump 3, the re-added solution heat exchanger b1 and then connects the re-added absorber a1. The re-added absorber a1 has the dilute solution pipe which passes through the re-added solution heat exchanger b1 and then connects generator A1. The re-added absorber a1 has the heated medium pipe connected external. Consequently, we achieve the two-stage high temperature second-type absorption heat pump with low temperature heating-side.

The two-stage high temperature second-type absorption heat pump with two-terminal heating shown in FIG. 24 can be realized by adding low temperature heating-side on the two-stage high temperature second-type absorption heat pump which is based on the single stage tandem double-effect second-type absorption heat pump, the specific process is as following:

In the two-stage high temperature second-type absorption heat pump which is based on the single stage tandem double-effect second-type absorption heat pump shown in FIG. 7, we add the re-added absorber a1, the re-added solution heat exchanger b1. The new added steam bleeding chamber 1 has the concentrated solution pipe which passes through the new added solution pump 3, the re-added solution heat exchanger b1 and then connects the re-added absorber a1. The re-added absorber a1 has the dilute solution pipe which passes through the re-added solution heat exchanger b1 and then connects low pressure generator B2. Evaporator D2 adds the refrigerant vapor channel connected the re-added absorber a1. The re-added absorber a1 has the heated medium pipe connected external. Consequently, we achieve the two-stage high temperature second-type absorption heat pump with low temperature heating-side.

The recuperative two-stage high temperature second-type absorption heat pump shown in FIG. 25 can be realized by adding the back-heating process on the two-stage high temperature second-type absorption heat pump which is based on the single stage second-type absorption heat pump, the specific process is as following:

In the two-stage high temperature second-type absorption heat pump which is based on the single stage second-type absorption heat pump shown in FIG. 1, we add recuperative steam bleeding chamber, recuperative absorber, recuperative solution pump, recuperative solution heat exchanger. The recuperative steam bleeding chamber a2 has the concentrated solution pipe which passes through recuperative solution pump c2, recuperative solution heat exchanger d2 and then connects recuperative absorber b2. The recuperative absorber b2 has the dilute solution pipe which passes through recuperative solution heat exchanger d2, the new added absorber 2 and then connects recuperative steam bleeding chamber a2. Absorber D1 adds the refrigerant vapor channel connected recuperative absorber b2. The recuperative steam bleeding chamber a2 has the refrigerant vapor channel connected condenser B1. The recuperative absorber b2 has the heated medium pipe connected external. Consequently, we achieve the recuperative two-stage high temperature second-type absorption heat pump.

The recuperative two-stage high temperature second-type absorption heat pump shown in FIG. 26 can be realized by adding the back-heating process on the two-stage high temperature second-type absorption heat pump which is based on the single stage second-type absorption heat pump, the specific process is as following:

In the two-stage high temperature second-type absorption heat pump which is based on the single stage second-type absorption heat pump shown in FIG. 1, we add recuperative steam bleeding chamber, recuperative absorber, recuperative first solution pump, recuperative solution heat exchanger and recuperative second solution pump. We change that the new added steam bleeding chamber 1 has concentrated solution pipe which passes through the new added solution pump 3 and the new added solution heat exchanger 5 and then connects the new added absorber 2 to that the new added steam bleeding chamber 1 has concentrated solution pipe which passes through the new added solution pump 3 and the new added solution heat exchanger 5, the new added absorber 2 and then connects recuperative steam bleeding chamber a2. The recuperative steam bleeding chamber a2 has the concentrated solution pipe which passes through recuperative first solution pump c2, recuperative solution heat exchanger d2 and then connects recuperative absorber b2. The recuperative absorber b2 has the dilute solution pipe which passes through recuperative solution heat exchanger d2, recuperative second solution pump e2, and then connects the new added absorber 2. Absorber D1 adds the refrigerant vapor channel connected recuperative absorber b2. The recuperative steam bleeding chamber a2 has the refrigerant vapor channel connected condenser. The recuperative absorber b2 has the heated medium pipe connected external. Consequently, we achieve the recuperative two-stage high temperature second-type absorption heat pump.

The Effect Achieved by the Invention Technology:

The method to improve the heating temperature of heat pump and the second-type high temperature absorption heat pump, which are put forward by the invention, has the effect and advantages as following:

①. The method to improve the heating temperature of heat pump, which is provided in the invention, is simple, reasonable and practical and can greatly enhance the waste heat temperature too. Based on the existing low temperature second-type absorption heat pump, we can get corresponding high temperature second-type absorption heat pump by using this invention.

②. The second-type absorption heat pump achieved by using the invention can greatly improve the residual heat temperature.

③. In the second-type high temperature absorption heat pump, there are less heat transfer links which is good for the greatly improving of residual heat temperature.

④. The second-type high temperature absorption heat pump achieved by using the invention has simple structure and reasonable process which can reduce extremely the equipment cost.

⑤. This invention can enrich the categories of the second-type absorption heat pump and expand the operating temperatures range and application scope of the second-type absorption heat pump.

In short, the method to improve the heating temperature of heat pump and the second-type high temperature absorption heat pump which adopt the method can realize greatly enhancing of waste heat temperature, enrich the types of the second-type absorption heat pump, make the structure of unit simplicity and cost reduction and have a well novelty, creativity, practicality.

What is claimed is:

1. A method of improving a heating temperature of a heat pump comprising steps of: a dilute solution of an absorber (D1) passing through a solution heat exchanger (G1) and then entering a generator (A1), and then heating the dilute solution by a residual heat medium flowing through the generator (A1) for releasing a refrigerant vapor to provided to a condenser (B1), a concentrated solution of the generator (A1) flowing through a solution pump (E1), the solution heat exchanger (G1) and entering the absorber (D1) for absorbing heat and being partially vaporized, and then entering a steam bleeding chamber (1), the steam bleeding chamber (1) releasing the refrigerant vapor to enter the condenser (B1), the concentrated solution flowing through a new added solution pump (3), a new added solution heat exchanger (5) and then connecting a new added absorber (2), then the concentrated solution absorbing the refrigerant vapor came from the absorber (D1) and providing a high temperature heating load to the heated medium, the dilute solution of the new added absorber (2) flowing through the new added solution heat exchanger (5) and then entering the absorber (D1) for absorbing the refrigerant vapor came from an evaporator (C1) and releasing heat, the refrigerant vapor, entering the condenser (B1) from the generator (A1) and the new added steam bleeding chamber (1), releasing heat to a cooling medium and becoming a liquid refrigerant, the liquid refrigerant flowing through a liquid refrigerant pump (F1) and then being divided into two parts, wherein a part of the liquid refrigerant flows through a new added throttle (6) and then enters the evaporator (C1) for absorbing residual heat and becoming refrigerant vapor provided to the absorber (D1); in the absorber (D1), the refrigerant vapor is absorbed by the solution and releases heat to the other road of solution and liquid refrigerant which flows through absorber (D1); the other part flows through absorber (D1) and absorbs heat becoming refrigerant vapor provided to the new added absorber (2); at first, the concentration of the solution entering the new added absorber (2) is promoted by the generator (A1) for the first time; and then, the solution concentration is improved by the absorber (D1) and the new added steam bleeding chamber (1) for the second time; the refrigerant vapor entering the new added absorber (2) is produced by the heating of the absorber (D1); the heating temperature of the new added absorber (2) is higher than the one of the absorber (D1), thus achieving the two stages improvement of the residual heat temperature.

2. The second-type high temperature absorption heat pump produced in accordance with the method of claim 1, comprising the new added steam bleeding chamber (1), the new added absorber (2), the new added liquid refrigerant pump (4) or the new added throttle (6), the new added solution pump (3), the new added solution heat exchanger (5) and the single stage second-type absorption heat pump which comprises the generator (A1), the condenser (B1), the evaporator (C1), the absorber (D1), the solution pump (E1), the liquid refrigerant pump (F1) and the solution heat exchanger (G1), wherein the generator (A1) has the concentrated solution pipe which passes through the solution pump (E1), the solution heat exchanger (G1) and then connects the absorber (D1), and the absorber (D1) has the dilute solution pipe which passes through solution heat exchanger (G1) and then connects the generator (A1), the generator (A1) has refrigerant vapor pipe connected the condenser (B1), the condenser (B1) has the liquid refrigerant pipe which passes through the liquid refrigerant pump (F1) and then connects the evaporator (C1), the evaporator (C1) has the refrigerant vapor channel connected the absorber (D1), the generator (A1) and the evaporator (C1) have the residual heat pipe connected external, the condenser (B1) has the liquid refrigerant channel connected the absorber (D1), the generator (A1) and evaporator have the residual heat medium pipe connected external, the condenser (B1) has the cooling medium pipe connected external, the absorber (D1) has the heated medium pipe connected external, wherein the solution tandem cycle is adopted as following, that the generator (A1) has the concentrated solution pipe which passes through the solution pump (E1), the solution heat exchanger (G1) and then connects the absorber (D1) is changed to that the generator (A1) has the concentrated solution pipe which passes through the solution pump (E1), the solution heat exchanger (G1), the absorber (D1) and then connects the new added steam bleeding chamber (1), and the new added steam bleeding chamber (1) has the concentrated solution pipe which passes through the new added solution pump (3) and the new added solution heat exchanger (5) and then connects the new added absorber (2), then the new added absorber (2) has the dilute solution pipe which passes through the new added solution heat exchanger (5) and then connects absorber (D1), wherein in the single stage second-type absorption heat pump, that the absorber (D1) has the heated medium pipe connected external is changed to that the absorber (D1) has refrigerant vapor channel connected the new added absorber (2) after that condenser (B1) or evaporator (C1) add the liquid refrigerant pipe which passes through the new added liquid refrigerant pump (4) and then connects absorber, or that absorber (D1) has the heated medium pipe connected external is changed to that absorber (D1) has refrigerant vapor channel connected the new added absorber (2) after that condenser (B1) has the liquid refrigerant pipe which passes through liquid refrigerant pump (F1) and then connects absorber (D1), at the same time, that condenser (B1) has the liquid refrigerant pipe which passes through liquid refrigerant pump (F1) and then connects evaporator (C1) is adjusted to that condenser (B1) has the liquid refrigerant pipe which passes through the liquid refrigerant pump (F1), the new added throttle (6) and then connects evaporator (C1), wherein that the new added steam bleeding chamber (1) has refrigerant vapor channel connected condenser (B1), and the new added absorber (2) has the heated medium pipe connected external, such that the single stage second-type absorption heat pump completes the first stage improving of residual heat temperature, and absorber (D1) heats up the liquid refrigerant flowing therethrough, the liquid refrigerant becomes refrigerant vapor provided to the new added absorber (2), absorber (D1) heats up the solution flowing therethrough, after being partially vaporized, the solution enters the new added steam bleeding chamber (1), the refrigerant vapor produced by the new added steam bleeding chamber (1) enters condenser (B1), at the same time, the concentrated solution enters the new added absorber (2), absorbs the refrigerant vapor came from absorber (D1) and provides the high temperature heating load to the heated medium, thus achieving the two-stage high temperature second-type absorption heat pump based on the single stage second-type absorption heat pump.

3. The second-type high temperature absorption heat pump produced in accordance with the method of claim 1, comprising: the new added steam bleeding chamber (1), the new added absorber (2), the new added liquid refrigerant pump (4) or the new added throttle (6), the new added solution pump (3), the new added solution heat exchanger (5) and the recuperative single stage second-type absorption heat pump which comprises generator, condenser, evaporator, the first absorber, the first solution pump, liquid refrigerant pump, the second absorber, the steam bleeding chamber, the second solution pump or/and the third solution pump, the first solution heat exchanger and the second solution heat exchanger, wherein the recuperative single stage second-type absorption heat pump, generator (A1) has the concentrated solution pipe which passes through the first solution pump (E1), the second solution heat exchanger (L1), the second absorber (H1) and then connects the steam bleeding chamber (I1), and the steam bleeding chamber (I1) has the concentrated solution pipe which passes through the second solution pump (J1), the first solution heat exchanger (G1) and then connects the first absorber (D1), and the first absorber (D1) has the dilute solution pipe which passes through the first solution heat exchanger (G1) or/and the third solution heat exchanger (K1) and then connects the second absorber (H1, the second absorber (H1) has the dilute solution pipe which passes through the second solution heat exchanger (L1) and then connects generator (A1), generator (A1) and the steam bleeding chamber (I1) have refrigerant vapor pipe connected condenser (B1), condenser (B1) has the liquid refrigerant pipe which passes through liquid refrigerant pump (F1) and then connects evaporator (C1), evaporator (C1) has refrigerant vapor channel which separately connects the first absorber (D1) and the second absorber (H1), generator (A1) and evaporator (C1) have the residual heat medium pipe connected external, condenser (B1) has the cooling medium pipe connected external, and the first absorber (D1) has the heated medium pipe connected external, wherein the solution tandem cycle is adopted as following, and that the steam bleeding chamber (I1) has the concentrated solution pipe which passes through the second solution pump (J1), the first solution heat exchanger (G1) and then connects the first absorber (D1) is changed to that the steam bleeding chamber (I1) has the concentrated solution pipe which passes through the second solution pump (J1), the first solution heat exchanger (G1), the first absorber (D1) and then connects the new added steam bleeding chamber (1), and the new added steam bleeding chamber (1) has the concentrated solution pipe which passes through the new added solution pump (3) and the new added solution heat exchanger (5) and then connects the new added absorber (2), the new added absorber (2) has the dilute solution pipe which passes through the new added solution heat exchanger (5) and then connects absorber (D1), wherein the first absorber (D1) has the heated medium pipe connected external is changed to that the first absorber (D1) has refrigerant vapor channel connected the new added absorber (2) after that condenser (B1) or evaporator (C1) add the liquid refrigerant pipe which passes through the new added liquid refrigerant pump (4) and then connects absorber or the first absorber (D1) has the heated medium pipe connected external is changed to that the first absorber (D1) has refrigerant vapor channel connected the new added absorber (2) after that condenser (B1) has the liquid refrigerant pipe which passes through liquid refrigerant pump (F1) and then connects the first absorber (D1), at the same time, that condenser (B1) has the liquid refrigerant pipe which passes through liquid refrigerant pump (F1) and then connects evaporator (C1) is adjusted to that condenser (B1) has the liquid refrigerant pipe which passes through liquid refrigerant pump (F1), the new added throttle (6) and then connects evaporator (C1), wherein that the new added steam bleeding chamber (1) has refrigerant vapor channel connected condenser (B1), and the new added absorber (2) has the heated medium pipe connected external, the recuperative single stage second-type absorption heat pump completes the first stage improving of residual heat temperature, and the first absorber (D1) heats up the liquid refrigerant flowing therethrough, a liquid refrigerant becomes refrigerant vapor provided to the new added absorber (2), the first absorber (D1) heats up the solution flowing therethrough, after being partially vaporization, the solution enters the new added steam bleeding chamber (1), a refrigerant vapor produced by the new added steam bleeding chamber (1) enters condenser (B1), at the same time, the concentrated solution enters the new added absorber (2), absorbs the refrigerant vapor came from the first absorber (D1) and provides the high temperature heating load to the heated medium, thus achieving the two-stage high temperature second-type absorption heat pump based on the recuperative single stage second-type absorption heat pump.

4. The second-type high temperature absorption heat pump, produced in accordance with the method of claim 1, comprising: the new added steam bleeding chamber (1), the new added absorber (2), the new added liquid refrigerant pump (4) or the new added throttle (6), the new added solution pump (3), the new added solution heat exchanger (5) and the recuperative single stage second-type absorption heat pump which comprises generator, condenser, the first evaporator, the second evaporator, the first absorber, the first solution pump, liquid refrigerant pump, the second absorber, the steam bleeding chamber, the second solution pump, throttle, the first solution heat exchanger and the second solution heat exchanger, wherein the recuperative single stage second-type absorption heat pump, generator (A1) has the concentrated solution pipe which passes through the first solution pump (E1), the second solution heat exchanger (L1), the second absorber (H1) and then connects the steam bleeding chamber (I1), and the steam bleeding chamber (I1) has the concentrated solution pipe which passes through the second solution pump (J1), the first solution heat exchanger (G1) and then connects the first absorber (D1), the first absorber (D1) has the dilute solution pipe which passes through the first solution heat exchanger (G1) and then connects the second absorber (H1), the second absorber (H1) has the dilute solution pipe which passes through the second solution heat exchanger (L1) and then connects generator (A1), and generator (A1) and the steam bleeding chamber (I1) have refrigerant vapor pipe connected condenser (B1), condenser (B1) has the liquid refrigerant pipe which passes through liquid refrigerant pump (F1) and then connects the first evaporator (C1), the first evaporator (C1) has liquid refrigerant pipe which passes through throttle (N1) and then connects the second evaporator (M1), the first evaporator (C1) has refrigerant vapor channel connected the first absorber (D1), the second evaporator (M1) has refrigerant vapor channel connected the second absorber (H1), generator (A1), the first evaporator (C1) and the second evaporator (M1) have the residual heat medium pipe connected external, condenser (B1) has the cooling medium pipe connected external, and the first absorber (D1) has the heated medium pipe connected external, wherein the solution tandem cycle is adopted as following, and that the steam bleeding chamber (I1) has the concentrated solution pipe which passes through the second solution pump (J1), the first solution heat exchanger (G1) and then connects the first absorber (D1) is changed to that the steam bleeding chamber (I1) has the concentrated solution pipe which passes through the second solution pump (J1), the first solution heat exchanger (G1), the first absorber (D1) and then connects the new added steam bleeding chamber (1), then the new added steam bleeding chamber (1) has the concentrated solution pipe which passes through the new added solution pump (3) and the new added solution heat exchanger (5) and then connects the new added absorber (2), the new added absorber (2) has the dilute solution pipe which passes through the new added solution heat exchanger (5) and then connects absorber (D1), wherein that the first absorber (D1) has the heated medium pipe connected external is changed to that the first absorber (D1) has refrigerant vapor channel connected the new added absorber (2) after that condenser (B1) or the first evaporator (C1) add the liquid refrigerant pipe which passes through the new added liquid refrigerant pump (4) and then connects absorber, or that the first absorber (D1) has the heated medium pipe connected external is changed to that the first absorber (D1) has refrigerant vapor channel connected the new added absorber (2) after that condenser (B1) has the liquid refrigerant pipe which passes through liquid refrigerant pump (F1) and then connects the first absorber (D1), at the same time, that condenser (B1) has the liquid refrigerant pipe which passes through liquid refrigerant pump (F1) and then connects the first evaporator (C1) is adjusted to that condenser (B1) has the liquid refrigerant pipe which passes through liquid refrigerant pump (F1), the new added throttle (6) and then connects the first evaporator (C1), wherein that the new added steam bleeding chamber (1) has refrigerant vapor channel connected condenser (B1), and the new added absorber (2) has the heated medium pipe connected external, the recuperative single stage second-type absorption heat pump completes the first stage improving of residual heat temperature, the first absorber (D1) heats up the liquid refrigerant flowing therethrough, and the liquid refrigerant becomes refrigerant vapor provided to the new added absorber (2), the first absorber (D1) heats up the solution flowing therethrough, after being partially vaporized, the solution enters the new added steam bleeding chamber (1), the refrigerant vapor produced by the new added steam bleeding chamber (1) enters condenser (B1), at the same time, the concentrated solution enters the new added absorber (2), absorbs the refrigerant vapor came from the first absorber (D1) and provides the high temperature heating load to the heated medium, thus achieving the two-stage high temperature second-type absorption heat pump based on the recuperative single stage second-type absorption heat pump.

5. The second-type high temperature absorption heat pump, produced in accordance with the method of claim 1, comprising: the new added steam bleeding chamber (1), the new added absorber (2), the new added liquid refrigerant pump (4) or the new added throttle (6), the new added solution pump (3), the new added solution heat exchanger (5) and the single stage tandem double-effect second-type absorption heat pump which comprises high pressure generator (A2), low pressure generator (B2), condenser (C2), evaporator (D2), absorber (E2), the first solution pump (F2), the second solution pump (G2), liquid refrigerant pump (H2), throttle (I2), solution heat exchanger (J2), wherein the single stage tandem double-effect second-type absorption heat pump, high pressure generator (A2) has the concentrated solution pipe which passes through the second solution pump (G2), solution heat exchanger (J2) and then connects absorber (E2), and absorber (E2) has the dilute solution pipe which passes through solution heat exchanger (J2) and then connects low pressure generator (B2), low pressure generator (B2) has the concentrated solution pipe which passes through the first solution pump (F2) and then connects high pressure generator (A2), after that high pressure generator (A2) refrigerant vapor channel connected low pressure generator (B2), low pressure generator (B2) liquid refrigerant pipe which passes through throttle (I2) and then connects condenser (C2), low pressure generator (B2) has refrigerant vapor channel connected condenser (C2), generator (A2) has liquid refrigerant pipe which passes through liquid refrigerant pump (H2) and then connects evaporator (D2), evaporator (D2) has refrigerant vapor channel connected absorber (E2), generator (A2) and evaporator (D2) separately have the residual heat medium pipe connected external, condenser (C2) has the cooling medium pipe connected external, and absorber (E2) has the heated medium pipe connected external, wherein the solution tandem cycle is adopted as following, that high pressure generator (A2) has the concentrated solution pipe which passes through the first solution pump (F2), solution heat exchanger (J2) and then connects absorber (E2) is changed to that high pressure generator (A2) has the concentrated solution pipe which passes through the first solution pump (F2), solution heat exchanger (J2), absorber (E2) and then connects the new added steam bleeding chamber (1), and the new added steam bleeding chamber (1) has the concentrated solution pipe which passes through the new added solution pump (3) and the new added solution heat exchanger (5) and then connects the new added absorber (2), the new added absorber (2) has the dilute solution pipe which passes through the new added solution heat exchanger (5) and then connects absorber (E2), wherein that absorber (E2) has the heated medium pipe connected external is changed to that absorber (E2) has refrigerant vapor channel connected the new added absorber (2) after that condenser (C2) or evaporator (D2) add the liquid refrigerant pipe which passes through the new added liquid refrigerant pump (4) and then connects absorber (E2), or that absorber (E2) has the heated medium pipe connected external is changed to that absorber (E2) has refrigerant vapor channel connected the new added absorber (2) after that condenser (C2) has the liquid refrigerant pipe which passes through liquid refrigerant pump (H2) and then connects absorber (E2), at the same time, that condenser (C2) has the liquid refrigerant pipe which passes through liquid refrigerant pump (H2) and then connects evaporator (D2) is adjusted to that condenser (C2) has the liquid refrigerant pipe which passes through liquid refrigerant pump (H2), the new added throttle (6) and then connects evaporator (D2), wherein that the new added steam bleeding chamber (1) has refrigerant vapor channel connected condenser (C2), and the new added absorber (2) has the heated medium pipe connected external, such that the single stage double-effect second-type absorption heat pump completes the first stage improving of residual heat temperature, absorber (E2) heats up the liquid refrigerant flowing therethrough, and the liquid refrigerant becomes refrigerant vapor provided to the new added absorber (2), absorber (E2) heats up the solution flowing therethrough, after being partially vaporized, the solution enters the new added steam bleeding chamber (1), a refrigerant vapor produced by the new added steam bleeding chamber (1) enters condenser (C2), at the same time, the concentrated solution enters the new added absorber (2), absorbs the refrigerant vapor came from the first absorber (D1) and provides the high temperature heating load to the heated medium, thus achieving the two-stage high temperature second-type absorption heat pump based on the single stage double-effect second-type absorption heat pump.

6. The second-type high temperature absorption heat pump, produced in accordance with the method of claim 1, comprising: the new added steam bleeding chamber (1), the new added absorber (2), the new added liquid refrigerant pump (4) or the new added throttle (6), the new added solution pump (3), the new added solution heat exchanger (5) and the single stage tandem double-effect second-type absorption heat pump which comprises high pressure generator (A2), low pressure generator (B2), condenser (C2), evaporator (D2), absorber (E2), the first solution pump (F2), the second solution pump (G2), liquid refrigerant pump (H2), throttle (I2), solution heat exchanger (J2), wherein the single stage tandem double-effect second-type absorption heat pump, high pressure generator (A2) has the concentrated solution pipe which passes through the second solution pump (G2), solution heat exchanger (J2) and then connects absorber (E2), and absorber (E2) has the dilute solution pipe which passes through solution heat exchanger (J2) and then connects low pressure generator (B2), low pressure generator (B2) has the concentrated solution pipe which passes through the first solution pump (F2) and then connects high pressure generator (A2), after that high pressure generator (A2) refrigerant vapor channel connected low pressure generator (B2), low pressure generator (B2) liquid refrigerant pipe which passes through throttle (I2) and then connects condenser (C2), low pressure generator (B2) has refrigerant vapor channel connected condenser (C2), and generator (A2) has liquid refrigerant pipe which passes through liquid refrigerant pump (H2) and then connects evaporator (D2), evaporator (D2) has refrigerant vapor channel connected absorber (E2), generator (A2) and evaporator (D2) separately have the residual heat medium pipe connected external, condenser (C2) has the cooling medium pipe connected external, and absorber (E2) has the heated medium pipe connected external, wherein the solution independent cycle is adopted as following, and the new added steam bleeding chamber (1) has the concentrated solution pipe which passes through the new added solution pump (3) and the new added solution heat exchanger (5) and then connects the new added absorber (2), the new added absorber (2) has the dilute solution pipe which passes through the new added solution heat exchanger (5), absorber (E2) and then connects the new added steam bleeding chamber (1), wherein that absorber (E2) has the heated medium pipe connected external is changed to that absorber (E2) has refrigerant vapor channel connected the new added absorber (2) after that condenser (C2) or evaporator (D2) adds the liquid refrigerant pipe which passes through the new added liquid refrigerant pump (4) and then connects absorber (E2), or that absorber (E2) has the heated medium pipe connected external is changed to that absorber (E2) has refrigerant vapor channel connected the new added absorber (2) after that condenser (C2) has the liquid refrigerant pipe which passes through liquid refrigerant pump (H2) and then connects absorber (E2), at the same time, that condenser (C2) has the liquid refrigerant pipe which passes through liquid refrigerant pump (H2) and then connects evaporator (D2) is adjusted to that condenser (C2) has the liquid refrigerant pipe which passes through liquid refrigerant pump (H2), the new added throttle (6) and then connects evaporator (D2), wherein the new added steam bleeding chamber (1) has refrigerant vapor channel connected condenser (C2), and the new added absorber (2) has the heated medium pipe connected external, such that the single stage double-effect second-type absorption heat pump completes the first stage improving of residual heat temperature, absorber (E2) heats up the liquid refrigerant flowing therethrough, and the liquid refrigerant becomes refrigerant vapor provided to the new added absorber (2), absorber (E2) heats up the solution therethrough, after being partially vaporized, the solution enters the new added steam bleeding chamber (1), the refrigerant vapor produced by the new added steam bleeding chamber (1) enters condenser (C2), at the same time, the concentrated solution enters the new added absorber (2), absorbs the refrigerant vapor came from the first absorber (D1) and provides the high temperature heating load to the heated medium, thus achieving the two-stage high temperature second-type absorption heat pump based on the single stage double-effect second-type absorption heat pump.

7. The second-type high temperature absorption heat pump, produced in accordance with the method of claim 1, comprising: the new added steam bleeding chamber (1), the new added absorber (2), the new added liquid refrigerant pump (4) or the new added throttle (6), the new added solution pump (3), the new added solution heat exchanger (5) and the single stage tandem double-effect second-type absorption heat pump which comprises high pressure generator (A2), low pressure generator (B2), condenser (C2), evaporator (D2), absorber (E2), solution pump (F2), liquid refrigerant pump (H2), throttle (I2), the first solution heat exchanger (J2) and the second solution heat exchanger (K2), wherein the single stage tandem double-effect second-type absorption heat pump, high pressure generator (A2) has the concentrated solution pipe which passes through the first solution heat exchanger (J2) and then connects low pressure generator (B2), and low pressure generator (B2) has the concentrated solution pipe which passes through the first solution heat exchanger (J2) and the second solution heat exchanger (K2) and then connects absorber (E2), absorber (E2) has the dilute solution pipe which passes through the second solution heat exchanger (K2) and then connects high pressure generator (A2), after that high pressure generator (A2) refrigerant vapor channel connected low pressure generator (B2), low pressure generator (B2) liquid refrigerant pipe which passes through throttle (I2) and then connects condenser (C2), low pressure generator (B2) has refrigerant vapor channel connected condenser (C2), high pressure generator (A2) has liquid refrigerant pipe which passes through liquid refrigerant pump (H2) and then connects evaporator (D2), evaporator (D2) has refrigerant vapor channel connected absorber (E2), high pressure generator (A2) and evaporator (D2) separately have the residual heat medium pipe connected external, condenser (C2) has the cooling medium pipe connected external, absorber (E2) has the heated medium pipe connected external, wherein the solution tandem cycle is adopted as following, and that low pressure generator (B2) has the concentrated solution pipe which passes through solution pump (F2), the first solution heat exchanger (J2), the second solution heat exchanger (K2) and then connects absorber (E2) is changed to that high pressure generator (A2) has the concentrated solution pipe which passes through solution pump (F2), the first solution heat exchanger (J2), the second solution heat exchanger (K2), absorber (E2) and then connects the new added steam bleeding chamber (1), the new added steam bleeding chamber (1) has the concentrated solution pipe which passes through the new added solution pump (3) and the new added solution heat exchanger (5) and then connects the new added absorber (2), the new added absorber (2) has the dilute solution pipe which passes through the new added solution heat exchanger (5) and then connects absorber (E2), wherein that absorber (E2) has the heated medium pipe connected external is changed to that absorber (E2) has refrigerant vapor channel connected the new added absorber (2) after that condenser (C2) or evaporator (D2) adds the liquid refrigerant pipe which passes through the new added liquid refrigerant pump (4) and then connects absorber (E2), or that absorber (E2) has the heated medium pipe connected external is changed to that absorber (E2) has refrigerant vapor channel connected the new added absorber (2) after that condenser (C2) has the liquid refrigerant pipe which passes through liquid refrigerant pump (H2) and then connects absorber (E2), at the same time, that condenser (C2) has the liquid refrigerant pipe which passes through liquid refrigerant pump (H2) and then connects evaporator (D2) is adjusted to that condenser (C2) has the liquid refrigerant pipe which passes through liquid refrigerant pump (H2), the new added throttle (6) and then connects evaporator (D2), wherein the new added steam bleeding chamber (1) has refrigerant vapor channel connected condenser (C2), and the new added absorber (2) has the heated medium pipe connected external, such that the single stage double-effect second-type absorption heat pump completes the first stage improving of residual heat temperature, absorber (E2) heats up the liquid refrigerant flowing therethrough, and the liquid refrigerant becomes refrigerant vapor provided to the new added absorber (2), and absorber (E2) heats up the solution flowing therethrough, then enters the new added steam bleeding chamber (1), the refrigerant vapor produced by the new added steam bleeding chamber (1) enters condenser (C2), at the same time, the concentrated solution enters the new added absorber (2), absorbs the refrigerant vapor came from the first absorber (D1) and provides the high temperature heating load to the heated medium, thus achieving the two-stage high temperature second-type absorption heat pump based on the single stage double-effect second-type absorption heat pump.

8. The second-type high temperature absorption heat pump, produced in accordance with the method of claim 1, comprising: the new added steam bleeding chamber (1), the new added absorber (2), the new added liquid refrigerant pump (4) or the new added throttle (6), the new added solution pump (3), the new added solution heat exchanger (5) and the single stage parallel double-effect second-type absorption heat pump which comprises high pressure generator (A2), low pressure generator (B2), condenser (C2), evaporator (D2), absorber (E2), the first solution pump (F2), the second solution pump (G2), liquid refrigerant pump (H2), throttle (I2), the first solution heat exchanger (J2) and the second solution heat exchanger (K2), wherein the single stage tandem double-effect second-type absorption heat pump, high pressure generator (A2) has the concentrated solution pipe which passes through the first solution pump (F2), the first solution heat exchanger (J2) and then connects absorber (E2), absorber (E2) has the dilute solution pipe which passes through the first solution heat exchanger (J2) and then connects high pressure generator (A2), low pressure generator (B2) has the concentrated solution pipe which passes through the second solution pump (G2), the second solution heat exchanger (K2) and then connects absorber (E2), absorber (E2) has the dilute solution pipe which passes through the second solution heat exchanger (K2) and then connects low pressure generator (B2), after that high pressure generator (A2) refrigerant vapor channel connected low pressure generator (B2), low pressure generator (B2) has liquid refrigerant pipe which passes through throttle (I2) and then connects condenser (C2), and low pressure generator (B2) has refrigerant vapor channel connected condenser (C2), high pressure generator (A2) has liquid refrigerant pipe which passes through liquid refrigerant pump (H2) and then connects evaporator (D2), evaporator (D2) has refrigerant vapor channel connected absorber (E2), high pressure generator (A2) and evaporator (D2) separately have the residual heat medium pipe connected external, condenser (C2) has the cooling medium pipe connected external, absorber (E2) has the heated medium pipe connected external, wherein the solution tandem cycle is adopted as following, and that high pressure generator (A2) has the concentrated solution pipe which passes through solution pump (F2), the first solution heat exchanger (J2) and then connects absorber (E2) and that low pressure generator (B2) has the concentrated solution pipe which passes through the second solution pump (G2), the second solution heat exchanger (K2) and then connects absorber (E2) is changed to that absorber (E2) connects the new added steam bleeding chamber (1) after that the two roads of concentrated solution converges, and one road is that the pipe from high pressure generator (A2) passes through solution pump (F2), the first solution heat exchanger (J2), the other road is that the pipe from low pressure generator (B2) passes through the second solution pump (G2), the second solution heat exchanger (K2), the new added steam bleeding chamber (1) has the concentrated solution pipe which passes through the new added solution pump (3) and the new added solution heat exchanger (5) and then connects the new added absorber (2), the new added absorber (2) has the dilute solution pipe which passes through the new added solution heat exchanger (5) and then connects absorber (E2), wherein that absorber (E2) has the heated medium pipe connected external is changed to that absorber (E2) has refrigerant vapor channel connected the new added absorber (2) after that condenser (C2) or evaporator (D2) add the liquid refrigerant pipe which passes through the new added liquid refrigerant pump (4) and then connects absorber (E2), or that absorber (E2) has the heated medium pipe connected external is changed to that absorber (E2) has refrigerant vapor channel connected the new added absorber (2) after that condenser (C2) has the liquid refrigerant pipe which passes through liquid refrigerant pump (H2) and then connects absorber (E2), at the same time, that condenser (C2) has the liquid refrigerant pipe which passes through liquid refrigerant pump (H2) and then connects evaporator (D2) is adjusted to that condenser (C2) has the liquid refrigerant pipe which passes through liquid refrigerant pump (H2), the new added throttle (6) and then connects evaporator (D2), wherein the new added steam bleeding chamber (1) has refrigerant vapor channel connected condenser (C2), the new added absorber (2) has the heated medium pipe connected external, and the single stage double-effect second-type absorption heat pump completes the first stage improving of residual heat temperature, absorber (E2) heats up the liquid refrigerant flowing therethrough, and the liquid refrigerant becomes refrigerant vapor provided to the new added absorber (2), absorber (E2) heats up the solution flowing therethrough, after being partially vaporized, the solution enters the new added steam bleeding chamber (1), the refrigerant vapor produced by the new added steam bleeding chamber (1) enters condenser (C2), at the same time, the concentrated solution enters the new added absorber (2), absorbs the refrigerant vapor came from the first absorber (D1) and provides the high temperature heating load to the heated medium, thus achieving the two-stage high temperature second-type absorption heat pump based on the single stage double-effect second-type absorption heat pump.

9. The second-type high temperature absorption heat pump, produced in accordance with the method of claim 1, comprising: the new added steam bleeding chamber (1), the new added absorber (2), the new added liquid refrigerant pump (4) or the new added throttle (6), the new added solution pump (3), the new added solution heat exchanger (5) and the single stage parallel double-effect second-type absorption heat pump which comprises high pressure generator (A2), low pressure generator (B2), condenser (C2), evaporator (D2), absorber (E2), the first solution pump (F2), the second solution pump (G2), liquid refrigerant pump (H2), throttle (I2), the first solution heat exchanger (J2) and the second solution heat exchanger (K2), wherein the single stage tandem double-effect second-type absorption heat pump, high pressure generator (A2) has the concentrated solution pipe which passes through the first solution pump (F2), the first solution heat exchanger (J2) and then connects absorber (E2), absorber (E2) has the dilute solution pipe which passes through the first solution heat exchanger (J2) and then connects high pressure generator (A2), and low pressure generator (B2) has the concentrated solution pipe which passes through the second solution pump (G2), the second solution heat exchanger (K2) and then connects absorber (E2), absorber (E2) has the dilute solution pipe which passes through the second solution heat exchanger (K2) and then connects low pressure generator (B2), after that high pressure generator (A2) refrigerant vapor channel connected low pressure generator (B2), low pressure generator (B2) has liquid refrigerant pipe which passes through throttle (I2) and then connects condenser (C2), and low pressure generator (B2) has refrigerant vapor channel connected condenser (C2), high pressure generator (A2) has liquid refrigerant pipe which passes through liquid refrigerant pump (H2) and then connects evaporator (D2), evaporator (D2) has refrigerant vapor channel connected absorber (E2), high pressure generator (A2) and evaporator (D2) separately have the residual heat medium pipe connected external, condenser (C2) has the cooling medium pipe connected external. Absorber (E2) has the heated medium pipe connected external, wherein the solution tandem cycle is adopted as following, and that high pressure generator (A2) has the concentrated solution pipe which passes through solution pump (F2), the first solution heat exchanger (J2) and then connects absorber (E2) is changed to that high pressure generator (A2) has the concentrated solution pipe which passes through solution pump (F2), the first solution heat exchanger (J2), absorber (E2) and then connects the new added steam bleeding chamber (1), or that low pressure generator (B2) has the concentrated solution pipe which passes through the second solution pump (G2), the second solution heat exchanger (K2) and then connects absorber (E2) is changed to that low pressure generator (B2) has the concentrated solution pipe which passes through the second solution pump (G2), the second solution heat exchanger (K2), absorber (E2) and then connects the new added steam bleeding chamber (1), the new added steam bleeding chamber (1) has the concentrated solution pipe which passes through the new added solution pump (3) and the new added solution heat exchanger (5) and then connects the new added absorber (2), the new added absorber (2) has the dilute solution pipe which passes through the new added solution heat exchanger (5) and then connects absorber (E2), wherein that absorber (E2) has the heated medium pipe connected external is changed to that absorber (E2) has refrigerant vapor channel connected the new added absorber (2) after that condenser (C2) or evaporator (D2) add the liquid refrigerant pipe which passes through the new added liquid refrigerant pump (4) and then connects absorber (E2), or that absorber (E2) has the heated medium pipe connected external is changed to that absorber (E2) has refrigerant vapor channel connected the new added absorber (2) after that condenser (C2) has the liquid refrigerant pipe which passes through liquid refrigerant pump (H2) and then connects absorber (E2), at the same time, that condenser (C2) has the liquid refrigerant pipe which passes through liquid refrigerant pump (H2) and then connects evaporator (D2) is adjusted to that condenser (C2) has the liquid refrigerant pipe which passes through liquid refrigerant pump (H2), the new added throttle (6) and then connects evaporator (D2), wherein the new added steam bleeding chamber (1) has refrigerant vapor channel connected condenser (C2), and the new added absorber (2) has the heated medium pipe connected external, the single stage double-effect second-type absorption heat pump completes the first stage improving of residual heat temperature, absorber (E2) heats up the liquid refrigerant flowing therethrough, and the liquid refrigerant becomes refrigerant vapor provided to the new added absorber (2), absorber (E2) heats up the solution flowing therethrough, after being partially vaporized, the solution enters the new added steam bleeding chamber (1), the refrigerant vapor produced by the new added steam bleeding chamber (1) enters condenser (C2), at the same time, the concentrated solution enters the new added absorber (2), absorbs the refrigerant vapor came from the first absorber (D1) and provides the high temperature heating load to the heated medium, thus achieving the two-stage high temperature second-type absorption heat pump based on the single stage double-effect second-type absorption heat pump.

10. The second-type high temperature absorption heat pump, produced in accordance with the method of claim 1, comprising: the new added steam bleeding chamber (1), the new added absorber (2), the new added liquid refrigerant pump (4) or the new added throttle (6), the new added solution pump (3), the new added solution heat exchanger (5) and the recuperative single stage tandem double-effect second-type absorption heat pump, and the recuperative single stage tandem double-effect second-type absorption heat pump comprises the third solution heat exchanger (P2), the second absorber (L2), the steam bleeding chamber (M2), the third solution pump (N2), the second evaporator (Q2), the second throttle (R2) and the single stage tandem double-effect second-type absorption heat pump which comprises high pressure generator (A2), low pressure generator (B2), condenser (C2), evaporator (D2), the first absorber (E2), solution pump (F2), liquid refrigerant pump (H2), throttle (I2), the first solution heat exchanger (J2) and the second solution heat exchanger (K2), wherein in the recuperative single stage tandem double-effect second-type absorption heat pump, that low pressure generator (B2) has the concentrated solution pipe which passes through solution pump (F2), the first solution heat exchanger (J2) and the second solution heat exchanger (K2) and then connects the first absorber (E2) is adjusted to that low pressure generator (B2) has the concentrated solution pipe which passes through solution pump (F2), the first solution heat exchanger (J2), the second solution heat exchanger (K2), the first absorber (E2) and then connects the steam bleeding chamber (M2), and the steam bleeding chamber (M2) has the concentrated solution pipe which passes through the third solution pump (N2), the third solution heat exchanger (P2) and then connects the second absorber (L2), the second absorber (L2) has the dilute solution pipe which passes through the third solution heat exchanger (P2) and then connects the first absorber (E2), the steam bleeding chamber (M2) has refrigerant vapor channel connected condenser (C2), the first evaporator (D2) has refrigerant vapor channel which passes through the second throttle (R2) and then connects the second evaporator (Q2), the second evaporator (Q2) has refrigerant vapor channel connected the second absorber (L2), the second absorber (L2) has the heated medium pipe connected external, that absorber (E2) has the heated medium pipe connected external is canceled, wherein the solution tandem cycle is adopted as following, and that the steam bleeding chamber (M2) has the concentrated solution pipe which passes through the third solution pump (N2), the third solution heat exchanger (P2) and then connects the second absorber (L2) is changed to that the steam bleeding chamber (M2) has the concentrated solution pipe which passes through the third solution pump (N2), the third solution heat exchanger (P2), the second absorber (L2) and then connects the new added steam bleeding chamber (1), the new added steam bleeding chamber (1) has the concentrated solution pipe which passes through the new added solution pump (3) and the new added solution heat exchanger (5) and then connects the new added absorber (2), the new added absorber (2) has the dilute solution pipe which passes through the new added solution heat exchanger (5) and then connects the second absorber (L2), wherein that the second absorber (L2) has the heated medium pipe connected external is changed to that the second absorber (L2) has refrigerant vapor channel connected the new added absorber (2) after that condenser (C2) or evaporator (D2) add the liquid refrigerant pipe which passes through the new added liquid refrigerant pump (4) and then connects the second absorber (L2), or that the second absorber (L2) has the heated medium pipe connected external is changed to that the second absorber (L2) has refrigerant vapor channel connected the new added absorber (2) after that condenser (C2) has the liquid refrigerant pipe which passes through liquid refrigerant pump (H2) and then connects the second absorber (L2), at the same time, that condenser (C2) has the liquid refrigerant pipe which passes through liquid refrigerant pump (H2) and then connects evaporator (D2) is adjusted to that condenser (C2) has the liquid refrigerant pipe which passes through liquid refrigerant pump (H2), the new added throttle (6) and then connects evaporator (D2), wherein the new added steam bleeding chamber (1) has refrigerant vapor channel connected condenser (C2), and the new added absorber (2) has the heated medium pipe connected external, the recuperative single stage double-effect second-type absorption heat pump completes the first stage improving of residual heat temperature, the second absorber (L2) heats up the liquid refrigerant flowing therethrough, and the liquid refrigerant becomes refrigerant vapor provided to the new added absorber (2), the second absorber (L2) heats up the solution therethrough, after being partially vaporized, the solution enters the new added steam bleeding chamber (1), the refrigerant vapor produced by the new added steam bleeding chamber (1) enters condenser (C2), at the same time, the concentrated solution enters the new added absorber (2), absorbs the refrigerant vapor came from the second absorber (L2) and provides the high temperature heating load to the heated medium, thus achieving the two-stage high temperature second-type absorption heat pump based on the recuperative single stage double-effect second-type absorption heat pump.

11. The second-type high temperature absorption heat pump, produced in accordance with the method of claim 1, comprising: the new added steam bleeding chamber (1), the new added absorber (2), the new added liquid refrigerant pump (4) or the new added throttle (6), the new added solution pump (3), the new added solution heat exchanger (5) and the recuperative single stage tandem double-effect second-type absorption heat pump, and the recuperative single stage tandem double-effect second-type absorption heat pump comprises the third solution heat exchanger (P2), the second absorber (L2), the steam bleeding chamber (M2), the third solution pump (N2), the second evaporator (Q2), the second throttle (R2) and the single stage parallel double-effect second-type absorption heat pump which comprises high pressure generator (A2), low pressure generator (B2), condenser (C2), evaporator (D2), the first absorber (E2), the first solution pump (F2), the second solution pump (G2), liquid refrigerant pump (H2), throttle (I2), the first solution heat exchanger (J2) and the second solution heat exchanger (K2), wherein in the recuperative single stage tandem double-effect second-type absorption heat pump, high pressure generator (A2) has the concentrated solution pipe which passes through solution pump (F2), the first solution heat exchanger (J2) and then connects the first absorber (E2) to that high pressure generator (A2) has the concentrated solution pipe which passes through solution pump (F2), the first solution heat exchanger (J2) the first absorber (E2) and then connects the steam bleeding chamber (M2), and that low pressure generator (B2) has the concentrated solution pipe which passes the second solution pump (G2), the second solution heat exchanger (K2) and then connects the first absorber (E2) is adjusted to that the concentrated solution pipe which passes through solution pump (F2), the first solution heat exchanger (J2) from high pressure generator (A2) joins with the other concentrated solution pipe which passes through the second solution pump (G2), the second solution heat exchanger (K2) from low pressure generator (B2), wherein the steam bleeding chamber (M2) has the concentrated solution pipe which passes through the third solution pump (N2), the third solution heat exchanger (P2) and then connects the second absorber (L2), and the second absorber (L2) has the dilute solution pipe which passes through the third solution heat exchanger (P2) and then connects the first absorber (E2), the steam bleeding chamber (M2) has refrigerant vapor channel connected condenser (C2), the first evaporator (D2) has refrigerant vapor channel which passes through the second throttle (R2) and then connects the second evaporator (Q2), the second evaporator (Q2) has refrigerant vapor channel connected the second absorber (L2), the second absorber (L2) has the heated medium pipe connected external, that absorber (E2) has the heated medium pipe connected external is canceled, wherein the solution tandem cycle is adopted as following, and that the steam bleeding chamber (M2) has the concentrated solution pipe which passes through the third solution pump (N2), the third solution heat exchanger (P2) and then connects the second absorber (L2) is changed to that the steam bleeding chamber (M2) has the concentrated solution pipe which passes through the third solution pump (N2), the third solution heat exchanger (P2), the second absorber (L2) and then connects the new added steam bleeding chamber (1), the new added steam bleeding chamber (1) has the concentrated solution pipe which passes through the new added solution pump (3) and the new added solution heat exchanger (5) and then connects the new added absorber (2), the new added absorber (2) has the dilute solution pipe which passes through the new added solution heat exchanger (5) and then connects the second absorber (L2), wherein that the second absorber (L2) has the heated medium pipe connected external is changed to that the second absorber (L2) has refrigerant vapor channel connected the new added absorber (2) after that condenser (C2) or evaporator (D2) add the liquid refrigerant pipe which passes through the new added liquid refrigerant pump (4) and then connects the second absorber (L2), or that the second absorber (L2) has the heated medium pipe connected external is changed to that the second absorber (L2) has refrigerant vapor channel connected the new added absorber (2) after that condenser (C2) has the liquid refrigerant pipe which passes through liquid refrigerant pump (H2) and then connects the second absorber (L2), at the same time, that condenser (C2) has the liquid refrigerant pipe which passes through liquid refrigerant pump (H2) and then connects evaporator (D2) is adjusted to that condenser (C2) has the liquid refrigerant pipe which passes through liquid refrigerant pump (H2), the new added throttle (6) and then connects evaporator (D2), wherein the new added steam bleeding chamber (1) has refrigerant vapor channel connected condenser (C2), and the new added absorber (2) has the heated medium pipe connected external, the recuperative single stage double-effect second-type absorption heat pump completes the first stage improving of residual heat temperature, the second absorber (L2) heats up the liquid refrigerant flowing therethrough, and the liquid refrigerant becomes refrigerant vapor provided to the new added absorber (2), the second absorber (L2) heats up the solution flowing therethrough, after being partially vaporized, the solution enters the new added steam bleeding chamber (1), the refrigerant vapor produced by the new added steam bleeding chamber (1) enters condenser (C2), at the same time, the concentrated solution enters the new added absorber (2), absorbs the refrigerant vapor came from the second absorber (L2) and provides the high temperature heating load to the heated medium, thus achieving the two-stage high temperature second-type absorption heat pump based on the recuperative single stage double-effect second-type absorption heat pump.

12. The second-type high temperature absorption heat pump, produced in accordance with the method of claim 1, comprising: the new added steam bleeding chamber (1), the new added absorber (2), the new added liquid refrigerant pump (4) or the new added throttle (6), the new added solution pump (3), the new added solution heat exchanger (5) and the single generator two-stage second-type absorption heat pump which comprises generator, condenser, evaporator, absorption-evaporator, absorber, solution pump, the first liquid refrigerant pump, throttle or the second liquid refrigerant pump, the first solution heat exchanger, the second solution heat exchanger, wherein the single generator two-stage second-type absorption heat pump, generator (A3) has the concentrated solution pipe which passes through solution pump (F3), the first solution heat exchanger (I3), the second solution heat exchanger (J3) and then connects the second absorber (E3), and the second absorber (E3) has the concentrated solution pipe which passes through the second solution heat exchanger (J3) and then connects absorption-evaporator (D3), absorption-evaporator (D3) has the dilute solution pipe which passes through the first solution heat exchanger (I3) and then connects generator (A3), generator (A3) has refrigerant vapor channel connected condenser (B3), generator (B3) has the liquid refrigerant pipe which passes through the first liquid refrigerant pump (G3), throttle (H3) and then connect evaporator (C3), after that, the pipe connects absorption-evaporator (D3), and then absorption-evaporator (D3) has refrigerant vapor channel connected the second absorber (E3), or after that condenser (B3) has the liquid refrigerant pipe connected evaporator (C3) and evaporator (C3) has the liquid refrigerant pipe which passes through the second liquid refrigerant pump (K3) and then connects absorption-evaporator (D3), absorption-evaporator (D3) has refrigerant vapor channel connected the second absorber (E3), evaporator (C3) has refrigerant vapor channel connected absorption-evaporator (D3), generator (A3) and evaporator (C3) separately have the heated medium pipe connected external, condenser (B3) has the cooling medium pipe connected external, absorber (E3) has the heated medium pipe connected external, wherein the solution tandem cycle is adopted as following, and that generator (A3) has the concentrated solution pipe which passes through solution pump (F3), the first solution heat exchanger (I3), the second solution heat exchanger (J3) and then connects the second absorber (E3) is changed to that generator (A3) has the concentrated solution pipe which passes through solution pump (F3), the first solution heat exchanger (I3), the second solution heat exchanger (J3), the second absorber (E3) and then connects the new added steam bleeding chamber (1), the new added steam bleeding chamber (1) has the concentrated solution pipe which passes through the new added solution pump (3) and the new added solution heat exchanger (5) and then connects the new added absorber (2), the new added absorber (2) has the dilute solution pipe which passes through the new added solution heat exchanger (5) and then connects absorber (E3), wherein that absorber (E3) has the heated medium pipe connected external is changed to that absorber (E3) has refrigerant vapor channel connected the new added absorber (2) after that condenser (B3) or evaporator (C3) add the liquid refrigerant pipe which passes through the new added liquid refrigerant pump (4) and then connects absorber (E3), or that absorber (E3) has the heated medium pipe connected external is changed to that absorber (E3) has refrigerant vapor channel connected the new added absorber (2) after that evaporator (C3) has the liquid refrigerant pipe which passes through the second liquid refrigerant pump (K3) and then connects absorber (E3), at the same time, that evaporator (C3) has the liquid refrigerant pipe which passes through the second liquid refrigerant pump (K3), absorption-evaporator (D3) and then connects evaporator (C3) is adjusted to that evaporator (C3) has the liquid refrigerant pipe which passes through the second liquid refrigerant pump (K3), the new added throttle (6) and then connects absorption-evaporator (D3), wherein the new added steam bleeding chamber (1) has refrigerant vapor channel connected condenser (B3), the new added absorber (2) has the heated medium pipe connected external, the single generator two-stage second-type absorption heat pump completes two stages improving of residual heat temperature, the second absorber (L2) heats up the liquid refrigerant flowing therethrough, and the liquid refrigerant becomes refrigerant vapor provided to the new added absorber (2), and absorber (E3) heats up the liquid refrigerant flowing therethrough, the liquid refrigerant becomes refrigerant vapor provided to the new added absorber (2), after being partially vaporized, the solution enters the new added steam bleeding chamber (1), the refrigerant vapor produced by the new added steam bleeding chamber (1) enters condenser (B3), at the same time, the concentrated solution enters the new added absorber (2), absorbs the refrigerant vapor came from absorber (E3) and provides the high temperature heating load to the heated medium, thus achieving the three-stage high temperature second-type absorption heat pump based on the single generator two-stage second-type absorption heat pump.

13. The second-type high temperature absorption heat pump, as recited in any one of claims 2, 3, 5, 8-9, and 11, further comprising the re-added absorber (a1), and the re-added solution heat exchanger (b1), wherein the new added steam bleeding chamber (1) has the concentrated solution pipe which passes through the new added solution pump (3), the re-added solution heat exchanger (b1) and then connects the re-added absorber (a1), the re-added absorber (a1) has the dilute solution pipe which passes through the re-added solution heat exchanger (b1) and then connects generator or low pressure generator, the first evaporator adds refrigerant vapor pipe connected the re-added absorber (a1), the re-added absorber (a1) has the heated medium pipe connected external, thus obtaining the second-type high temperature absorption heat pump with low-temperature heating-side.

14. The second-type high temperature absorption heat pump, as recited in any one of claims 2, 3, 5, 8-9, and 11, further comprising the re-added absorber (a1), the re-added solution heat exchanger (b1), and the re-added solution regulator (c1), wherein the new added steam bleeding chamber (1) has the concentrated solution pipe which passes through the new added solution pump (3), the re-added solution regulator (c1) and then connects the re-added absorber (a1), the re-added absorber (a1) has the dilute solution pipe which passes through the re-added solution heat exchanger (b1) and then connects generator or low pressure generator, and that generator has concentrated solution which passes through solution pump and one or several solution heat exchanger and then connects absorber is changed to that generator has concentrated solution which passes through solution pump, the re-added solution heat exchanger (b1) and one or several solution heat exchanger and then connects absorber, evaporator adds refrigerant vapor pipe connected the re-added absorber (a1), the re-added absorber (a1) has the heated medium pipe connected external, thus obtaining the second-type high temperature absorption heat pump with low-temperature heating-side.

15. The second-type high temperature absorption heat pump, as recited in any one of claims 2, 3, 5, 8-9, and 11, further comprising the re-added absorber (a1), the re-added solution heat exchanger (b1), the re-added evaporator (d1), and the re-added throttle (e1), wherein that evaporator has liquid refrigerant pipe which passes through the re-added throttle (e1) and then connects the re-added evaporator (d1), and that evaporator has liquid refrigerant channel connected the first absorber or absorption-evaporator is adjusted to that evaporator has refrigerant vapor channel connected the re-added absorber (a1) and the re-added evaporator (d1)

has refrigerant vapor channel connected the first absorber or absorption-evaporator, the new added steam bleeding chamber (1) has the concentrated solution pipe which passes through the new added solution pump (3), the re-added solution heat exchanger (b1) and then connects the re-added absorber (a1), the re-added absorber (a1) has the dilute solution pipe which passes through the re-added solution heat exchanger (b1) and then connects generator or low pressure generator, the re-added absorber (a1) has the heated medium pipe connected external, thus obtaining the second-type high temperature absorption heat pump with low-temperature heating-side.

16. The second-type high temperature absorption heat pump, as recited in any one of claims 2, 3, 5, 8-9, and 11, further comprising the re-added absorber (a1), the re-added solution heat exchanger (b1), the re-added solution regulator (c1), the re-added evaporator (d1), and the re-added throttle (e1), wherein that evaporator has liquid refrigerant pipe which passes through the re-added throttle (e1) and then connects the re-added evaporator (d1), and that evaporator has refrigerant vapor channel connected the first absorber or absorption-evaporator is adjusted to that evaporator has refrigerant vapor channel connected the re-added absorber (a1) and the re-added evaporator (d1) has refrigerant vapor channel connected the first absorber or absorption-evaporator, the new added steam bleeding chamber (1) has the concentrated solution pipe which passes through the new added solution pump (3), the re-added solution heat exchanger (b1) and then connects the re-added absorber (a1), the re-added absorber (a1) has the dilute solution pipe which passes through the re-added solution heat exchanger (b1) and then connects generator or low pressure generator, the re-added absorber (a1) has the heated medium pipe connected external, thus obtaining the second-type high temperature absorption heat pump with low-temperature heating-side.

17. The second-type high temperature absorption heat pump, as recited in any one of claim 2, further comprising the recuperative steam bleeding chamber, the recuperative absorber, the recuperative solution pump and the recuperative solution heat exchanger based on the single evaporator second-type high temperature absorption heat pumps formed by adding the new added steam bleeding chamber (1), the new added absorber (2), the new added liquid refrigerant pump (4) or the new added throttle (6), the new added solution pump (3) and the new added solution heat exchanger (5), wherein that recuperative steam bleeding chamber (a2) has the concentrated solution pipe which passes through recuperative solution pump (c2) and recuperative solution heat exchanger (d2) and then connects recuperative absorber (b2), recuperative absorber (b2) has the dilute solution pipe which passes through recuperative solution heat exchanger (d2), the new added absorber (2) and then connects recuperative steam bleeding chamber (a2), absorber adds refrigerant vapor channel connected recuperative absorber (b2), recuperative steam bleeding chamber (a2) has refrigerant vapor channel connected condenser, recuperative absorber (b2) has the heated medium pipe connected external, that the new added absorber (2) has the heated medium pipe connected external, thus obtaining the recuperative high temperature second-type absorption heat pump, wherein that aimed at the second-type high temperature absorption heat pump which is formed by adding the new added steam bleeding chamber (1), the new added absorber (2), the new added liquid refrigerant pump (4) or the new added throttle (6), the new added solution pump (3) and the new added solution heat exchanger (5), the new added second steam bleeding chamber (7), the new added second absorber (8), the new added throttle (10) or the new added second liquid refrigerant pump (12), the new added second solution pump (9) and the new added second solution heat exchanger (11), recuperative steam bleeding chamber, recuperative absorber, recuperative solution pump and recuperative solution heat exchanger are added, wherein that recuperative steam bleeding chamber (a2) has the concentrated solution pipe which passes through recuperative solution pump (c2) and recuperative solution heat exchanger (d2) and then connects recuperative absorber (b2), recuperative absorber (b2) has the dilute solution pipe which passes through recuperative solution heat exchanger (d2), the new added second absorber (8) and then connects recuperative steam bleeding chamber (a2), absorber which the new added absorber (2) provides refrigerant vapor to connects recuperative absorber (b2), or the new added absorber (2) connects recuperative absorber (b2), recuperative steam bleeding chamber (a2) has the refrigerant vapor channel connected condenser, recuperative absorber (b2) has the heated medium pipe connected external, the new added second absorber (8) has the heated medium pipe connected external, thus obtaining the recuperative high temperature second-type absorption heat pump.

18. The second-type high temperature absorption heat pump, as recited in any one of claim 2, further comprising the recuperative steam bleeding chamber, the recuperative absorber, the recuperative first solution pump, the recuperative solution heat exchanger or the recuperative second solution pump based on the single evaporator second-type high temperature absorption heat pump formed by adding the new added steam bleeding chamber (1), the new added absorber (2), the new added liquid refrigerant pump (4) or the new added throttle (6), the new added solution pump (3) and the new added solution heat exchanger (5), wherein that he new added steam bleeding chamber (1) has the concentrated solution pipe which passes through the new added solution pump (3) and the new added solution heat exchanger (5) and then connects the new added absorber (2) is changed to that he new added steam bleeding chamber (1) has the concentrated solution pipe which passes through the new added solution pump (3) and the new added solution heat exchanger (5), the new added absorber (2) and then connects recuperative steam bleeding chamber (a2), recuperative steam bleeding chamber (a2) has the concentrated solution pipe which passes through recuperative first solution pump (c2) and recuperative solution heat exchanger (d2) and then connects recuperative absorber (b2), recuperative absorber (b2) has the dilute solution pipe which passes through recuperative solution heat exchanger (d2) or passes recuperative second solution pump too and then connects the new added absorber (2), absorber adds refrigerant vapor channel connected recuperative absorber (b2), recuperative steam bleeding chamber (a2) has refrigerant vapor channel connected condenser, recuperative absorber (b2) has the heated medium pipe connected external, the new added absorber (2) has the heated medium pipe connected external, thus obtaining the recuperative high temperature second-type absorption heat pump, wherein that aimed at the second-type high temperature absorption heat pump which is formed by adding the new added steam bleeding chamber (1), the new added absorber (2), the new added liquid refrigerant pump (4) or the new added throttle (6), the new added solution pump (3) and the new added solution heat exchanger (5), the new added second steam bleeding chamber (7), the new added second absorber (8), the new added throttle (10) or the new added second liquid refrigerant pump (12), the new added second solution pump (9) and the new added second solution heat exchanger (11), recuperative steam bleeding chamber, recuperative absorber, recuperative first solution pump, recuperative solution heat exchanger or recuperative second solution pump are added, wherein that the pipe from the new added second steam bleeding chamber (7) passes through the new added second solution pump (9) and the new added second solution heat exchanger (11) and then connects the new added second absorber (8) is changed to that the pipe from the new added second steam bleeding chamber (7) passes through the new added second solution pump (9) and the new added second solution heat exchanger (11), the new added second absorber (8) and then connects recuperative steam bleeding chamber (a2), recuperative steam bleeding chamber (a2) has the concentrated solution pipe which passes through recuperative solution pump (c2) and recuperative solution heat exchanger (d2) and then connects recuperative absorber (b2), recuperative absorber (b2) has the dilute solution pipe which passes through recuperative solution heat exchanger (d2) or passes recuperative second solution pump too and then connects the new added second absorber (8), absorber which the new added absorber (2) provides refrigerant vapor to connects recuperative absorber (b2), or the new added absorber (2) connects recuperative absorber (b2), recuperative steam bleeding chamber (a2) has the refrigerant vapor channel connected condenser, recuperative absorber (b2) has the heated medium pipe connected external, the new added second absorber (8) has the heated medium pipe connected external, thus obtaining the recuperative high temperature second-type absorption heat pump.

19. A method of improving a heating temperature of a heat pump comprising steps of: forming a heating load in an absorber (D1) and dividing the heating load into two parts, wherein one part of the heating load heats up a solution flowing through a solution heat exchanger (5), the absorber (D1) forms a new added absorber (2), the solution is vaporized and then enters a steam bleeding chamber (1), the other part of the heating load heats up a liquid refrigerant flowing through a liquid refrigerant pump (4), the absorber (D1) forms an evaporator (C1), and the liquid refrigerant becomes refrigerant vapor provided to the new added absorber (2);

after a vapor phase and a liquid phase of the solution entering the steam bleeding chamber (1) is separated, the refrigerant vapor entering a condenser (B1) while the concentrated solution flowing through a solution pump (3), the solution heat exchanger (5) and then connecting the new added absorber (2);

then the concentrated solution in the absorber (2) absorbing the refrigerant vapor came from the absorber (D1) and providing a high temperature heating load to a heated medium; the refrigerant vapor, entering the condenser (B1) from the steam bleeding chamber (1), releasing heat to a cooling medium and becoming a liquid refrigerant;

after the liquid refrigerant flowing through a liquid refrigerant pump (F1), the liquid refrigerant pump (4) and the absorber (D1) where it absorbs heat and becomes refrigerant vapor with high temperature entering the new added absorber (2), wherein a solution concentration entering the new added absorber (2) from the steam bleeding chamber (1) is higher than the one entering the absorber (D1) from the generator (A1), a temperature of the refrigerant vapor entering the new added absorber (2) from the absorber (D1) is higher than the one entering the absorber (D1) from the evaporator (C1), thereby, an exothermic temperature of the new added absorber (2) is much higher than the one of the absorber (D1).

20. The second-type high temperature absorption heat pump, produced in accordance with the method of claim 19, comprising: the new added steam bleeding chamber (1), the new added absorber (2), the new added liquid refrigerant pump (4) or the new added throttle (6), the new added solution pump (3), the new added solution heat exchanger (5) and the single stage second-type absorption heat pump which comprises the generator (A1), the condenser (B1), the evaporator (C1), the absorber (D1), the solution pump (E1), the liquid refrigerant pump (F1) and the solution heat exchanger (G1), wherein the single stage second-type absorption heat pump, generator (A1) has the concentrated solution pipe which passes through solution pump (E1), solution heat exchanger (G1) and then connects absorber (D1), and absorber (D1) the dilute solution pipe which passes through solution heat exchanger (G1) and then connects generator (A1), generator (A1) has refrigerant vapor pipe connected condenser (B1), condenser (B1) has the liquid refrigerant pipe which passes through liquid refrigerant pump (F1) and then connects evaporator (C1), evaporator (C1) has the refrigerant vapor channel connected absorber (D1), generator (A1) and evaporator (C1) has the residual heat pipe connected external, condenser (B1) has the liquid refrigerant channel connected absorber (D1), generator (A1) and evaporator have the residual heat medium pipe connected external, condenser (B1) has the cooling medium pipe connected external, and absorber (D1) has the heated medium pipe connected external, wherein the solution independent cycle is adopted as following, and the new added steam bleeding chamber (1) has the concentrated solution pipe which passes through the new added solution pump (3) and the new added solution heat exchanger (5) and then connects the new added absorber (2), the new added absorber (2) has the dilute solution pipe which passes through the new added solution heat exchanger (5), absorber (D1) and then connects the new added steam bleeding chamber (1), wherein that absorber (D1) has the heated medium pipe connected external is changed to that absorber (D1) has refrigerant vapor channel connected the new added absorber (2) after that condenser (B1) or evaporator (C1) add the liquid refrigerant pipe which passes through the new added liquid refrigerant pump (4) and then connects absorber, or that absorber (D1) has the heated medium pipe connected external is changed to that absorber (D1) has refrigerant vapor channel connected the new added absorber (2) after that condenser (B1) has the liquid refrigerant pipe which passes through liquid refrigerant pump (F1) and then connects absorber (D1), at the same time, that condenser (B1) has the liquid refrigerant pipe which passes through liquid refrigerant pump (F1) and then connects evaporator (C1) is adjusted to that condenser (B1) has the liquid refrigerant pipe which passes through liquid refrigerant pump (F1), the new added throttle (6) and then connects evaporator (C1), wherein that the new added steam bleeding chamber (1) has refrigerant vapor channel connected condenser (B1), and the new added absorber (2) has the heated medium pipe connected external, such that the single stage second-type absorption heat pump completes the first stage improving of residual heat temperature, and absorber (D1) heats up the liquid refrigerant flowing therethrough, the liquid refrigerant becomes refrigerant vapor provided to the new added absorber (2), absorber (D1) heats up the solution flowing therethrough, after being partially vaporized, the solution enters the new added steam bleeding chamber (1), a refrigerant vapor produced by the new added steam bleeding chamber (1) enters condenser (B1), at the same time, the concentrated solution enters the new added absorber (2), absorbs the refrigerant vapor came from absorber (D1) and provides the high temperature heating load to the heated medium, thus achieving the two-stage high temperature second-type absorption heat pump based on the single stage second-type absorption heat pump.

21. The second-type high temperature absorption heat pump, produced in accordance with the method of claim 19, comprising: the new added steam bleeding chamber (1), the new added absorber (2), the new added liquid refrigerant pump (4) or the new added throttle (6), the new added solution pump (3), the new added solution heat exchanger (5) and the recuperative single stage second-type absorption heat pump which comprises generator, condenser, evaporator, the first absorber, the first solution pump, liquid refrigerant pump, the second absorber, the steam bleeding chamber, the second solution pump, the first solution heat exchanger and the second solution heat exchanger, wherein the recuperative single stage second-type absorption heat pump, generator (A1) has the concentrated solution pipe which passes through the first solution pump (E1), the second solution heat exchanger (L1) and then connects the second absorber (H1), and the steam bleeding chamber (I1) has the concentrated solution pipe which passes through the second solution pump (J1), the first solution heat exchanger (G1) and then connects the first absorber (D1), the first absorber (D1) has the dilute solution pipe which passes through the first solution heat exchanger (G1), the second absorber (H1) and then connects the steam bleeding chamber (I1), generator (A1) and the steam bleeding chamber (I1) have refrigerant vapor pipe connected condenser (B1), condenser (B1) has the liquid refrigerant pipe which passes through liquid refrigerant pump (F1) and then connects evaporator (C1), evaporator (C1) has refrigerant vapor channel which separately connects the first absorber (D1) and the second absorber (H1), generator (A1) and evaporator (C1) have the residual heat medium pipe connected external condenser (B1) has the cooling medium pipe connected external, and the first absorber (D1) has the heated medium pipe connected external, wherein the solution independent cycle is adopted as following, and the new added steam bleeding chamber (1) has the concentrated solution pipe which passes through the new added solution pump (3) and the new added solution heat exchanger (5) and then connects the new added absorber (2), the new added absorber (2) has the dilute solution pipe which passes through the new added solution heat exchanger (5), absorber (D1) and then connects the new added steam bleeding chamber (1), wherein that the first absorber (D1) has the heated medium pipe connected external is changed to that the first absorber (D1) has refrigerant vapor channel connected the new added absorber (2) after that condenser (B1) or evaporator (C1) add the liquid refrigerant pipe which passes through the new added liquid refrigerant pump (4) and then connects absorber, or that the first absorber (D1) has the heated medium pipe connected external is changed to that the first absorber (D1) has refrigerant vapor channel connected the new added absorber (2) after that condenser (B1) has the liquid refrigerant pipe which passes through liquid refrigerant pump (F1) and then connects the first absorber (D1), at the same time, that condenser (B1) has the liquid refrigerant pipe which passes through liquid refrigerant pump (F1) and then connects evaporator (C1) is adjusted to that condenser (B1) has the liquid refrigerant pipe which passes through liquid refrigerant pump (F1), the new added throttle (6) and then connects evaporator (C1), wherein that the new added steam bleeding chamber (1) has refrigerant vapor channel connected condenser (B1), and the new added absorber (2) has the heated medium pipe connected external, such that the recuperative single stage second-type absorption heat pump completes the first stage improving of residual heat temperature, the first absorber (D1) heats up the liquid refrigerant flowing therethrough, and the liquid refrigerant becomes refrigerant vapor provided to the new added absorber (2), the first absorber (D1) heats up the solution flowing therethrough, after being partially vaporized, the solution enters the new added steam bleeding chamber (1), the refrigerant vapor produced by the new added steam bleeding chamber (1) enters condenser (B1), at the same time, the concentrated solution enters the new added absorber (2), absorbs the refrigerant vapor came from the first absorber (D1) and provides the high temperature heating load to the heated medium, thus achieving the two-stage high temperature second-type absorption heat pump based on the recuperative single stage second-type absorption heat pump.

22. The second-type high temperature absorption heat pump, produced in accordance with the method of claim 19, comprising: the new added steam bleeding chamber (1), the new added absorber (2), the new added liquid refrigerant pump (4) or the new added throttle (6), the new added solution pump (3), the new added solution heat exchanger (5) and the recuperative single stage second-type absorption heat pump which comprises generator, condenser, the first evaporator, the second evaporator, the first absorber, the first solution pump, liquid refrigerant pump, the second absorber, the steam bleeding chamber, the second solution pump, throttle, the first solution heat exchanger and the second solution heat exchanger, wherein the recuperative single stage second-type absorption heat pump, generator (A1) has the concentrated solution pipe which passes through the first solution pump (E1), the second solution heat exchanger (L1) and then connects the second absorber (H1), and the second absorber (H1) has the dilute solution pipe which passes through the second solution heat exchanger (L1) and then connects generator (A1), the steam bleeding chamber (I1) has the concentrated solution pipe which passes through the second solution pump (J1), the first solution heat exchanger (G1) and then connects the first absorber (D1), the first absorber (D1) has the dilute solution pipe which passes through the first solution heat exchanger (G1), the second absorber (H1) and then connects the steam bleeding chamber (I1), and generator (A1) and the steam bleeding chamber (I1) have refrigerant vapor pipe connected condenser (B1), condenser (B1) has the liquid refrigerant pipe which passes through liquid refrigerant pump (F1) and then connects the first evaporator (C1), the first evaporator (C1) has liquid refrigerant pipe which passes through throttle (N1) and then connects the second evaporator (M1), the first evaporator (C1) has refrigerant vapor channel connected the first absorber (D1), the second evaporator (M1) has refrigerant vapor channel connected the second absorber (H1), and generator (A1), the first evaporator (C1), the second evaporator (M1) have the residual heat medium pipe connected external, condenser (B1) has the cooling medium pipe connected external. The first absorber (D1) has the heated medium pipe connected external, wherein the solution independent cycle is adopted as following, and the new added steam bleeding chamber (1) has the concentrated solution pipe which passes through the new added solution pump (3) and the new added solution heat exchanger (5) and then connects the new added absorber (2), the new added absorber (2) has the dilute solution pipe which passes through the new added solution heat exchanger (5), absorber (D1) and then connects the new added steam bleeding chamber (1), wherein that the first absorber (D1) has the heated medium pipe connected external is changed to that the first absorber (D1) has refrigerant vapor channel connected the new added absorber (2) after that condenser (B1) or the first evaporator (C1) add the liquid refrigerant pipe which passes through the new added liquid refrigerant pump (4) and then connects absorber, or that the first absorber (D1) has the heated medium pipe connected external is changed to that the first absorber (D1) has refrigerant vapor channel connected the new added absorber (2) after that condenser (B1) has the liquid refrigerant pipe which passes through liquid refrigerant pump (F1) and then connects the first absorber (D1), at the same time, that condenser (B1) has the liquid refrigerant pipe which passes through liquid refrigerant pump (F1) and then connects the first evaporator (C1) is adjusted to that condenser (B1) has the liquid refrigerant pipe which passes through liquid refrigerant pump (F1), the new added throttle (6) and then connects the first evaporator (C1), wherein that the new added steam bleeding chamber (1) has refrigerant vapor channel connected condenser (B1), and the new added absorber (2) has the heated medium pipe connected external, such that the recuperative single stage second-type absorption heat pump completes the first stage improving of residual heat temperature, the first absorber (D1) heats up the liquid refrigerant flowing therethrough, and the liquid refrigerant becomes refrigerant vapor provided to the new added absorber (2), and the first absorber (D1) heats up the solution flowing therethrough, after being partially vaporized, the solution enters the new added steam bleeding chamber (1), the refrigerant vapor produced by the new added steam bleeding chamber (1) enters condenser (B1), at the same time, the concentrated solution enters the new added absorber (2), absorbs the refrigerant vapor came from the first absorber (D1) and provides the high temperature heating load to the heated medium, thus achieving the two-stage high temperature second-type absorption heat pump based on the recuperative single stage second-type absorption heat pump.

23. The second-type high temperature absorption heat pump, as recited in claim 21 or 22, wherein that the first absorber (D1) has the refrigerant vapor pipe connected the new added absorber (2) after that the new added liquid refrigerant pump (4) or liquid refrigerant pump (F1) has the liquid refrigerant pipe connected the first absorber (D1) is adjusted to that the second absorber (H1) has the refrigerant vapor pipe connected the new added absorber (2) after that the new added liquid refrigerant pump (4) or liquid refrigerant pump (F1) has the liquid refrigerant pipe connected the second absorber (H1), wherein that the recuperative single stage second-type absorption heat pump completes the first stage improving of residual heat temperature, and the second absorber (H1) heats up the liquid refrigerant flowing therethrough and the liquid refrigerant becomes refrigerant vapor provided to the new added absorber (2), the first absorber (D1) heats up the solution flowing therethrough, after being partially vaporized, the solution enters the new added steam bleeding chamber (1), the refrigerant vapor produced by the new added steam bleeding chamber (1) enters condenser (B1), at the same time, the concentrated solution enters the new added absorber (2), absorbs the refrigerant vapor came from the second absorber (H1) and provides the high temperature heating load to the heated medium, and when the first absorber (D1) has the heated medium pipe connected external, the second absorber (L2) and the new added absorber (2) separately provide heat to the heated medium, thus achieving the two-stage high temperature second-type absorption heat pump based on the recuperative single stage double-effect second-type absorption heat pump.

24. The second-type high temperature absorption heat pump, produced in accordance with the method of claim 19, comprising: the new added steam bleeding chamber (1), the new added absorber (2), the new added liquid refrigerant pump (4) or the new added throttle (6), the new added solution pump (3), the new added solution heat exchanger (5) and the single stage tandem double-effect second-type absorption heat pump which comprises high pressure generator (A2), low pressure generator (B2), condenser (C2), evaporator (D2), absorber (E2), solution pump (F2), liquid refrigerant pump (H2), throttle (I2), the first solution heat exchanger (J2) and the second solution heat exchanger (K2), wherein the single stage tandem double-effect second-type absorption heat pump, high pressure generator (A2) has the concentrated solution pipe which passes through the first solution heat exchanger (J2) and then connects low pressure generator (B2), and low pressure generator (B2) has the concentrated solution pipe which passes through the first solution heat exchanger (J2) and the second solution heat exchanger (K2) and then connects absorber (E2), absorber (E2) has the dilute solution pipe which passes through the second solution heat exchanger (K2) and then connects high pressure generator (A2), after that high pressure generator (A2) refrigerant vapor channel connected low pressure generator (B2), low pressure generator (B2) liquid refrigerant pipe which passes through throttle (I2) and then connects condenser (C2), low pressure generator (B2) has refrigerant vapor channel connected condenser (C2), condenser (C2) has liquid refrigerant pipe which passes through liquid refrigerant pump (H2) and then connects evaporator (D2), evaporator (D2) has refrigerant vapor channel connected absorber (E2), high pressure generator (A2) and evaporator (D2) separately have the residual heat medium pipe connected external, condenser (C2) has the cooling medium pipe connected external, absorber (E2) has the heated medium pipe connected external, wherein the solution independent cycle is adopted as following, and the new added steam bleeding chamber (1) has the concentrated solution pipe which passes through the new added solution pump (3) and the new added solution heat exchanger (5) and then connects the new added absorber (2), the new added absorber (2) has the dilute solution pipe which passes through the new added solution heat exchanger (5), absorber (E2) and then connects the new added steam bleeding chamber (1), wherein that absorber (E2) has the heated medium pipe connected external is changed to that absorber (E2) has refrigerant vapor channel connected the new added absorber (2) after that condenser (C2) or evaporator (D2) adds the liquid refrigerant pipe which passes through the new added liquid refrigerant pump (4) and then connects absorber (E2), or that absorber (E2) has the heated medium pipe connected external is changed to that absorber (E2) has refrigerant vapor channel connected the new added absorber (2) after that condenser (C2) has the liquid refrigerant pipe which passes through liquid refrigerant pump (H2) and then connects absorber (E2), at the same time, that condenser (C2) has the liquid refrigerant pipe which passes through liquid refrigerant pump (H2) and then connects evaporator (D2) is adjusted to that condenser (C2) has the liquid refrigerant pipe which passes through liquid refrigerant pump (H2), the new added throttle (6) and then connects evaporator (D2), wherein the new added steam bleeding chamber (1) has refrigerant vapor channel connected condenser (C2), and the new added absorber (2) has the heated medium pipe connected external, such that the single stage double-effect second-type absorption heat pump completes the first stage improving of residual heat temperature, absorber (E2) heats up the liquid refrigerant flowing therethrough, and the liquid refrigerant becomes refrigerant vapor provided to the new added absorber (2), and absorber (E2) heats up the solution flowing therethrough, after being partially vaporized, the solution enters the new added steam bleeding chamber (1), the refrigerant vapor produced by the new added steam bleeding chamber (1) enters condenser (C2), at the same time, the concentrated solution enters the new added absorber (2), absorbs the refrigerant vapor came from the first absorber (D1) and provides the high temperature heating load to the heated medium, thus achieving the two-stage high temperature second-type absorption heat pump based on the single stage double-effect second-type absorption heat pump.

25. The second-type high temperature absorption heat pump, produced in accordance with the method of claim 19, comprising: the new added steam bleeding chamber (1), the new added absorber (2), the new added liquid refrigerant pump (4) or the new added throttle (6), the new added solution pump (3), the new added solution heat exchanger (5) and the single stage parallel double-effect second-type absorption heat pump which comprises high pressure generator (A2), low pressure generator (B2), condenser (C2), evaporator (D2), absorber (E2), the first solution pump (F2), the second solution pump (G2), liquid refrigerant pump (H2), throttle (I2), the first solution heat exchanger (J2) and the second solution heat exchanger (K2), wherein the single stage tandem double-effect second-type absorption heat pump, high pressure generator (A2) has the concentrated solution pipe which passes through the first solution pump (F2), the first solution heat exchanger (J2) and then connects absorber (E2), absorber (E2) has the dilute solution pipe which passes through the first solution heat exchanger (J2) and then connects high pressure generator (A2), low pressure generator (B2) has the concentrated solution pipe which passes through the second solution pump (G2), the second solution heat exchanger (K2) and then connects absorber (E2), absorber (E2) has the dilute solution pipe which passes through the second solution heat exchanger (K2) and then connects low pressure generator (B2), after that high pressure generator (A2) refrigerant vapor channel connected low pressure generator (B2), low pressure generator (B2) has liquid refrigerant pipe which passes through throttle (I2) and then connects condenser (C2), low pressure generator (B2) has refrigerant vapor channel connected condenser (C2), high pressure generator (A2) has liquid refrigerant pipe which passes through liquid refrigerant pump (H2) and then connects evaporator (D2), evaporator (D2) has refrigerant vapor channel connected absorber (E2), high pressure generator (A2) and evaporator (D2) separately have the residual heat medium pipe connected external, condenser (C2) has the cooling medium pipe connected external, absorber (E2) has the heated medium pipe connected external, wherein the solution independent cycle is adopted as following, and the new added steam bleeding chamber (1) has the concentrated solution pipe which passes through the new added solution pump (3) and the new added solution heat exchanger (5) and then connects the new added absorber (2), the new added absorber (2) has the dilute solution pipe which passes through the new added solution heat exchanger (5), absorber (E2) and then connects the new added steam bleeding chamber (1), wherein that absorber (E2) has the heated medium pipe connected external is changed to that absorber (E2) has refrigerant vapor channel connected the new added absorber (2) after that condenser (C2) or evaporator (D2) add the liquid refrigerant pipe which passes through the new added liquid refrigerant pump (4) and then connects absorber (E2), or that absorber (E2) has the heated medium pipe connected external is changed to that absorber (E2) has refrigerant vapor channel connected the new added absorber (2) after that condenser (C2) has the liquid refrigerant pipe which passes through liquid refrigerant pump (H2) and then connects absorber (E2), at the same time, that condenser (C2) has the liquid refrigerant pipe which passes through liquid refrigerant pump (H2) and then connects evaporator (D2) is adjusted to that condenser (C2) has the liquid refrigerant pipe which passes through liquid refrigerant pump (H2), the new added throttle (6) and then connects evaporator (D2), wherein the new added steam bleeding chamber (1) has refrigerant vapor channel connected condenser (C2), and the new added absorber (2) has the heated medium pipe connected external, the single stage double-effect second-type absorption heat pump completes the first stage improving of residual heat temperature, absorber (E2) heats up the liquid refrigerant flowing therethrough, and the liquid refrigerant becomes refrigerant vapor provided to the new added absorber (2). Absorber (E2) heats up the solution flowing therethrough, after being partially vaporized, the solution enters the new added steam bleeding chamber (1), the refrigerant vapor produced by the new added steam bleeding chamber (1) enters condenser (C2), at the same time, the concentrated solution enters the new added absorber (2), absorbs the refrigerant vapor came from the first absorber (D1) and provides the high temperature heating load to the heated medium, thus achieving the two-stage high temperature second-type absorption heat pump based on the single stage double-effect second-type absorption heat pump.

26. The second-type high temperature absorption heat pump, produced in accordance with the method of claim 19, comprising: the new added steam bleeding chamber (1), the new added absorber (2), the new added liquid refrigerant pump (4) or the new added throttle (6), the new added solution pump (3), the new added solution heat exchanger (5) and the recuperative single stage tandem double-effect second-type absorption heat pump, wherein the recuperative single stage tandem double-effect second-type absorption heat pump comprises the second solution heat exchanger (K2), the second absorber (L2), the steam bleeding chamber (M2), the third solution pump (N2) or the fourth solution pump (O2) and the single stage tandem double-effect second-type absorption heat pump which comprises high pressure generator (A2), low pressure generator (B2), condenser (C2), evaporator (D2), the first absorber (E2), the first solution pump (F2), the second solution pump (G2), liquid refrigerant pump (H2), throttle (I2), and solution heat exchanger (J2), wherein in the recuperative single stage tandem double-effect second-type absorption heat pump, the second solution pump (G2) is canceled, and that high pressure generator (A2) has the concentrated solution pipe which passes through the second solution pump (G2), the first solution heat exchanger (J2) and then connects absorber (E2) is adjusted to that high pressure generator (A2) has the concentrated solution pipe which passes through the second solution pump (G2), the first solution heat exchanger (J2), absorber (E2) and then connects the steam bleeding chamber (M2), and the steam bleeding chamber (M2) has the concentrated solution pipe which passes through the third solution pump (N2), the second solution heat exchanger (K2) and then connects the second absorber (L2), the second absorber (L2) has the dilute solution pipe which passes through the second solution heat exchanger (K2) or the fourth solution pump (O2) and then connects absorber (E2), the steam bleeding chamber (M2) has refrigerant vapor channel connected condenser (C2), evaporator (D2) has refrigerant vapor channel connected the second absorber (L2), the second absorber (L2) has the heated medium pipe connected external, that absorber (E2) has the heated medium pipe connected external is canceled, wherein the solution tandem cycle is adopted as following, and that the steam bleeding chamber (M2) has the concentrated solution pipe which passes through the third solution pump (N2), the second solution heat exchanger (K2) and then connects the second absorber (L2) is changed to that the steam bleeding chamber (M2) has the concentrated solution pipe which passes through the third solution pump (N2), the second solution heat exchanger (K2), the second absorber (L2) and then connects the new added steam bleeding chamber (1), the new added steam bleeding chamber (1) has the concentrated solution pipe which passes through the new added solution pump (3) and the new added solution heat exchanger (5) and then connects the new added absorber (2), the new added absorber (2) has the dilute solution pipe which passes through the new added solution heat exchanger (5) and then connects the second absorber (L2), wherein that the second absorber (L2) has the heated medium pipe connected external is changed to that the second absorber (L2) has refrigerant vapor channel connected the new added absorber (2) after that condenser (C2) or evaporator (D2) add the liquid refrigerant pipe which passes through the new added liquid refrigerant pump (4) and then connects the second absorber (L2), or that the second absorber (L2) has the heated medium pipe connected external is changed to that the second absorber (L2) has refrigerant vapor channel connected the new added absorber (2) after that condenser (C2) has the liquid refrigerant pipe which passes through liquid refrigerant pump (H2) and then connects the second absorber (L2), at the same time, that condenser (C2) has the liquid refrigerant pipe which passes through liquid refrigerant pump (H2) and then connects evaporator (D2) is adjusted to that condenser (C2) has the liquid refrigerant pipe which passes through liquid refrigerant pump (H2), the new added throttle (6) and then connects evaporator (D2), wherein the new added steam bleeding chamber (1) has refrigerant vapor channel connected condenser (C2), and the new added absorber (2) has the heated medium pipe connected external, the recuperative single stage double-effect second-type absorption heat pump completes the first stage improving of residual heat temperature, the second absorber (L2) heats up the liquid refrigerant flowing therethrough, and the liquid refrigerant becomes refrigerant vapor provided to the new added absorber (2), the second absorber (L2) heats up the solution flowing therethrough, after being partially vaporized, the solution enters the new added steam bleeding chamber (1), the refrigerant vapor produced by the new added steam bleeding chamber (1) enters condenser (C2), at the same time, the concentrated solution enters the new added absorber (2), absorbs the refrigerant vapor came from the second absorber (L2) and provides the high temperature heating load to the heated medium, thus achieving the two-stage high temperature second-type absorption heat pump based on the recuperative single stage double-effect second-type absorption heat pump.

27. The second-type high temperature absorption heat pump, produced in accordance with the method of claim 19, comprising the new added steam bleeding chamber (1), the new added absorber (2), the new added liquid refrigerant pump (4) or the new added throttle (6), the new added solution pump (3), the new added solution heat exchanger (5) and the recuperative single stage tandem double-effect second-type absorption heat pump, and the recuperative single stage tandem double-effect second-type absorption heat pump comprises the second solution heat exchanger (K2), the second absorber (L2), the steam bleeding chamber (M2), the third solution pump (N2), the second evaporator (Q2), the second throttle (R2) and the single stage tandem double-effect second-type absorption heat pump which comprises high pressure generator (A2), low pressure generator (B2), condenser (C2), evaporator (D2), the first absorber (E2), the first solution pump (F2), the second solution pump (G2), liquid refrigerant pump (H2), throttle (I2), and solution heat exchanger (J2), wherein the recuperative single stage tandem double-effect second-type absorption heat pump, the steam bleeding chamber (M2) has the concentrated solution pipe which passes through the third solution pump (N2), the second solution heat exchanger (K2) and then connects the second absorber (L2), the second absorber (L2) has the dilute solution pipe which passes through the second solution heat exchanger (K2), the first absorber (E2) and then connects the steam bleeding chamber (M2), the steam bleeding chamber (M2) has refrigerant vapor channel connected condenser (C2), evaporator (D2) has refrigerant vapor channel which passes through the second throttle (R2) and then connects the second evaporator (Q2), the second evaporator (Q2) has refrigerant vapor channel connected the second absorber (L2), the second absorber (L2) has the heated medium pipe connected external, that absorber (E2) has the heated medium pipe connected external is canceled, wherein the solution independent cycle is adopted as following, and that the steam bleeding chamber (M2) has the concentrated solution pipe which passes through the third solution pump (N2), the second solution heat exchanger (K2) and then connects the second absorber (L2) is changed to that the steam bleeding chamber (M2) has the concentrated solution pipe which passes through the third solution pump (N2), the second solution heat exchanger (K2), the second absorber (L2) and then connects the new added steam bleeding chamber (1), and the new added steam bleeding chamber (1) has the concentrated solution pipe which passes through the new added solution pump (3) and the new added solution heat exchanger (5) and then connects the new added absorber (2), the new added absorber (2) has the dilute solution pipe which passes through the new added solution heat exchanger (5), the second absorber (L2) and then connects the new added steam bleeding chamber (1), wherein that the second absorber (L2) has the heated medium pipe connected external is changed to that the second absorber (L2) has refrigerant vapor channel connected the new added absorber (2) after that condenser (C2) or evaporator (D2) adds the liquid refrigerant pipe which passes through the new added liquid refrigerant pump (4) and then connects the second absorber (L2), or that the second absorber (L2) has the heated medium pipe connected external is changed to that the second absorber (L2) has refrigerant vapor channel connected the new added absorber (2) after that condenser (C2) has the liquid refrigerant pipe which passes through liquid refrigerant pump (H2) and then connects the second absorber (L2), at the same time, that condenser (C2) has the liquid refrigerant pipe which passes through liquid refrigerant pump (H2) and then connects evaporator (D2) is adjusted to that condenser (C2) has the liquid refrigerant pipe which passes through liquid refrigerant pump (H2), the new added throttle (6) and then connects evaporator (D2), wherein the new added steam bleeding chamber (1) has refrigerant vapor channel connected condenser (C2), the new added absorber (2) has the heated medium pipe connected external, the recuperative single stage double-effect second-type absorption heat pump completes the first stage improving of residual heat temperature, the second absorber (L2) heats up the liquid refrigerant flowing therethrough, and the liquid refrigerant becomes refrigerant vapor provided to the new added absorber (2), the second absorber (L2) heats up the solution flowing therethrough, after being partially vaporized, the solution enters the new added steam bleeding chamber (1), the refrigerant vapor produced by the new added steam bleeding chamber (1) enters condenser (C2), at the same time, the concentrated solution enters the new added absorber (2), absorbs the refrigerant vapor came from the second absorber (L2) and provides the high temperature heating load to the heated medium, thus achieving the two-stage high temperature second-type absorption heat pump based on the recuperative single stage double-effect second-type absorption heat pump.

28. The second-type high temperature absorption heat pump, produced in accordance with the method of claim 19, comprising: the new added steam bleeding chamber (1), the new added absorber (2), the new added liquid refrigerant pump (4) or the new added throttle (6), the new added solution pump (3), the new added solution heat exchanger (5) and the recuperative single stage tandem double-effect second-type absorption heat pump, and the recuperative single stage tandem double-effect second-type absorption heat pump comprises the third solution heat exchanger (P2), the second absorber (L2), the steam bleeding chamber (M2), the third solution pump (N2) and the single stage tandem double-effect second-type absorption heat pump which comprises high pressure generator (A2), low pressure generator (B2), condenser (C2), evaporator (D2), the first absorber (E2), solution pump (F2), liquid refrigerant pump (H2), throttle (I2), the first solution heat exchanger (J2) and the second solution heat exchanger (K2), wherein the recuperative single stage tandem double-effect second-type absorption heat pump, the steam bleeding chamber (M2) has the concentrated solution pipe which passes through the third solution pump (N2), the third solution heat exchanger (P2) and then connects the second absorber (L2), and the second absorber (L2) has the dilute solution pipe which passes through the third solution heat exchanger (P2), the first absorber (E2) and then connects the steam bleeding chamber (M2), the steam bleeding chamber (M2) has refrigerant vapor channel connected condenser (C2), evaporator (D2) has refrigerant vapor channel connected the second absorber (L2), the second absorber (L2) has the heated medium pipe connected external, that absorber (E2) has the heated medium pipe connected external is canceled, wherein the solution independent cycle is adopted as following, and the new added steam bleeding chamber (1) has the concentrated solution pipe which passes through the new added solution pump (3) and the new added solution heat exchanger (5) and then connects the new added absorber (2), the new added absorber (2) has the dilute solution pipe which passes through the new added solution heat exchanger (5), the second absorber (L2) and then connects the new added steam bleeding chamber (1), wherein that the second absorber (L2) has the heated medium pipe connected external is changed to that the second absorber (L2) has refrigerant vapor channel connected the new added absorber (2) after that condenser (C2) or evaporator (D2) add the liquid refrigerant pipe which passes through the new added liquid refrigerant pump (4) and then connects the second absorber (L2), or that the second absorber (L2) has the heated medium pipe connected external is changed to that the second absorber (L2) has refrigerant vapor channel connected the new added absorber (2) after that condenser (C2) has the liquid refrigerant pipe which passes through liquid refrigerant pump (H2) and then connects the second absorber (L2), at the same time, that condenser (C2) has the liquid refrigerant pipe which passes through liquid refrigerant pump (H2) and then connects evaporator (D2) is adjusted to that condenser (C2) has the liquid refrigerant pipe which passes through liquid refrigerant pump (H2), the new added throttle (6) and then connects evaporator (D2), wherein the new added steam bleeding chamber (1) has refrigerant vapor channel connected condenser (C2), the new added absorber (2) has the heated medium pipe connected external, the recuperative single stage double-effect second-type absorption heat pump completes the first stage improving of residual heat temperature, the second absorber (L2) heats up the liquid refrigerant flowing therethrough, and the liquid refrigerant becomes refrigerant vapor provided to the new added absorber (2), the second absorber (L2) heats up the solution flowing therethrough, after being partially vaporized, the solution enters the new added steam bleeding chamber (1), the refrigerant vapor produced by the new added steam bleeding chamber (1) enters condenser (C2), at the same time, the concentrated solution enters the new added absorber (2), absorbs the refrigerant vapor came from the second absorber (L2) and provides the high temperature heating load to the heated medium, thus achieving the two-stage high temperature second-type absorption heat pump based on the recuperative single stage double-effect second-type absorption heat pump.

29. The second-type high temperature absorption heat pump, produced in accordance with the method of claim 19, comprising: the new added steam bleeding chamber (1), the new added absorber (2), the new added liquid refrigerant pump (4) or the new added throttle (6), the new added solution pump (3), the new added solution heat exchanger (5) and the recuperative single stage parallel double-effect second-type absorption heat pump, and the recuperative single stage tandem double-effect second-type absorption heat pump comprises the third solution heat exchanger (P2), the second absorber (L2), the steam bleeding chamber (M2), the third solution pump (N2) and the single stage parallel double-effect second-type absorption heat pump which comprises high pressure generator (A2), low pressure generator (B2), condenser (C2), evaporator (D2), the first absorber (E2), the first solution pump (F2), the second solution pump (G2), liquid refrigerant pump (H2), throttle (I2), the first solution heat exchanger (J2) and the second solution heat exchanger (K2), wherein the recuperative single stage tandem double-effect second-type absorption heat pump, the steam bleeding chamber (M2) has the concentrated solution pipe which passes through the third solution pump (N2), the third solution heat exchanger (P2) and then connects the second absorber (L2), and the second absorber (L2) has the dilute solution pipe which passes through the third solution heat exchanger (P2), the first absorber (E2) and then connects the steam bleeding chamber (M2), the steam bleeding chamber (M2) has refrigerant vapor channel connected condenser (C2), evaporator (D2) has refrigerant vapor channel connected the second absorber (L2), the second absorber (L2) has the heated medium pipe connected external, that absorber (E2) has the heated medium pipe connected external is canceled, wherein the solution independent cycle is adopted as following, and the new added steam bleeding chamber (1) has the concentrated solution pipe which passes through the new added solution pump (3) and the new added solution heat exchanger (5) and then connects the new added absorber (2), the new added absorber (2) has the dilute solution pipe which passes through the new added solution heat exchanger (5), the second absorber (L2) and then connects the new added steam bleeding chamber (1), wherein that the second absorber (L2) has the heated medium pipe connected external is changed to that the second absorber (L2) has refrigerant vapor channel connected the new added absorber (2) after that condenser (C2) or evaporator (D2) add the liquid refrigerant pipe which passes through the new added liquid refrigerant pump (4) and then connects the second absorber (L2), or that the second absorber (L2) has the heated medium pipe connected external is changed to that the second absorber (L2) has refrigerant vapor channel connected the new added absorber (2) after that condenser (C2) has the liquid refrigerant pipe which passes through liquid refrigerant pump (H2) and then connects the second absorber (L2), at the same time, that condenser (C2) has the liquid refrigerant pipe which passes through liquid refrigerant pump (H2) and then connects evaporator (D2) is adjusted to that condenser (C2) has the liquid refrigerant pipe which passes through liquid refrigerant pump (H2), the new added throttle (6) and then connects evaporator (D2), wherein the new added steam bleeding chamber (1) has refrigerant vapor channel connected condenser (C2), the new added absorber (2) has the heated medium pipe connected external, the recuperative single stage double-effect second-type absorption heat pump completes the first stage improving of residual heat temperature, the second absorber (L2) heats up the liquid refrigerant flowing therethrough, and the liquid refrigerant becomes refrigerant vapor provided to the new added absorber (2), and the second absorber (L2) heats up the solution flowing therethrough, after being partially vaporized, the solution enters the new added steam bleeding chamber (1), the refrigerant vapor produced by the new added steam bleeding chamber (1) enters condenser (C2), at the same time, the concentrated solution enters the new added absorber (2), absorbs the refrigerant vapor came from the second absorber (L2) and provides the high temperature heating load to the heated medium, thus achieving the two-stage high temperature second-type absorption heat pump based on the recuperative single stage double-effect second-type absorption heat pump.

30. The second-type high temperature absorption heat pump, produced in accordance with the method of claim 19, comprising: the new added steam bleeding chamber (1), the new added absorber (2), the new added liquid refrigerant pump (4) or the new added throttle (6), the new added solution pump (3), the new added solution heat exchanger (5) and the single generator two-stage second-type absorption heat pump which comprises generator, condenser, evaporator, absorption-evaporator, absorber, solution pump, the first liquid refrigerant pump, throttle or the second liquid refrigerant pump, the first solution heat exchanger, the second solution heat exchanger, wherein the single generator two-stage second-type absorption heat pump, generator (A3) has the concentrated solution pipe which passes through solution pump (F3), the first solution heat exchanger (I3), the second solution heat exchanger (J3) and then connects the second absorber (E3), and the second absorber (E3) has the concentrated solution pipe which passes through the second solution heat exchanger (J3) and then connects absorption-evaporator (D3), absorption-evaporator (D3) has the dilute solution pipe which passes through the first solution heat exchanger (I3) and then connects generator (A3), generator (A3) has refrigerant vapor channel connected condenser (B3), generator (B3) has the liquid refrigerant pipe which passes through the first liquid refrigerant pump (G3), throttle (H3) and then connect evaporator (C3). After that, the pipe connects absorption-evaporator (D3), and then absorption-evaporator (D3) has refrigerant vapor channel connected the second absorber (E3), or after that condenser (B3) has the liquid refrigerant pipe connected evaporator (C3) and evaporator (C3) has the liquid refrigerant pipe which passes through the second liquid refrigerant pump (K3) and then connects absorption-evaporator (D3), absorption-evaporator (D3) has refrigerant vapor channel connected the second absorber (E3), evaporator (C3) has refrigerant vapor channel connected absorption-evaporator (D3), generator (A3) and evaporator (C3) separately have the heated medium pipe connected external, condenser (B3) has the cooling medium pipe connected external, absorber (E3) has the heated medium pipe connected external, wherein the solution independent cycle is adopted as following, and the new added steam bleeding chamber (1) has the concentrated solution pipe which passes through the new added solution pump (3) and the new added solution heat exchanger (5) and then connects the new added absorber (2), the new added absorber (2) has the dilute solution pipe which passes through the new added solution heat exchanger (5), absorber (E3) and then connects the new added steam bleeding chamber (1), wherein that absorber (E3) has the heated medium pipe connected external is changed to that absorber (E3) has refrigerant vapor channel connected the new added absorber (2) after that condenser (B3) or evaporator (C3) adds the liquid refrigerant pipe which passes through the new added liquid refrigerant pump (4) and then connects absorber (E3), or that absorber (E3) has the heated medium pipe connected external is changed to that absorber (E3) has refrigerant vapor channel connected the new added absorber (2) after that evaporator (C3) has the liquid refrigerant pipe which passes through the second liquid refrigerant pump (K3) and then connects absorber (E3), at the same time, that evaporator (C3) has the liquid refrigerant pipe which passes through the second liquid refrigerant pump (K3) and then connects absorption-evaporator (D3) is adjusted to that evaporator (C3) has the liquid refrigerant pipe which passes through the second liquid refrigerant pump (K3), the new added throttle (6) and then connects absorption-evaporator (D3), wherein the new added steam bleeding chamber (1) has refrigerant vapor channel connected condenser (B3), the new added absorber (2) has the heated medium pipe connected external, the single generator two-stage second-type absorption heat pump completes two stages improving of residual heat temperature, the second absorber (L2) heats up the liquid refrigerant flowing therethrough, and the liquid refrigerant becomes refrigerant vapor provided to the new added absorber (2), and absorber (E3) heats up the liquid refrigerant flowing therethrough, the liquid refrigerant becomes refrigerant vapor provided to the new added absorber (2), after being partially vaporized, the solution enters the new added steam bleeding chamber (1), the refrigerant vapor produced by the new added steam bleeding chamber (1) enters condenser (B3), at the same time, the concentrated solution enters the new added absorber (2), absorbs the refrigerant vapor came from absorber (E3) and provides the high temperature heating load to the heated medium, thus achieving the three-stage high temperature second-type absorption heat pump based on the single generator two-stage second-type absorption heat pump.

31. The second-type high temperature absorption heat pump, produced in accordance with the method of claim 19, comprising: the new added second steam bleeding chamber (7), the new added second absorber (8), the new added second throttle (10) or the new added second liquid refrigerant pump (12), the new added second solution pump (9), the new added second solution heat exchanger (11) and any of the second-type high temperature absorption heat pump expounded in claims 2-30, wherein the solution tandem cycle is adopted as following, and that he new added steam bleeding chamber (1) has the concentrated solution pipe which passes through the new added solution pump (3) and the new added solution heat exchanger (5) and then connects the new added absorber (2) is changed to that he new added steam bleeding chamber (1) has the concentrated solution pipe which passes through the new added solution pump (3) and the new added solution heat exchanger (5), the new added absorber (2) and then connects the new added second steam bleeding chamber (7), and the new added second steam bleeding chamber (7) has the concentrated solution pipe which passes through the new added second solution pump (9) and the new added second solution heat exchanger (11) and then connects the new added second absorber (8), the new added second absorber (8) has the dilute solution pipe which passes through the new added second solution heat exchanger (11) and then connects the new added absorber (2), that the new added absorber (2) has the heated medium pipe connected external is changed to that the new added absorption-evaporator (2) has refrigerant vapor channel connected the new added second absorber (8) after that condenser or evaporator adds the liquid refrigerant pipe which passes through the new added second liquid refrigerant pump (12) and then connects the new added absorber (2), or that the new added absorber (2) has the heated medium pipe connected external is changed to that the new added absorption-evaporator (2) has refrigerant vapor channel connected the new added second absorber (8) after that condenser has the liquid refrigerant pipe which passes through liquid refrigerant pump and then connects the new added absorber (2), at the same time, that condenser has liquid refrigerant pipe connected other components such as evaporator or absorber or absorption-evaporator is adjusted to that condenser has the liquid refrigerant pipe which passes through liquid refrigerant pump, the new added second throttle (10) and then connects other components such as evaporator or absorber or absorption-evaporator, wherein the new added second steam bleeding chamber (7) has refrigerant vapor channel connected condenser, the new added second absorber (8) the heated medium pipe connected external, the new added absorber (2) heats up the liquid refrigerant and the liquid refrigerant becomes refrigerant vapor provided to the new added second absorber (8), the new added absorber (2) heats up the solution flowing therethrough, wherein that after being partially vaporized, the solution enters the new added second steam bleeding chamber (7), the refrigerant vapor produced by the new added second steam bleeding chamber (7) enters condenser, at the same time, the concentrated solution enters the new added second absorber (8), absorbs the refrigerant vapor came from the new added absorber (2) and provides the high temperature heating load to the heated medium, thus achieving the corresponding three-stage or multi-stage high temperature second-type absorption heat pump.

32. The second-type high temperature absorption heat pump, produced in accordance with the method of claim 19, comprising: the new added second steam bleeding chamber (7), the new added second absorber (8), the new added second throttle (10) or the new added second liquid refrigerant pump (12), the new added second solution pump (9), the new added second solution heat exchanger (11) and any of the second-type high temperature absorption heat pump expounded in claims 2-30, wherein that the solution independent cycle is adopted as following, the new added second steam bleeding chamber (7) has the concentrated solution pipe which passes through the new added second solution pump (9), the new added second solution heat exchanger (11) and then connects the new added second absorber (8), the new added second absorber (8) has the dilute solution pipe which passes through the new added second solution heat exchanger (11), the new added absorber (2) and then connects the new added second steam bleeding chamber (7), and that the new added absorber (2) has the heated medium pipe connected external is changed to that the new added absorption-evaporator (2) has refrigerant vapor channel connected the new added second absorber (8) after that condenser or evaporator adds the liquid refrigerant pipe which passes through the new added second liquid refrigerant pump (12) and then connects the new added absorber (2), or that the new added absorber (2) has the heated medium pipe connected external is changed to that the new added absorption-evaporator (2) has refrigerant vapor channel connected the new added second absorber (8) after that condenser has the liquid refrigerant pipe which passes through liquid refrigerant pump and then connects the new added absorber (2), at the same time, that condenser has liquid refrigerant pipe connected other components such as evaporator or absorber or absorption-evaporator is adjusted to that condenser has the liquid refrigerant pipe which passes through liquid refrigerant pump, the new added second throttle (10) and then connects other components such as evaporator or absorber or absorption-evaporator, wherein the new added second steam bleeding chamber (7) has refrigerant vapor channel connected condenser, the new added second absorber (8) the heated medium pipe connected external, the new added absorber (2) heats up the liquid refrigerant and the liquid refrigerant becomes refrigerant vapor provided to the new added second absorber (8), the new added absorber (2) heats up the solution which flowing therethrough, wherein that after being partially vaporized, the solution enters the new added second steam bleeding chamber (7), and the refrigerant vapor produced by the new added second steam bleeding chamber (7) enters condenser, at the same time, the concentrated solution enters the new added second absorber (8), absorbs the refrigerant vapor came from the new added absorber (2) and provides the high temperature heating load to the heated medium, thus achieving the corresponding three-stage or multi-stage high temperature second-type absorption heat pump.

33. The second-type high temperature absorption heat pump, as recited in any one of claims 27-29, wherein that the second absorber (L2) has the refrigerant vapor pipe connected the new added absorber (2) after that the new added liquid refrigerant pump (4) or liquid refrigerant pump (H2) has the liquid refrigerant pipe connected the second absorber (L2) is adjusted to that the first absorber (E2) has the refrigerant vapor pipe connected the new added absorber (2) after that the new added liquid refrigerant pump (4) or liquid refrigerant pump (H2) has the liquid refrigerant pipe connected the second absorber (L2), wherein the recuperative single stage second-type absorption heat pump completes the first stage improving of residual heat temperature, and the first absorber (E2) heats up the liquid refrigerant flowing therethrough, and the liquid refrigerant becomes refrigerant vapor provided to the new added absorber (2), the second absorber (L2) heats up the solution flowing therethrough, after being partially vaporized, the solution enters the new added steam bleeding chamber (1), the refrigerant vapor produced by the new added steam bleeding chamber (1) enters condenser (C2), at the same time, the concentrated solution enters the new added absorber (2), absorbs the refrigerant vapor came from the second absorber (L2) and provides the high temperature heating load to the heated medium, when the second absorber (L2) has the heated medium pipe connected external, the second absorber (L2) and the new added absorber (2) separately provide heat to the heated medium, thus achieving the two-stage high temperature second-type absorption heat pump based on the recuperative single stage double-effect second-type absorption heat pump.

* * * * *